US010167126B2

(12) United States Patent
Tacheny et al.

(10) Patent No.: US 10,167,126 B2
(45) Date of Patent: Jan. 1, 2019

(54) BOX WITH INNER BAG FOR LIQUID FOOD

(71) Applicant: INVINEO S.A., Thon (BE)

(72) Inventors: Thierry Tacheny, Thon (BE); Etienne Mertens de Wilmars, Brussels (BE)

(73) Assignee: INVINEO S.A., Thon (BE)

( * ) Notice: Subject to any disclaimer, the term of this patent is extended or adjusted under 35 U.S.C. 154(b) by 28 days.

(21) Appl. No.: 15/366,313

(22) Filed: Dec. 1, 2016

(65) Prior Publication Data

US 2017/0081103 A1 Mar. 23, 2017

Related U.S. Application Data

(63) Continuation-in-part of application No. PCT/BE2015/000026, filed on Jun. 1, 2015.

(30) Foreign Application Priority Data

Jun. 2, 2014 (BE) ..... 2014/0414

(51) Int. Cl.

| | |
|---|---|
| ***B65D 77/06*** | (2006.01) |
| ***B65D 47/24*** | (2006.01) |
| ***B65D 77/20*** | (2006.01) |
| ***B65D 81/38*** | (2006.01) |
| ***B65D 85/72*** | (2006.01) |
| ***B67D 1/08*** | (2006.01) |

(52) U.S. Cl.

CPC ..... *B65D 77/067* (2013.01); *B65D 47/249* (2013.01); *B65D 77/20* (2013.01); *B65D 81/3825* (2013.01); *B65D 85/72* (2013.01); *B67D 1/0857* (2013.01); *B67D 1/0895* (2013.01)

(58) Field of Classification Search

CPC .... B65D 77/067; B65D 77/20; B65D 47/249; B65D 81/3825; B65D 85/72; B67D 1/0857; B67D 1/0895

USPC ..... 222/94–97, 105, 106, 395

See application file for complete search history.

(56) References Cited

U.S. PATENT DOCUMENTS

| | | | |
|---|---|---|---|
| 5,147,071 A | 9/1992 | Rutter et al. | |
| 6,375,048 B1 * | 4/2002 | van der Meer ..... | B67D 1/0462 222/396 |

(Continued)

FOREIGN PATENT DOCUMENTS

| | | |
|---|---|---|
| DE | 553586 | 6/1932 |
| DE | 8907795 | 8/1989 |

(Continued)

OTHER PUBLICATIONS

Written Opinion in related PCT Application Serial No. PCT/EB2015/000026, dated Sep. 18, 2015 (English translation attached).

(Continued)

*Primary Examiner* — Lien Ngo

(74) *Attorney, Agent, or Firm* — Hovey Williams LLP

(57) ABSTRACT

A rigid box with a wall defining an inner chamber into which extends a flexible bag for a liquid or viscous food to be consumed in a suitable serving temperature range, whereby the flexible bag is associated with a part comprising a valve. The box is provided with passages suitable for the flow of an aqueous medium within the inner chamber outside the flexible bag so as to control the temperature of the food to be consumed.

37 Claims, 40 Drawing Sheets

(56) References Cited

U.S. PATENT DOCUMENTS

| | | | | |
|---|---|---|---|---|
| 6,851,579 | B2 | 2/2005 | Savage et al. | |
| 7,478,737 | B2 | 1/2009 | Gosi et al. | |
| 8,424,723 | B2 | 4/2013 | Doelman et al. | |
| 2007/0107459 | A1 | 5/2007 | Strickland et al. | |
| 2009/0057347 | A1 | 3/2009 | Leys et al. | |
| 2009/0078721 | A1 | 3/2009 | Hoffman et al. | |
| 2012/0018459 | A1 | 1/2012 | Richards et al. | |
| 2014/0097201 | A1* | 4/2014 | Otto | B67D 3/00 222/95 |
| 2014/0166694 | A1* | 6/2014 | Otto | B67D 1/0001 222/95 |

FOREIGN PATENT DOCUMENTS

| | | |
|---|---|---|
| DE | 20318865 | 2/2004 |
| DE | 202009014339 | 12/2009 |
| EP | 1277667 | 1/2003 |
| EP | 1645523 | 7/2008 |
| EP | 2514711 | 10/2012 |
| WO | 0176974 | 10/2001 |

OTHER PUBLICATIONS

International Search Report in related PCT Application Serial No. PCT/EB2015/000026, dated Sep. 18, 2015 (English translation attached).

PCT Publication No. WO2015/184513 in related PCT Application Serial No. PCT/EB2015/000026 (English translation attached).

International Search Report and Written Opinion in related PCT Application Serial No. PCT/IB2017/001452, dated Apr. 10, 2018.

* cited by examiner

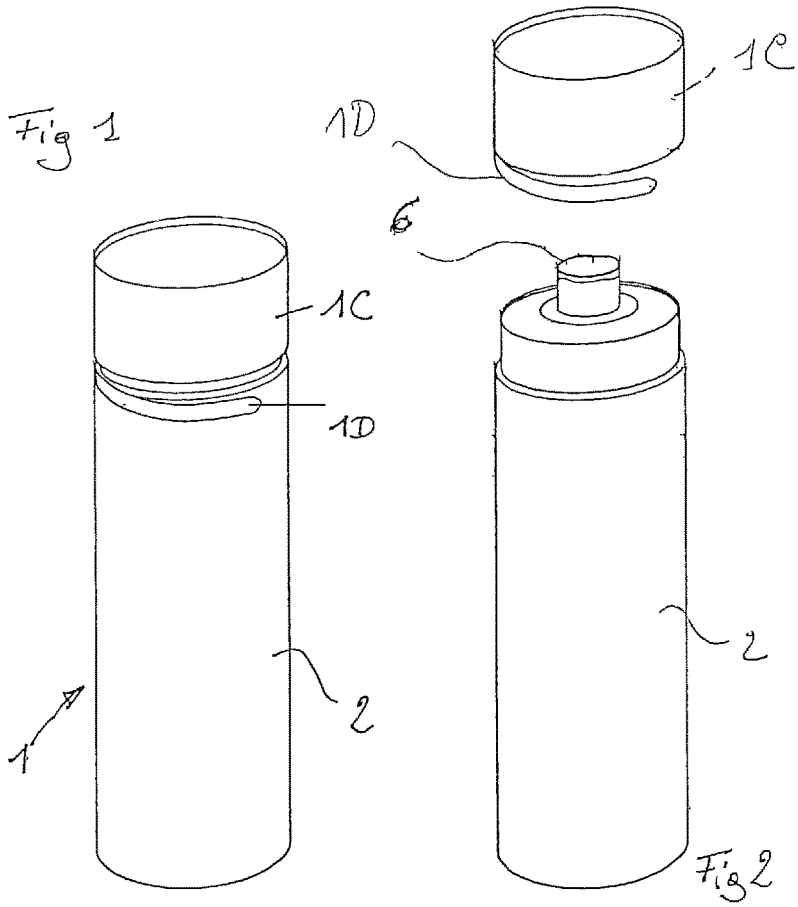
Fig 1
Fig 2
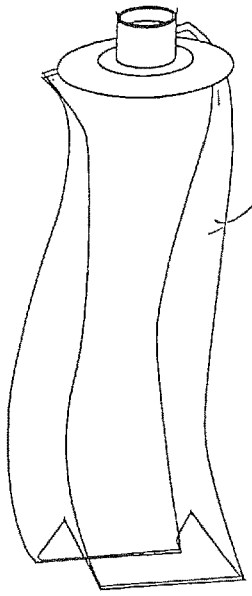
Fig 3
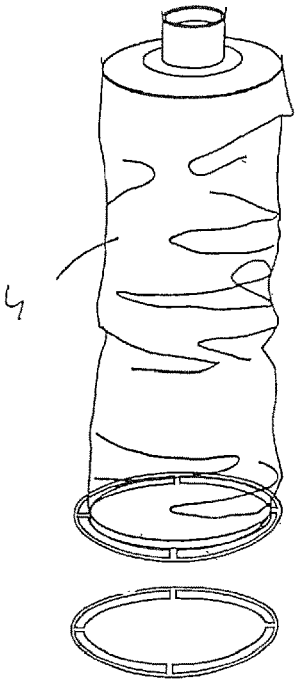
Fig 4

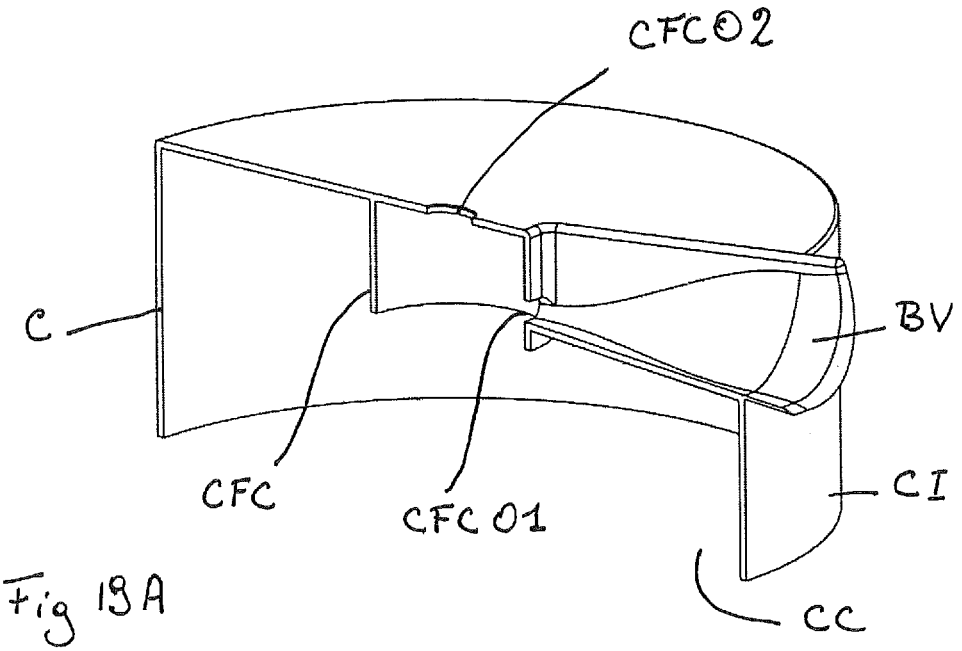
Fig 13A
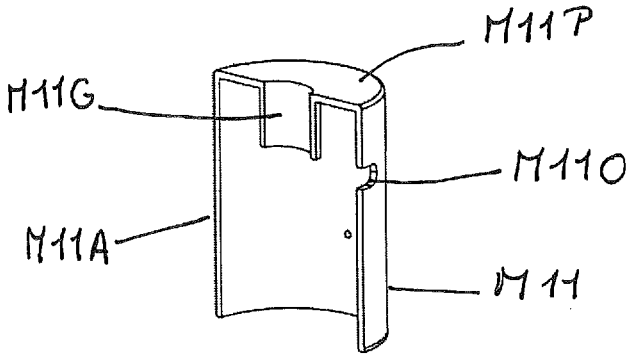
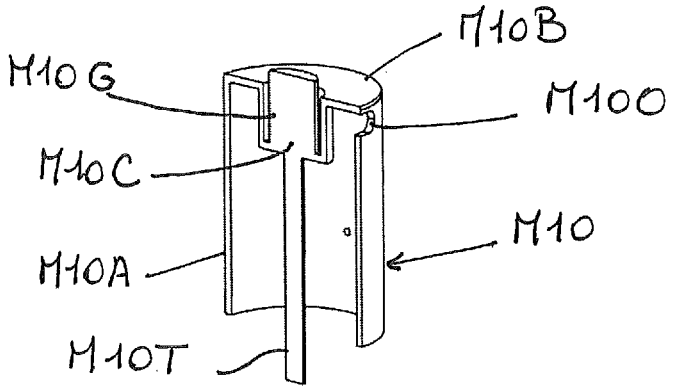

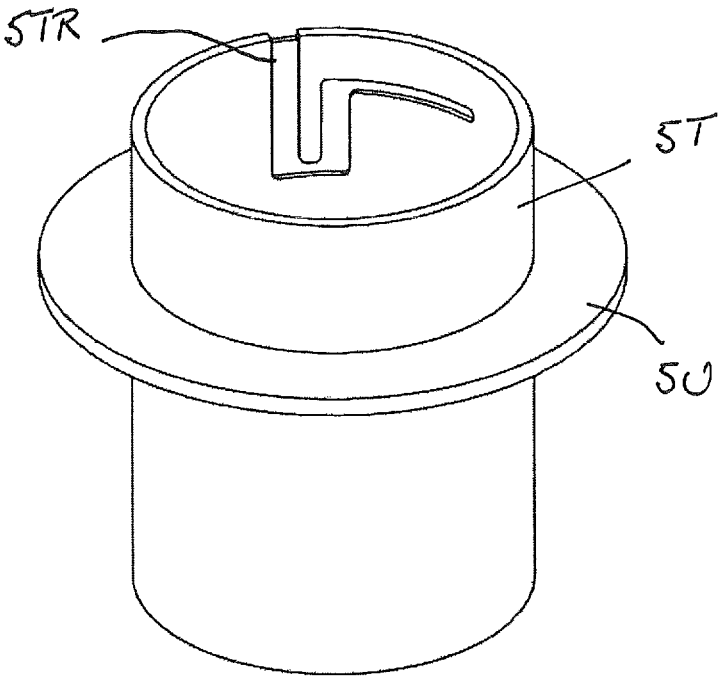
Fig 21A
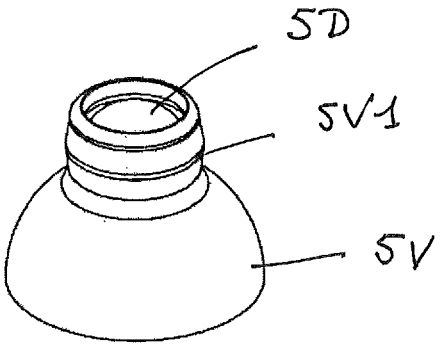
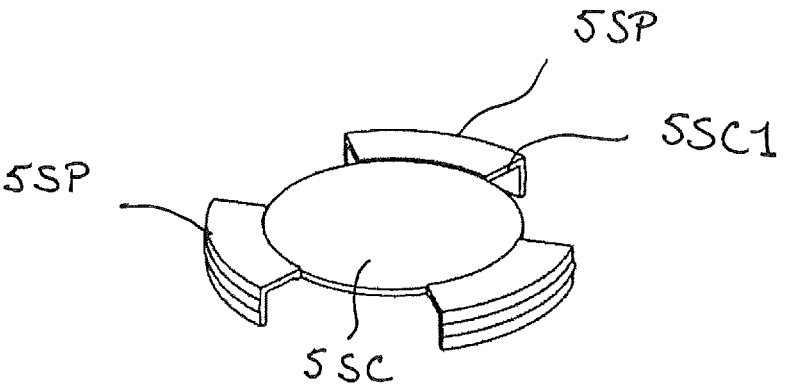

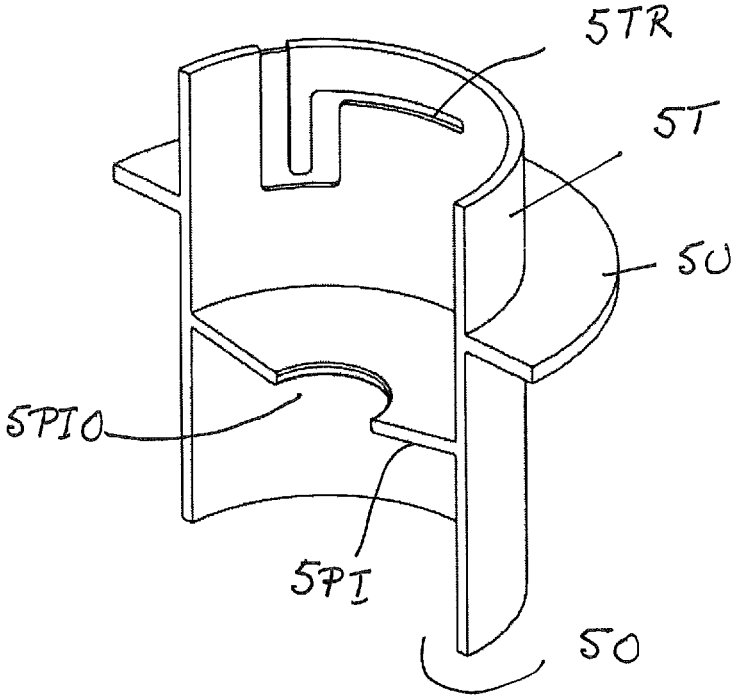
Fig 21B
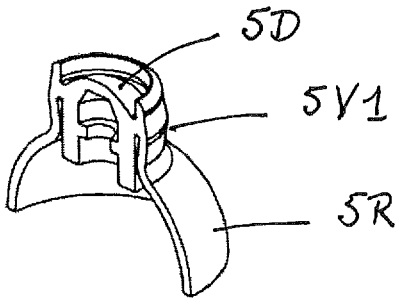
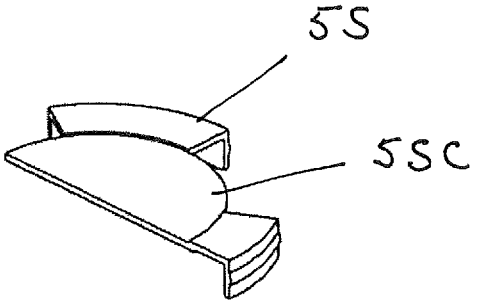

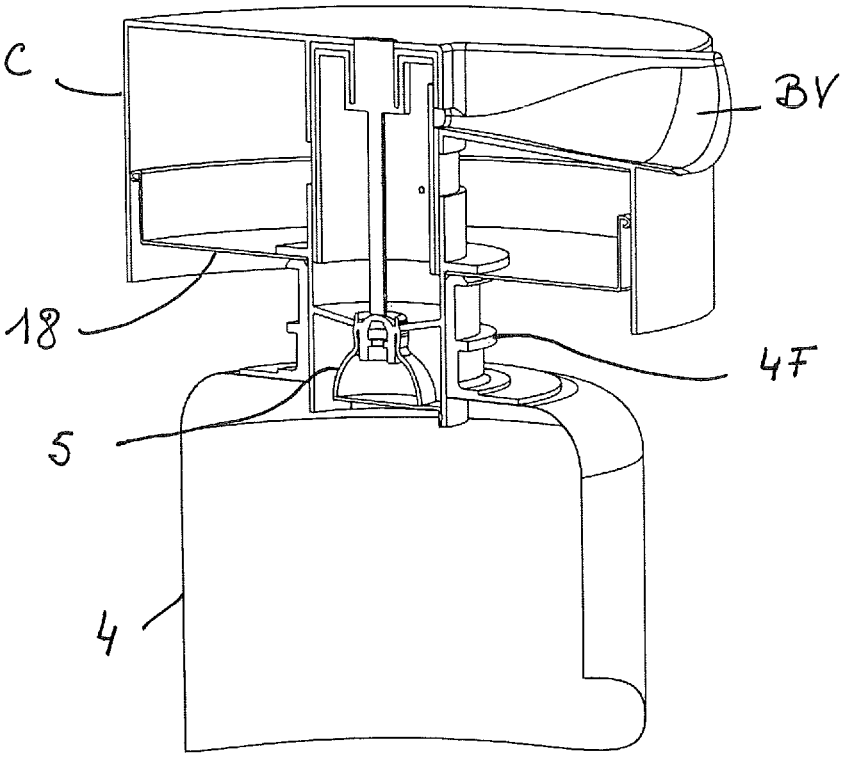
Fig 22
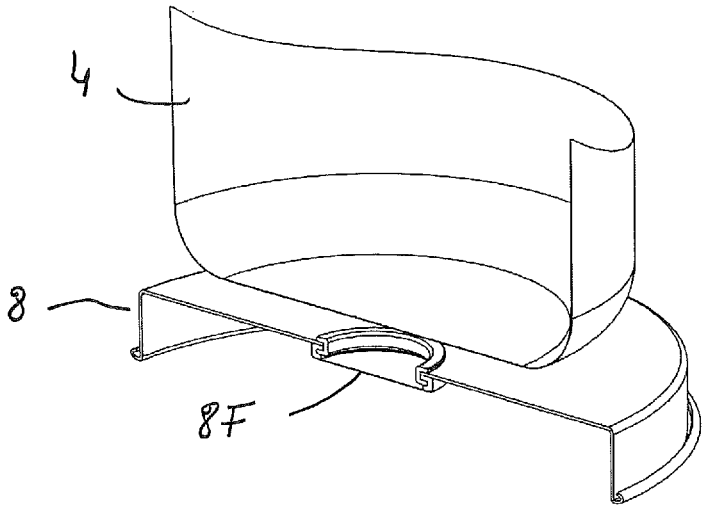

BOX WITH INNER BAG FOR LIQUID FOOD

The present application is a continuation-in-part application of PCT/BE2015/000026 filed on Jun. 1, 2015 and published on Dec. 10, 2015 under number WO 2015/184513, which is incorporated by reference herein in its entirety, and claims the priority benefit of Belgian Patent Application BE 2014/0414 filed on Jun. 2, 2014.

FIELD OF THE INVENTION

The present invention relates to a rigid box with a wall defining an inner chamber into which extends a flexible bag for a liquid or viscous food to be consumed in a suitable serving temperature range, whereby the flexible bag is associated with a part comprising a valve. The box is provided with passages suitable for the flow of an aqueous medium within the inner chamber outside the flexible bag so as to control the temperature of the food to be consumed. Especially, the box of the invention is a rigid box containing a bag designed to contain a liquid or viscous food, this food being intended to be dispensed into a consumer's container, said food being advantageously be kept free of oxygen and preferably of light, to avoid unwanted oxidation of the food and thus ensure better preservation of the food.

THE PRIOR ART

An inner bag housed in an outer bag, the inner bag being filled with liquid while the outer bag is designed to receive air to pressurise the inner bag and allow the liquid to flow, is known from U.S. Pat. No. 6,247,619.

US patent application US2012/0024896 also describes an inner bag housed in an outer bag, the inner bag containing the liquid for consumption while the outer bag contains the ice or refrigerant material.

US patent application US2009/0078721 describes a container designed to receive a bag filled with wine. The container may be placed in a refrigerator. The bag is associated with a means of dispensing, such as a valve with a pushbutton or tap.

U.S. Pat. No. 7,896,199 describes an inner bag housed in an outer bag, for example for containing ice.

The "cubybox", which is a cardboard box containing a bag filled with wine associated with a valve, is also known.

All known devices do not allow circulation of a coolant to provide a temperature as appropriate as possible for the liquid food to be consumed.

In addition, all known devices collect the liquid food or beverage in the vicinity of one end of the bag designed to be oriented downwards. In the case of wine or other beverages, any solid particles present in the beverage are therefore likely to be deposited in the dispensing tap. Furthermore, when the tap is oriented downwards, the risk of loss is considerable in the event of malfunctioning of the tap.

The present invention relates to a box to solve these problems among other things.

BRIEF DESCRIPTION OF THE INVENTION

The invention also relates to an apparatus which can be associated with such a box or boxes, allowing inter alia dispensing from the top without introducing air into the bag while ensuring an appropriate temperature for the food dispensed, with as little noise as possible. Preferably, the same liquid circulates in the box (outside the bag) to ensure an appropriate temperature of the liquid food present in the bag, and to ensure (slight) pressurization of the contents of the bag to allow dispensing of the liquid food without the use of a food dispensing pump. Such an apparatus allows control of the dispensing (without sudden variation in flow rate; dispensing controlled independently from the amount of liquid still present in the bag) according to the pressure of the liquid present in the box outside the bag.

The invention relates to a rigid box of which the wall or walls define an inner chamber into which extends a flexible bag or inner bag for containing a liquid or viscous food to be consumed (e.g. wine, a sauce, an alcoholic beverage, etc.) in a suitable serving temperature range (for example from 3 to 20° C. for wines, spirits, soft drinks, for example from 6 to 12° C. for white or rosé wines, 15 to 20° C. for red wine, 30 to 80° C. for a sauce, etc.). The flexible bag (4) is associated with a part (5) comprising a valve or a part (5) comprising a membrane or associable with a protection means (6) designed to cooperate with a part (7) comprising a valve. The box is advantageously provided or associated with a means for protecting the wall or walls (2) against the liquid aqueous medium for heating or cooling the food to be consumed, i.e. flowing within the inner chamber (3). For example, the wall or walls (2) have advantageously a side (2C) facing the inner chamber (3) resistant to an aqueous medium at a temperature at least close to the appropriate serving temperature range Said box (1) has a lower part (1I) with a bottom (8), an upper part (1S) and at least one passage (9) for the part (5), characterized in that the wall or walls (2) have a side facing the inner chamber (3) designed to withstand an aqueous medium at a temperature at least close to the appropriate serving temperature range. In the box according to the invention, the box (1) has, in the vicinity of its lower part (1I), or is associated with, an element (8A) having at least one passage (10) designed to form a connection between the part of the inner chamber (3) located outside said bag (4) and an inlet and/or outlet pipe (11). The box (1) also has or is associated with an element having at least one passage (9) designed to cooperate with the part (5) associated with said bag (4).

The box of the invention is also a rigid box presenting a container (1) whose wall or walls (2) define an inner chamber (3) in which there extends a soft bag (4) for a liquid or viscous food to be consumed in an appropriate serving temperature range by using an aqueous medium flowing within the inner chamber (3), said bag (4) being associated with a part (5) associated with a valve with a portion with a control device to move the valve between at least an open position and a closed position, said container (1) having a lower part (1I) with a bottom (8) presenting at least one opening (10) which can if necessary be closed by a means (6A) and which communicates with the inner chamber (3), an upper part (1S) with a plate (18) with at least one passage (9) for the part (5) or a portion thereof, in which the box is advantageously provided/associated with a means for protecting the wall or walls (2) against the aqueous medium or in which the wall or walls (2) have advantageously a side (2C) facing the inner chamber (3) resistant to an aqueous medium at a temperature at least close to the appropriate serving temperature range, and wherein the upper part (1S) of the container is associated with a cover (1C) having an opening or passage for an element capable of acting on the control device of the valve, this cover (1C) being associated with a spout (BV), essentially or preferably characterized in that the cover (1C) defines a chamber or hollow (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C).

At least a portion of a side wall (2) of the boxes (of the invention, as disclosed here hereabove and in the attached figures) located between the lower part (1I) and the upper part (1S) comprises preferably along its side facing the inner chamber (3) at least one means for forming one or more guide channels (12) for said aqueous medium and/or is associated with a means for forming one or more guide channels (12), said guide channel(s) (12) being designed so that even in the presence of the flexible bag (4) in the chamber (3), one or more channels (12) are or remain open for passage of the aqueous medium. The bag is preferably made of plastic with an aluminium layer. When the rigid box is opaque, it is possible for some foods to use non-opaque bags.

In the box according to the invention, the wall or walls of the box have advantageously an inner side or surface facing the inner chamber designed to withstand an aqueous medium (e.g. water, possibly with an additive, such as citric acid, a surfactant or a glycol, but preferably drinking water) at a temperature at least close to the appropriate serving temperature range (the temperature of the aqueous medium depends for example on the ambient temperature. When the ambient temperature is greater than the food serving temperature (it is therefore necessary to cool the food or to maintain the food at its serving temperature, avoiding warming due to the ambient temperature), the temperature of the aqueous medium will then advantageously be cooler than the optimum food serving temperature, for example between 1 and 10° C., such as from 2 to 5° C. Conversely, if the food serving temperature is higher than the ambient temperature (it is therefore necessary to heat the food or to maintain the food at its serving temperature, avoiding cooling due to the ambient temperature), the temperature of the aqueous medium will advantageously be greater than the appropriate serving temperature of the food, for example between 1 and 20° C., in particular from 2 to 10° C.

The term "valve" herein also refers to a tap or any other system designed to control the flow of food out of the bag.

The open channel(s) are designed to provide an aqueous medium passage between the wall(s) of the box and the bag, and thus ensure a good flow of the aqueous medium in the box to provide optimum cooling or heating of the food contained in the bag or to maintain a substantially optimal temperature for the food to be consumed.

The aqueous medium introduced into the box also allows the food present in the bag to be pressurized, so as to allow a quantity of food to come out of the bag and the box to be consumed at a temperature close to the optimum temperature.

In addition, the more the bag empties, the greater the amount of aqueous medium present in the box, which will allow a more rapid temperature adjustment of the food in the bag. When the amount of food in the bag is still large, the amount of aqueous medium in the box is reduced. However, once the temperature of the food in the bag has been set, dispensing a quantity of food will have little influence on the temperature of the food present in the bag.

Advantageously, the bag is suspended in the box. This ensures that all solid particles remain in the bottom of the bag and are not served for consumption. This prevents deposits in a dispensing channel or in a valve or tap.

According to the details of preferred embodiments, the boxes according to the invention have one or more of the following features:

The bag (4) is suspended in the box (3), and/or

The box (1) has, near its upper part (1S), at least one passage (14) designed to form a connection between the part of the inner chamber (3) located outside said bag (4) and an inlet and/or outlet pipe, and/or At least a portion of a side wall (2) of the box (1) between the lower part (1I) and the upper part (1S) comprises along its side facing the inner chamber (3) at least one means (12) to form a series of guide channels for said aqueous medium and/or is associated with a means to form one or more guide channels (12), said guide channel(s) (12) being designed so that even in the presence of the flexible bag in the chamber, one or more channels are open to the passage of the aqueous medium, said channels (12) advantageously being distributed along said side wall. Said means to form one or more guide channels (12) is for example a flexible or soft or rigid net-like element capable of surrounding the bag and/or fitting the inner side face of the box, and/or The box comprises one or more side walls (2), a bottom wall (8) forming a bottom and a top wall (18) opposite the bottom wall (8), the bottom wall (8) having at least one passage (14) designed to form a connection between the part of the inner chamber (3) located outside said bag (4) and an inlet and/or outlet pipe (15). The top wall (18) has at least one passage (9) designed to cooperate with the part (5) associated with said bag (4) or comprises the part (5) associated with said bag (4). The passage (14) of the bottom wall forming the bottom is designed to provide both the supply of a liquid in the part of the inner chamber (3) outside the bag (4), and removal or extraction of liquid from said portion of the chamber outside the bag. The passage may be unique or may be separate, for example to channel the flow of incoming liquid at least partially in the portion of the chamber, for example by means of a pipe extending into the chamber and having one end in the vicinity of the upper end, and/or The upper wall (18) is designed to cooperate with a part, advantageously with the part (5) associated with said bag (3), to form a connection between the part of the inner chamber (3) located outside said bag (4) and an inlet and/or outlet pipe (15), and/or The wall or walls (2) of the box are at least partially provided with a coating or layer of thermal insulation (20), and/or The box is formed by (a) a body (1) defining a side wall or walls (2) and having an open lower end (2A) and an open upper end (2B), (b) a bottom part (8) for closing the lower end (2A), said bottom part (8) having at least one passage (10) designed to form a connection between the part of the inner chamber (3) located outside said bag (4) and an inlet and/or outlet pipe (11), and (c) a cover (18) for closing the upper end (B), said cover (18) being designed to be associated with said bag (4), said cover having firstly a passage (17) communicating with the inside of the bag (4) and not with the part or zone of the chamber (3) located outside said bag (4), and secondly at least one passage (14) communicating with the part or zone of the inner chamber (3) located outside the bag (4), and/or The cover (18) is designed to form a connection between the passage or passages (14) communicating with the part or zone of the inner chamber (3) located outside said bag (4) and an inlet and/or outlet pipe (15), and/or The cover (18) has only one passage (9) communicating with the inside of the bag (4), said passage (9) being associated with a part (5) comprising a valve (5V) movable between a closed position opposing the passage of liquid out of the bag and an open position against the action of a biasing means (5R), while the bottom (8) has only an opening or openings communicating with the part of the inner chamber (3) of the box located outside the bag (4), said opening(s) being associated with one or more inlet and/or outlet pipes. The biasing or return means may be a spring or an elastically deformable material which when deformed tends to return to its initial undeformed shape, and/or The part (5) is a pipe (5T) with a flange (5U) resting on or attached to the cover (18) (The flange (5U) is preferably glued or welded to the cover (18). This flange is preferably made of a thermoplastic material enabling welding of the flange on the cover. If necessary, the flange (5U) may also be associated with an additional seal), said pipe (5T) comprising an advantageously tapered inner plate (5PI), preferably with an inclination towards the inside of the chamber (3) and the bag (4) (this allows the liquid or wine possibly present in the pipe (5T) to flow into the bag (4), said inner plate (5PI) having one or more openings, advantageously a central opening (5PIO), said pipe (5T) being associated in its portion (5TI) between the inner plate (5PI) and its open end (5O) directed towards the inside of the chamber (3) and the bag (4), a seat (5S) for the biasing or return means (5R) of the valve (5V), said valve (5V) having a portion (5VI) designed to close off said opening or openings of the inner plate (5PI) in the closed position of said valve (5V), said biasing or return means (5R) pushing said valve (5V) towards the inner plate (5PI) in said closed position (the term "closed position" means a position in which the 5V valve opposes the passage of liquid through the pipe (5T), particularly between its lower open end facing the bag and its upper open end), whereas during the movement of the valve (5V) to the open position against the action of the biasing or return means (5R) (the open position is a position in which liquid passage through the pipe (5T) between its lower opening and its upper opening or vice versa is possible), one or more openings of the plate are no longer closed by the valve (5V). The seat (5S) and/or the portion (5TI) between the inner plate (5PI) and its open end (5O) directed towards the inside of the chamber (3) and the bag (4) has (have) a passage or passages communicating with the inside of the bag (4). Advantageously, the seat (5S) is inserted into the pipe (5T) removably or not, said seat then being advantageously attached to the lower end of the pipe (5T) by a clipping system. The seat then advantageously takes the form of a central plate with 3 to 6 legs, said legs each being designed to collaborate with one or more slit (s) or groove (s) in the bottom part of the pipe (5T) to ensure fastening by clipping, and/or The valve (5V) has the shape of a pressure-deformable bell (5R) extended by a finger (5D), the bell (5R) having an edge (5RB) resting on the seat (5S) and being made of elastomeric material to form the biasing or return means, while the seat (5S) has means to limit the movements of the edge (5RB) of the bell (5R) during its movement into the open position by deformation by pressure exerted on said finger (5D). For example the central plate of the seat has a recess or indentation or protrusions designed to form a point or a bearing area (or abutment) for the base of the bell (5R) and thus limit relative movements of the base of the bell (5R) in relation to the seat (5S), and/or The box is associated with a cover (C) with a spout (BV), said cover (C) being associated with a mechanism (M) designed at least to control the opening of the valve (5V). The box may be marketed with the cover (C) associated with the box or capable of being mounted on the box (removably or not). The cover (C) can also be an element of the apparatus according to the invention. In this case, the cover (C) is mounted detachably on the box. If the cover (C) is mounted on the box, it is advantageously mounted movable on the box between an open position (in which the valve (5V) is in the open position) and a closed position (valve 5V in the closed position). When such a box with a cover is marketed, a system (e.g. a peelable or partially or totally tearable strip) is then provided to hold the cover (C) in the closed position prior to purchase and its placement in a device according to the invention. In such a case, the box with cover (C) will advantageously be marketed with instructions, and may then easily be recycled for reuse after disassembly and cleaning of the cover (C), removal of the cover (18) and the bag (4), installation of a new cover (18) with a new bag (4), and replacement of the cover (C) and a system (peelable or partially or totally tearable) for holding the cover (C) in the closed position, and/or The mechanism (M) designed at least to control the opening of the valve (5V) comprises at least one means (M10) movable between a raised position in which the valve (5V) is in the closed position (to prevent the passage of liquid through the pipe (5T)) and a lowered position in which the valve (5V) is in the open position against the action of the biasing or return means (5R), said means (M10) being adapted to or associated with a means (M11) designed to cooperate with the pipe (5T) in a relative position of said means with respect to said pipe (5T) to hold said means (M10) in the lowered position and maintain the valve (5V) in the open position, and/or The cover (C) has a skirt (CJ) defining a chamber (CC) designed to receive the upper part of the box and its cover (18), the chamber (CC) defined by the skirt (CJ) having a central sleeve (CFC) communicating through a first opening (CFCO1) with the spout (BV) and through a second opening (CFCO2) with the external environment along the top wall of the cover (C), said central sleeve (CFC) being associated with a first whistle (M11) mounted at least partially rotatably with respect to the central sleeve (CFC), said first whistle (M11) having a hollow cylindrical body (M11A) with one end associated with a plate (M11P) with a central opening designed to be positioned opposite the second opening (CFCO2) and with a central guide sleeve (M11G) coaxial with the cylindrical body (M11A) and communicating with the second opening (CFCO2) when said first whistle (M11) is engaged in the central sleeve (CFC). In this embodiment, the means (or second whistle M10) for controlling the valve (5V) is a sleeve (M10A) with one end closed by a plate (M10B) associated with a part (M10C) defining a groove (M10G) open towards the central guide sleeve (M11G) and designed to receive said central guide sleeve (M11G), said part (M10C) carrying a rod or needle (M10T) designed to act on the finger (5D) of the valve (5V) when the latter is in the open position, said sleeve (M10A) being mounted mobile at least in translation relative to the hollow cylindrical body (M11A). Also in this embodiment, the hollow cylindrical body (M11A) has an opening (M11O) which by rotation relative to the central sleeve (CFC) can be brought opposite the first opening (CFCO1) of the central sleeve (CFC), while the sheath (M10A) has an opening (M10O) which by axial translation movement relative to the cylindrical body (M11A) can be brought opposite the opening (M11O) of the hollow cylindrical body (M11A) while preferably the means M11 and/or the means M11 are mounted removably relative to the cover (C) with spout (BV). Removable mounting facilitates operations to clean the cover (C). The whistles (M10 and M11) and the cover (C) are therefore advantageously attached to each other removably, while allowing some relative movement between them, and/or The guide sleeve (M11G) of the whistle (M11) and the groove (M11G) of the means (M10) are designed to permit only relative axial translation movement between them, and/or The hollow cylindrical body (M11A) and the sleeve (M10A) each have a vent hole (M11AE; M10AE) which can be brought opposite one another by relative axial translation movement between the hollow cylindrical body (M11A) and the sleeve (M10A), and/or The hollow cylindrical body (M11A) carries at least one finger (M11AD) on its outer face, and in that the pipe (5T) has on its inner face at least one groove (5TR) open from the upper edge of the pipe (5T) and presenting a path permitting at least a movement comprising a component of relative axial translation movement of the cylindrical body (M11A) with respect to the pipe (5T) and at least a movement comprising a component of relative rotation movement of the cylindrical body (M11A) with respect to the pipe (5T), and/or The passage or passages (14) of the cover communicating with the part or zone of the chamber (3) located outside the bag (4) communicate with a channel (16) extending in the cover (18), said channel (16) surrounding a wall of the passage (17) communicating with the inside of the bag (4) and not with the part or zone of the chamber (3) located outside said bag (4), and/or The passage (14) of the cover communicating with the part or zone of the chamber (3) located outside the bag (4) extends in the body of the cover (18) to ensure good heat exchange between the aqueous medium and the body of the cover (18), at least in its part adjacent to the passage (17) communicating with the inside of the bag (4) and not with the part or zone of the chamber (3) located outside said bag (4), and/or The cover (18) has or comprises a means for suspending the bag in the inner chamber (3), and means designed to ensure its position relative to the side wall or walls (2) of the box, and/or The box comprises a means (21), said means advantageously being a skirt (21) surrounding an opening or the openings of the passage(s) (14) to the inner chamber (3), said skirt (21) being preferably carried by the cover (18) to ensure the presence of at least one volume of air in the part of the inner chamber located outside the bag during filling of the inner chamber (3) with said aqueous medium, and/or The bottom part (8) and the cover (18) each have a flange (10B, 18B) designed to bear on the inner face of the casing (2) defining the side wall or walls of the box (1), said flange (10B, 18B) advantageously being or being advantageously associated with an element (10R, 18R) defining an open circular or annular groove (10S or 18S) defined between two substantially cylindrical walls (10S1, 10S2, 18S1, 18S2) with preferably one or more protrusions (10P, 18P) forming teeth or fingers opposing a movement of withdrawal of the casing (2) relative to the bottom part (8) and the cover (18) when the ends of the casing (2) are engaged in the groove (10S, 18S) of the base part (8) and the cover (18) respectively, said circular or annular groove being advantageously associated with a resilient or deformable layer (10T, 18T) designed to form a seal at least for the liquid between the casing (2) and the cover (18) and the bottom part (8) respectively, and/or The bottom part (8) has an internal face designed to be turned towards the inner chamber (3) of the box (1), and in that, when the box with its bottom part facing downwards bears on a horizontal plane, the inner face of the bottom part (8) has at least one part (8A) having an inclination towards the passage (10) designed to form a connection between the part of the inner chamber (3) located outside said bag (4) and an inlet and/or outlet pipe (11), and/or The box comprises or is designed to be associated with a means (25) for determining the amount of aqueous medium introduced into the inner chamber and/or for determining the amount of liquid or viscous food present in the bag, and/or The box is associated with one or more means of protection (6) to secure the closure of the passages prior to use of the box, and/or The box is associated or capable of being associated with a mobile float element (27) in the inner chamber (3), located between the bag and the lower part, said float element (27) having a lower density than the aqueous medium, and/or The float element (27) is associated or capable of being associated with an element designed to measure a level, and/or The box is designed to withstand a pressure of the aqueous medium in the inner chamber of 1 to 5 bar ($1\times10^5$ Pa to $5\times10^5$ Pa), and/or The box is designed to contain two separate bags (4) containing identical or non-identical liquids and has or is associated with one or more elements having separate passages, a first passage providing communication in the first bag and a second passage providing communication in the second bag, and/or The box has at least one body with a bottom with an upper opening closable by a cover, the box being associated with an inner bag designed to form a liquid-tight barrier for the body of the box and define an inner chamber for the box, said cover having at least one passage (9) designed to cooperate with the part (5) of the flexible bag (4) and a passage or passages (10) designed to form a connection between the part of the inner chamber (3) located outside the bag (4) with one or more inlet/outlet pipes, and/or the cover (1C) is associated with at least one means of positioning (603, 604) of the portion with the control device in the chamber or hollow of the cover, and with at least one retention part (605) for said portion with the control device (601) of the valve (602), said retention part (605) being movable relative to said cover (1C) between a retention position in which said retention part (605) opposes withdrawal of the part with the control device (601) of the valve (602) from the chamber or hollow (600) of the cover (1C), and a non-retention position in which said retention part (605) does not oppose withdrawal of the portion with the control device (601) of the valve (602) from the chamber or hollow (600) of the cover (1C), and/or the cover (1C) has, in its chamber or hollow (600), at least two tabs (603) spaced apart from each other, at least one of which is flexible, said tabs (603) serving as a means to cooperate with the portion with the control device (601) of the valve (602) to ensure positioning of said portion in the chamber or hollow (600) of the cover (1C), and/or the cover (1C) presents a stop (604) in its chamber or hollow (600), said stop serving as a support for a wall (606) of the portion with the control device (601) of the valve (602) to limit or prevent movement of said portion of the valve (602) during relative movement of the control device (601) with respect to said portion of the valve (602), and/or the portion with the control device (601) of the valve (602) has a body (607), while the control device (601) comprises at least one and advantageously two lugs (608) extending outside said body (607) and movable relative to said body (607) against the action of a biasing means (5R) between a first position corresponding to the closed position of the valve (5V) and a second position corresponding to the open position of the valve (5V), said biasing means (5R) exerting a force opposing the movement of said lug or lugs (608) towards its/their second position(s), and/or the tabs (603) extending in the chamber or hollow (600) of the cover (1C) serve as a means of positioning of the lug or lugs (608) of the portion with the control device (601) of the valve (602) in the hollow or chamber (600) of the cover (1C), and/or the lug or lugs (608) is/are mobile against a biasing means (5R) between an adjacent position of a tab or the tabs (608), and a remote position of a tab or the tabs (608), and/or the container (1) has a central axis (A-A), and in which the control device (601) moves in a direction (B-B) perpendicular or substantially perpendicular to said central axis (A-A) of the container (1), and/or the plate (18) of the upper part (1S) has a means (610) cooperating with the cover (1C) to limit and preferably prevent rotation of the cover (1C) relative to the container (1) or to the plate (18), and/or the plate (18) has a passage or a recess (610), while the cover has a protrusion (611) extending in said passage or recess (610) to limit or prevent rotation of the cover relative to the container or to the plate (18), and/or the plate (18) has a passage (610) towards the inner chamber (3) of the container (1), while the protrusion (611) is a pipe carried by the cover (1C), thus enabling passage of air or liquid into the inner chamber (3) via the pipe (611) carried by the cover (1C), a seal (612) advantageously surrounding the pipe (611) to be compressed between a flat support (613) of the pipe (611) and the plate (18) of the upper part (1S) of the container (1), and/or the container (1) has a central axis (A-A), in which the retention part (605) is movable in a direction (C-C) perpendicular to said central axis (A-A), said retention part (605) comprising a spout (BV), an open end (614) of which accommodates one end of an outlet channel (615) of the valve (602), and/or the plate (18) has a first side (18A) facing the inner chamber (3) and a second side (18B) opposite the first side and facing the chamber or hollow (600) of the cover (1C), in which the soft bag (4) is associated with a hollow tip (617), while the valve (602) is associated with an element (618) presenting an inner open channel (619), a transverse section enabling the insertion of the element (618) in the hollow tip (617), and a clamp (620) bearing, possibly with an interposed seal, on the second side (18B) of said plate (18), and in which, advantageously, a seal (621) surrounding said element (618) of the valve (602) bears on the first side (18A) of the plate (18), and is preferably compressed between a far edge (617A), advantageously with a collar, of the hollow tip (617) and said first side (18A) of the plate (18), and/or the retention part (605) is held in position on the cover (1C) by a clip system or a system for insertion of a protrusion (622), possibly carried by a strip (624), in a recess or window (623), and/or the retention part (605) has at least one and advantageously two windows (625) giving access to the control device (601) of the valve (602) located in the hollow or chamber (600) of the cover (1C), the window(s) (625) being positioned to enable the insertion in the hollow or chamber (600) of the cover of an end or ends (630) of a tool (631) to apply a force on the control device (601), said window(s) (625) being advantageously also positioned to enable the insertion of a tool to detach the retention part (605) from the cover (1 C), and/or the bag (4) comprises a first soft element (4B) and a second soft element (4A) bonded together to form a soft pouch, the first element (4B) being less supple than the second element (4A), this second element (4A) having an area facing the inside of the pouch at least 50% and preferably 75% to 300% greater than the area of the first element (4B) facing the inside of the pouch, and in that advantageously the tip (617) of the soft bag is attached to said second soft element (4A) near one of its edges bonded to the first soft element (4A), and/or the soft bag (4) is surrounded by a soft net (626), and/or the cover (1C) has a positioning hollow or recess (627), said hollow or recess extending along the side face (1CL) of the cover (1C), and/or the box is associated with one or more means of protection (6, 6A, 6B, 6C) to secure the closing of a passage or passages or windows before the box is used, and/or Any combinations of these details and features.

The invention further relates to an apparatus for dispensing a quantity of a liquid or to viscous food contained in a bag placed in a box according to the invention, advantageously having one or more of the features and details mentioned above, in a suitable temperature range, said apparatus comprising at least:

A structure (100) with at least one support element (101) for at least one box (1) according to the invention;

A (one or more) tank(s) for an aqueous medium;

A means (103) for adjusting the temperature of at least part of said aqueous medium;

possibly, a tube with a connection designed to cooperate with a passage in the upper part of the box, said passage being advantageously associated with a valve and communicating with the inner chamber of the flexible bag;

One or more connections to connect one or more passages of the box communicating with the inner chamber thereof (3), to outside the bag (4); and A circuit (110) with at least one pump (111A, 111B) to circulate said aqueous medium in the inner chamber (3) of the rigid box outside the flexible bag (4) and to pressurise the aqueous medium present in the inner chamber (3) (advantageously a circuit with a pump to circulate aqueous medium in the means to adapt the temperature of at least a portion thereof and to circulate aqueous medium in the inner chamber of the box outside the flexible or soft bag and pressurize the aqueous medium present in the inner chamber), and A means of controlling the amount of food dispensed, said means of controlling (105) the amount of food dispensed comprising advantageously a mobile tool (631) capable of acting on the control device (601) of the valve (602).

Advantageous features of embodiments of an apparatus according to the invention are:

The structure comprises a part which can move relative to the support element between an open or raised position enabling the placing of a box on the support element, and a closed or lowered position preventing the placing of a box on the support element or removal of a box on the support element, and/or The support element comprises one or more connection means designed to cooperate with at least one passage of the lower part communicating with the inner chamber of the box outside the bag, said connection means being connected to one or more aqueous medium inlet/outlet pipes of said circuit, and/or The part which can move relative to the support element comprises a connection means designed to cooperate with a passage of the box communicating with the inside of the bag and to cooperate with a dispensing tube, and a connection means designed to cooperate with a passage of the box communicating with the inner chamber outside the bag, wherein, when the movable part is in the open position, said connection means are remote from said passages of the box, while when said movable part is in the closed position, said connection means are in a suitable position to cooperate with a passage of the box communicating with the inside of the bag and to cooperate with a dispensing tube, and/or The apparatus comprises one or more support elements having a connection means designed to cooperate with at least one passage of the lower part of a box bearing on the support element, and/or The circuit is associated with at least one vessel or expansion vessel located at a level above the box or boxes bearing on the support element(s), and/or The circuit is associated with one or more heat exchanger means, to adjust the temperature of the aqueous medium before it circulates in a box or boxes, and/or The circuit's pump is designed to provide a flow of aqueous medium from top to bottom in the box, outside the bag, which rests on a support element, and/or The pump is designed to extract the aqueous medium from a box resting on a support element to bring it to a tank, and/or The support element or support elements is/are designed to support at least one box, for example two or more than two separate boxes, and in that the apparatus includes at least two circuits with separate pumps, each circuit being designed to provide a flow of aqueous medium in the chamber, and/or The circuit or each circuit is associated with a vent valve, either to evacuate air present in the circuit or to bring air into the circuit, and/or The pump of the circuit or of each circuit is situated at a level located below the support element or box resting on the support element, and/or The apparatus is associated with a control system preventing operation of the pump of the circuit when the movable part is in the open position, and/or The apparatus is associated with one or more removable or mobile tanks for easy filling, and/or The apparatus comprises one or more safety systems when the aqueous medium level reaches a predetermined level in the tank or in a vessel or expansion vessel, and/or The apparatus comprises a control device determining the amount of liquid or viscous food present in the bag, and/or The apparatus comprises a device to control the amount of food to be dispensed out of the bag, and/or The apparatus is in the form of a mobile device with a connection to an electricity grid to power the pump and/or the heat exchanger for the aqueous medium flowing in the circuit and/or a control device, and/or Advantageously, the mobile tool has at least one claw-shaped element (631) capable of moving through a window (625) of the retention part (605) at least between a position acting on the control device (601) of the valve to bring it into the open position and a rest position in which the control device (601) of the valve is in a position corresponding to a closed position of the valve. and/or Preferably, the mobile tool (631) has at least one claw-shaped element capable of moving (advantageously by at least one pivoting movement), between a position in which the claw is located outside the hollow or chamber of the cover of the box and a position in which the claw has an end located in the hollow or chamber of the cover and acts on the control device of the valve to bring it into the open position, with an intermediate position in which the claw is in a position in which the claw has an end located in the hollow or chamber of the cover, without acting on the control device of the valve to bring it into the open position. and/or In an advantageous embodiment, the apparatus comprises a means to ensure correct positioning of the box with respect to the bottom of the apparatus. and/or any combinations of these features.

The invention also relates to a method of dispensing a liquid or viscous food contained in a bag placed in a box placed on a support element of an apparatus according to the invention, wherein the temperature of an aqueous medium is adjusted, wherein the operation of the pump is controlled to bring aqueous medium having a suitable temperature under pressure into the box and wherein the bag is compressed in the box to allow an amount of liquid or viscous food from the bag to pass through the tube to fill a container. Especially, the method is a method of dispensing into a consumption container (like a glass) a liquid or viscous food contained in a bag placed in a box selected from the group consisting of (A) a rigid box having at least one wall (2)

defining an inner chamber (3) in which a flexible bag (4) extends, which flexible bag (4) is designed to contain a liquid or viscous food to be consumed in an appropriate serving temperature range by using an aqueous medium flowing within the inner chamber (3), said flexible bag (4) being selected from the group consisting of a flexible bag (4) associated with a part (5) comprising a valve, a flexible bag (4) associated with a part (5) comprising a membrane, and a flexible bag (4) associable with a protection means (6) designed to cooperate with a part (7) comprising a valve, said rigid box (1) having a lower part (1I) with a bottom (8), an upper part (1S) and at least one passage (9) for the part (5);

in which the flexible bag (4) defines within the inner chamber (3) a part located outside said flexible bag (4);

in which the box is at least associated with a means for protecting the at least one wall (2) against the liquid aqueous medium flowing within the inner chamber (3) outside the flexible bag (3);

in which the rigid box (1) is provided or associated, in the vicinity of its lower part (1I), with an element (8A) having at least one passage (10) designed to form a connection between the part of the inner chamber (3) located outside said bag (4) and a pipe (11), in which the rigid box (1) is provided or associated with an element having at least one passage (9) designed to cooperate with the part (5,7) associated or associable with said flexible bag (4), and in which at least a portion of the at least one side wall (2) of the rigid box (1) located between the lower part (1I) and the upper part (1S) cooperates with a means for forming one or more guide channels (12) between flexible the bag (4) and the said portion of the at least one side wall (2), said one or more guide channels (12) remaining open for passage of the aqueous medium between the lower part and the upper part of the rigid box (1) even in the presence of the flexible bag (4) in the inner chamber (3), and (B) a rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), and in that the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C);

by using an apparatus comprising at least:

A structure (100) with at least one support element (101) for said rigid box (1);

A tank (102) for the aqueous medium intended to flow within the inner chamber (3) of the said rigid box (1);

A means (103) for adjusting the temperature of at least part of said aqueous medium intended to flow within the inner chamber (3) of the said rigid box (1);

A tube (104) with a connection designed to cooperate with a passage in the upper part of the rigid box;

At least one connection (106A, 106B) for connecting one or more passages of the rigid box communicating with the inner chamber (3) of the box, outside the bag (4);

A circuit (110) with at least one pump (111A, 111B) to circulate said aqueous medium in the inner chamber (3) of the rigid box outside the flexible bag (4) and to pressurise the aqueous medium present in the inner chamber (3), and A means of control (105) of the quantity of food to be dispensed, said method comprising at least the steps of :

placing on a support element of the apparatus at least a rigid box with a flexible bag containing a liquid or viscous food;

controlling the temperature of an aqueous medium to flow within the inner chamber (3) of the rigid box;

controlling the operation of the pump to bring aqueous medium having a suitable temperature under pressure into the inner chamber (3) of the rigid box; and controlling the opening of the valve for controlling the amount of liquid or viscous food from the flexible bag flowing into a container.

Special features and details of preferred embodiments of the invention will become apparent from the following detailed description in which reference is made to the accompanying drawings.

BRIEF DESCRIPTION OF THE DRAWINGS

In these drawings,

FIG. 1 is a perspective view of a box according to the invention;

FIG. 2 is a view of the box in FIG. 1 with the cover removed;

FIG. 3 is a view of the inner bag attached to a support part (5);

FIG. 4 is a view of another inner bag;

FIGS. 19A and 19B are sectional views of the parts shown in FIG. 18;

FIGS. 21A, 21B and 21C are exploded perspective, exploded sectional and simple sectional views of the pipe (5T);

FIG. 22 is a partial view of the box and cover (C) in the closed position;

DESCRIPTION OF THE PREFERRED EMBODIMENTS

Figure 5:
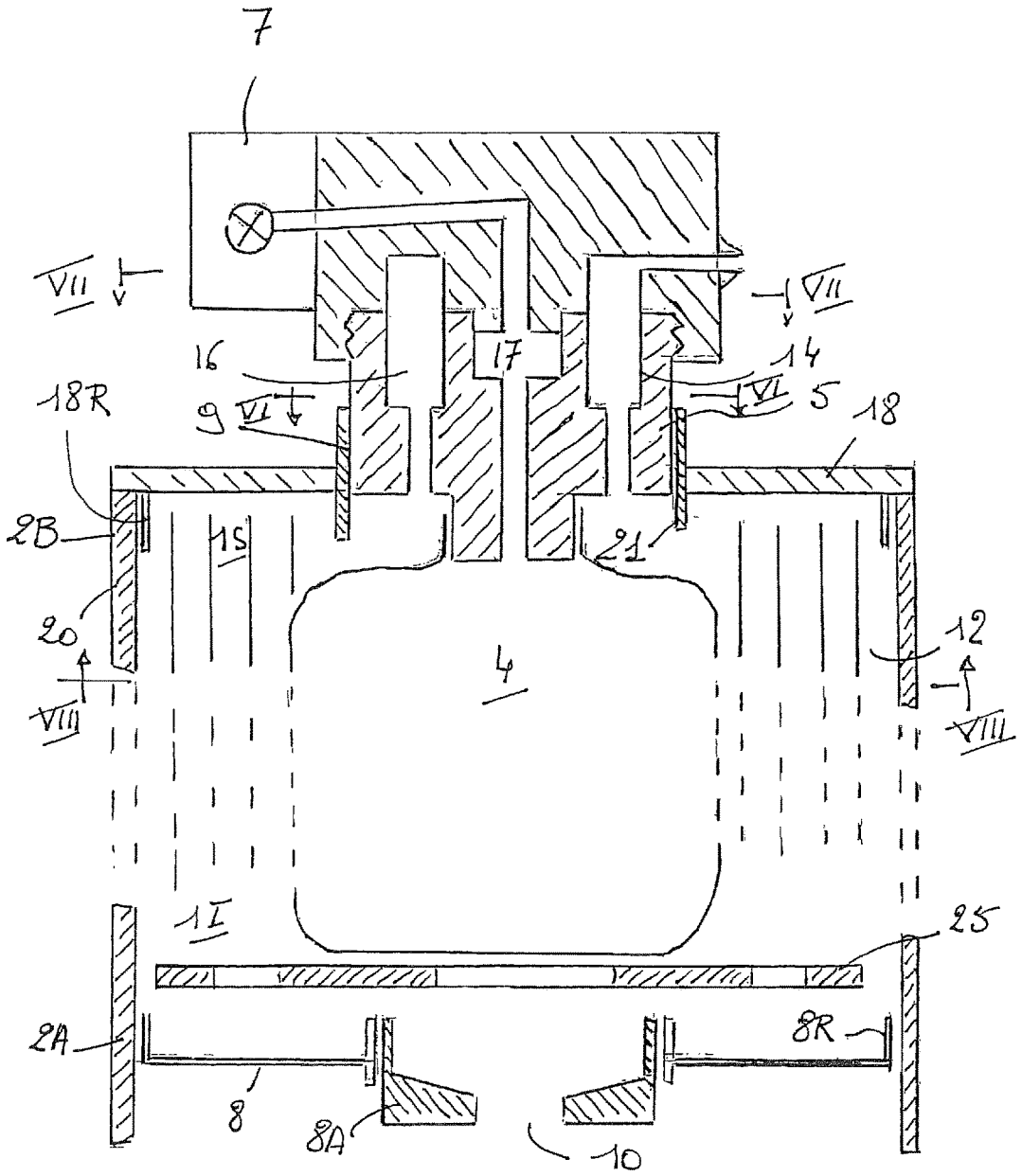
FIG. 5 is an enlarged sectional view of the upper part of the box and the bottom of the box.
Figure 6:
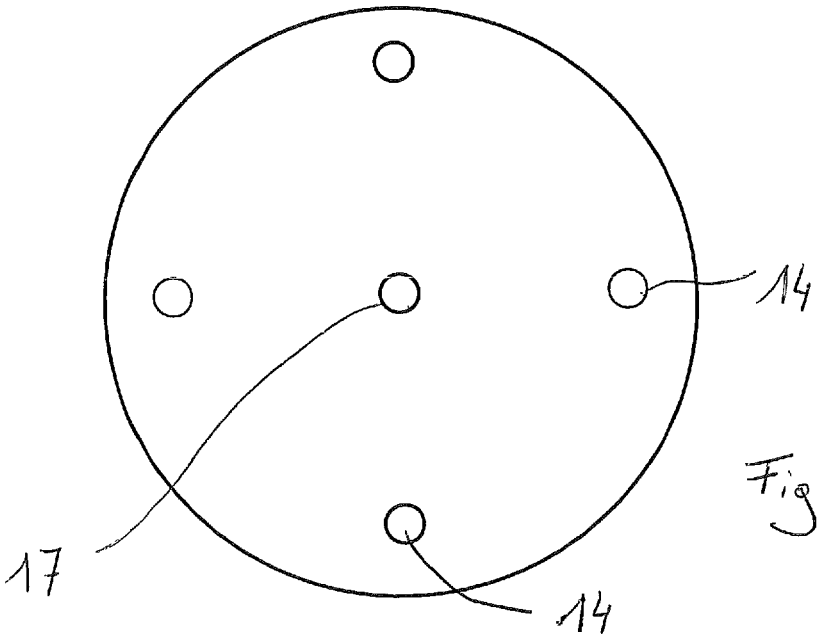
FIG. 6 is a sectional view along line VI-VI in FIG. 5.
Figure 7:
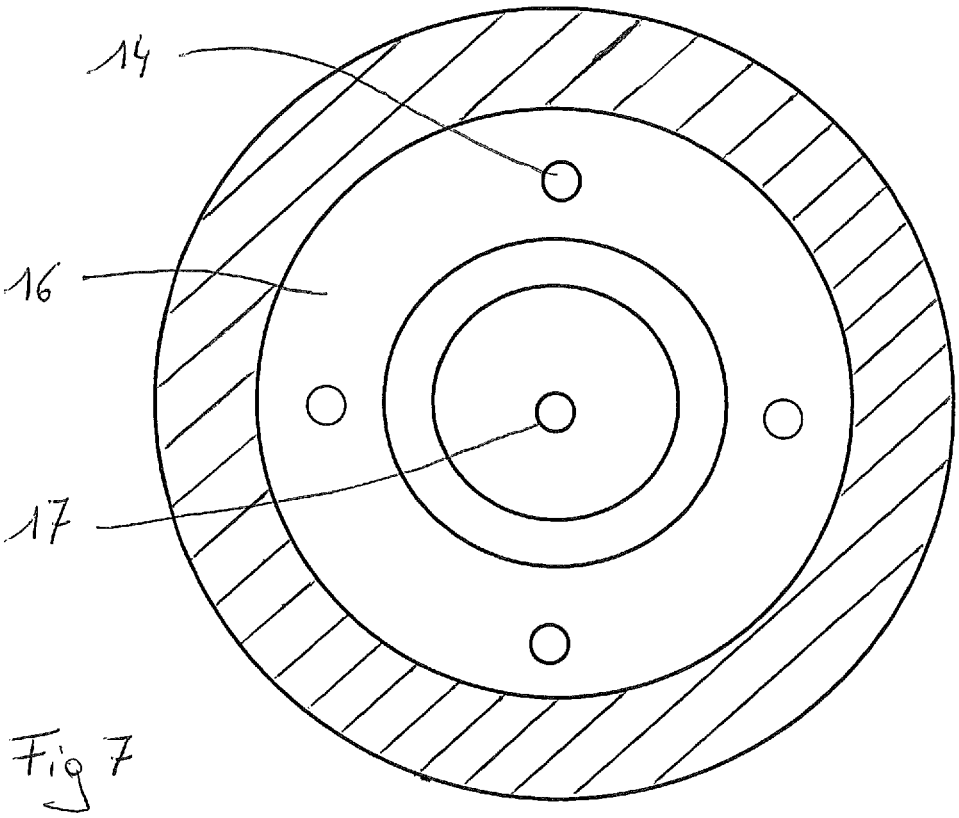
FIG. 7 is a sectional view along line VII-VII in FIG. 5.
Figure 8:
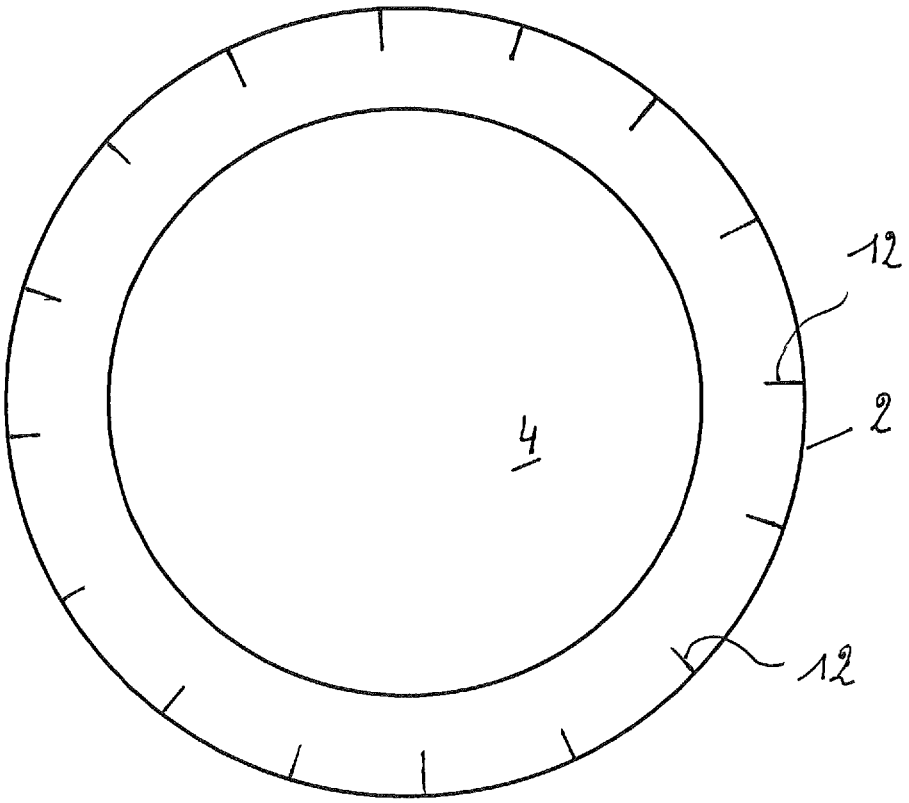
FIG. 8 is a sectional view along line VIII-VIII in FIG. 5.

The preferred embodiments disclosed in the description of the figures are given as examples only.

FIG. 1 shows a box (1) according to the invention before use. This box (1) is associated with a cap (1C) attached to the body (1) by means of a pull tab (1D). This tab (1D) serves as a visual means of checking that the box has not been opened in a store.

The walls (2) define an inner chamber (3) into which extends a flexible bag (4) for containing a liquid or viscous food for consumption in a suitable temperature range. Said bag (4) is associated with a part (5) comprising a valve or a part (5) comprising a membrane or associable with a protection means (6) designed to cooperate with a part (7) comprising a valve, for example a part of an apparatus according to the invention. Said box (1) has a lower part (1I) with a bottom (8), an upper part (1S) and at least one passage (9) for the part (5).

The walls (2) have a side facing the inner chamber (3) designed to withstand an aqueous medium at a temperature at least close to the appropriate serving temperature range, for example 3° C. to 20° C. for wine (sparkling wine, white wine, red wine, sweet wine). The box (1) has near its lower part (1I), or is associated with, an element (8A) having at least one passage (10) designed to form a connection between the part of the inner chamber (3) located outside said bag (4) and an inlet and/or outlet pipe (11). The box (1) has or is associated with an element having at least one passage (9) designed to cooperate with the part (5) associated with said bag (4).

At least a portion of a side wall (2) of the box (1) between the lower part (1I) and the upper part (1S) comprises along its side facing the inner chamber (3) at least one means for forming one or more guide channels (12) for said aqueous medium, said guide channel or channels (12) being designed so that even in the presence of the flexible bag (4) in the chamber (3), one or more channels (12) are or remain open for passage of the aqueous medium.

The bag (4) is suspended in the box (1), and more precisely in the chamber (3). This allows the particles which may be present in the liquid, for example beverage, wine, etc., to remain in the bag during extraction of the liquid (beverage, wine, etc.) from the bag for dispensing to consumers.

The box (1) has, near its upper part (1S), at least one passage (14) designed to form a connection between the part of the inner chamber (3) located outside said bag (4) and an inlet and/or outlet pipe (15).

At least a portion of a side wall (2) of the box (1) between the lower part (1I) and the upper part (1S) comprises along its side facing the inner chamber (3) at least one means (12) to form a series of guide channels for said aqueous medium, said guide channel(s) (12) being designed so that even in the presence of the flexible bag in the chamber, one or more channels are open to the passage of the aqueous medium, said channels (12) advantageously being distributed along said side wall. This ensures homogeneous cooling or warming of the bag, and prevents direct contact of the bag with the inner wall of the box. The wall is for example equipped with vertical fins whose free edge is designed to serve as a support for the bag (4) in the chamber.

The box comprises a side wall or walls (2), a bottom wall (8) forming a bottom and a top wall (18) opposite the bottom wall (8). The bottom wall (8) has at least one passage (14) designed to form a connection between the part of the inner chamber (3) located outside said bag (4) and an inlet and/or outlet pipe (15), whereas the upper wall (18) has at least one passage (9) designed to cooperate with the part (5) associated with said bag (4) or comprises the part (5) associated with said bag (4). The box thus enables mounting in a circuit to provide a movement or flow of aqueous medium from top to bottom and/or from bottom to top, but preferably from top to bottom.

The top wall (18) is or is designed to cooperate with a part, preferably with the part (5) associated with said bag (3), to form a connection between the part of the inner chamber (3) located outside said bag (4) and an inlet and/or outlet pipe (15).

The wall or walls (2) of the box are at least partially provided with a coating or layer of thermal insulation (20).

The box is formed by (a) a body (1) defining a side wall or walls (2) and having an open lower end (2A) and an open upper end (2B), (b) a bottom part (8) for closing the lower end (2A), said bottom part (8) having at least one passage (10) designed to form a connection between the part of the inner chamber (3) located outside said bag (4) and an inlet and/or outlet pipe (11), and (c) a cover (18) for closing the upper end (B), said cover (18) being designed to be associated with said bag (4), said cover having firstly a passage (17) communicating with the inside of the bag (4) and not with the part or zone of the chamber (3)located outside said bag (4), and, secondly, at least one passage (14) communicating with the part or zone of the inner chamber (3) located outside the bag (4).

The cover (18) is designed to form a connection between the passage or passages (14) communicating with the part or zone of the inner chamber (3) located outside said flexible or soft bag (4) and an inlet and/or outlet pipe (15).

The passage or passages (14) of the cover communicating with the part or zone of the chamber (3) located outside the bag (4) communicate with a channel (16) extending in the cover (18), said channel (16) being a channel surrounding a wall of the passage (17) communicating with the inside of the bag (4) and not with the part or zone of the chamber (3) located outside said bag (4). This channel (16) advantageously has a lower surface or bottom so that in case of use of the box, said surface or said bottom has an inclination or inclinations to bring at least by gravity the liquid in the channel (16) to a passage or passages (14).

The passage (14) of the cover communicating with the part or zone of the chamber (3) located outside the bag (4) extends in the body of the cover (18) to ensure good heat exchange between the aqueous medium and the body of the cover (18), at least in its part adjacent to the passage (17) communicating with the inside of the bag (4) and not with the part or zone of the chamber (3) located outside said bag (4).

The cover (18) has or comprises a means for suspending the bag in the inner chamber (3), and means designed to ensure its position relative to the side wall or walls (2) of the box.

Advantageously, the box comprises a means (21), said means being advantageously a skirt (21) surrounding one or more openings of the passage(s) (14) to the inner chamber (3), said skirt (21) being preferably carried by the cover (18) to ensure the presence of at least one volume of air in the part of the inner chamber located outside the bag during filling of the inner chamber (3) with said aqueous medium. This air volume is useful to take up effects due to possible expansion or contraction of the aqueous fluid passing through the box or even the release of gas by the aqueous fluid. This air mattress thus serves as a buffer.

The bottom part (8) and the cover (18) each have a flange designed to rest on the inner face of the casing (2) defining the side wall or walls of the box (1).

The bottom part (8) has an internal face designed to be turned towards the inner chamber (3) of the box (1), whereas when the box with its bottom part facing downward rests on a horizontal plane, the inner face of the bottom part (8) has at least one part (8A) having an inclination towards the passage (10) designed to form a connection between the part of the inner chamber (3) located outside said bag (4) and an inlet and/or outlet pipe (11).

The box comprises or is designed to be associated with a means (25) for determining the amount of aqueous medium introduced into the inner chamber and/or for determining the amount of liquid or viscous food present in the bag. For example, the box has a window or a tube to estimate the amount of water present in the chamber outside the bag.

The box (1) is associated with one or protection means (6) to secure the closure of the passages prior to use of the box. After removal of the cover (1C), this provides additional security before use of the box.

The box could have been associated with a mobile float element (27) in the inner chamber (3), located between the bag and the lower part, said float element (27) having a lower density than the aqueous medium. This float can either be used to determine the contents of the bag or to ensure better extraction of the liquid contained in the bag, the bag moving upwards when the liquid is extracted out of the bag (4). The extraction means (25) is for example attached to the float (27).

The box is for example built to withstand a pressure of the aqueous medium in the inner chamber of 1 to 5 bar ($1\times10^5$ Pa to $5\times10^5$ Pa).

The box is designed to be placed in an apparatus for dispensing a quantity of a liquid or viscous food contained in a bag placed in a box, in an appropriate temperature range.

Figure 9:
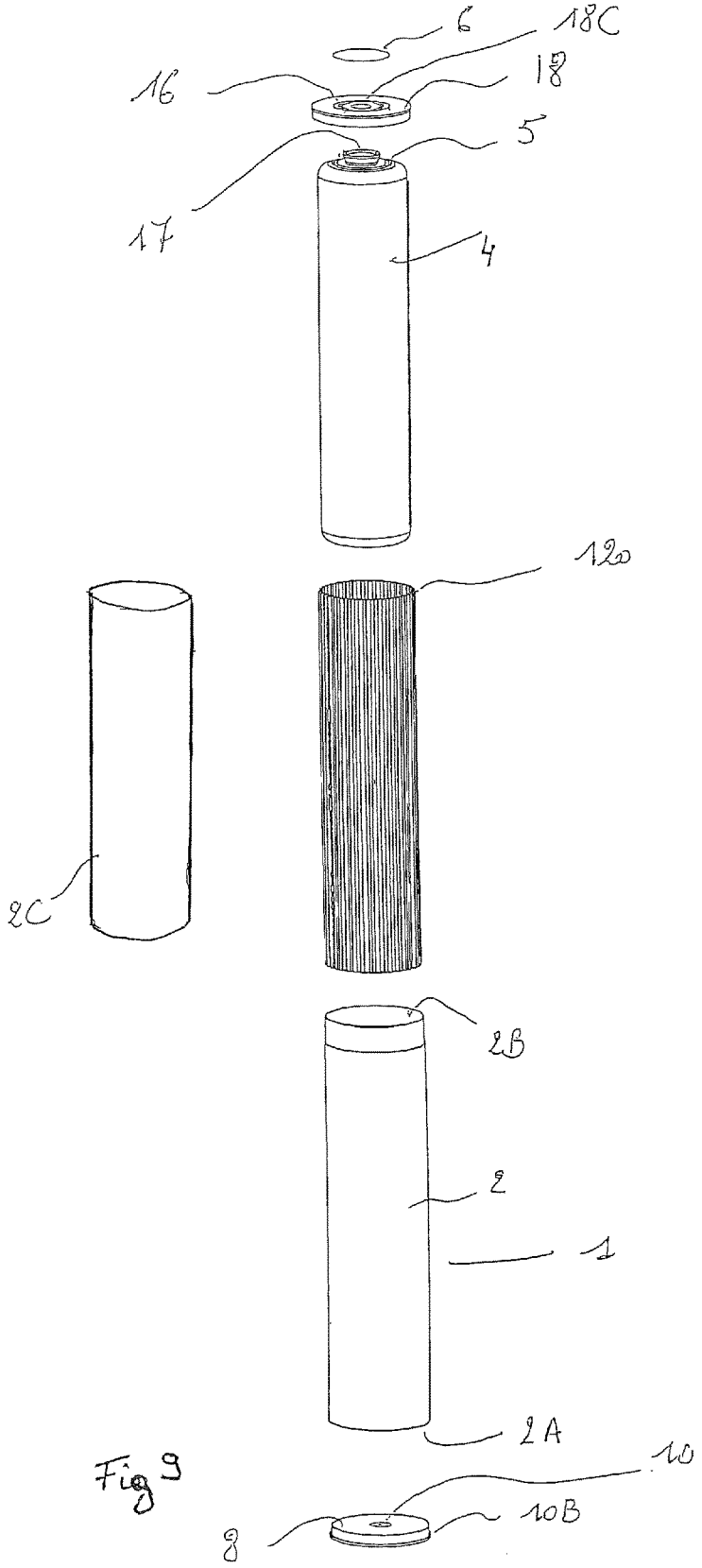
FIG. 9 is an exploded view of a box according to the invention.

The box in FIG. 9 comprises:

- A hollow body (1) whose side wall (2) preferably defines a cylinder open at its lower end (2A) and at its upper end (2B);
- Optionally a sleeve (2C) designed to form a covering of the inner face of the side wall (2); this covering is attached or not to the wall, for example glued, such a lining being advantageous to avoid direct contact between the aqueous medium and the inner face of the wall (2), when the body (1) is made of a material which may deteriorate in contact with water;
- A flexible element (120) having a series of parallel corrugations to define channels (12), this element (120) having a flat shape prior to winding;
- A bag (4) associated along its top opening with a rigid part (5),
- A bottom (8) with a passage (10), said bottom preferably being substantially circular and having a flange (10B) designed to bear on the lower circular edge of the body (1);
- A cover (18) with a central lower cavity (18I) designed to receive a portion of the part (5), and a central opening (18C) designed to be positioned opposite the passage (17) of the part (5). The upper face of the cover (18) having an annular groove (16) associated with one or more passages (14), said cover (18) also having a flange (18B) designed to bear on the upper edge (2B) of the box (1);

A removable cap (6) for protecting the central opening and the groove of the cover.

Figure 9A:
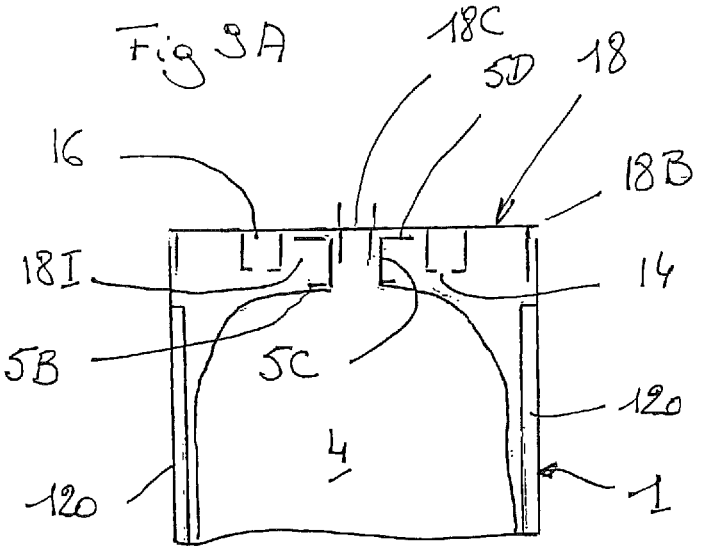
FIG. 9A is a sectional view of the cover associated with part (5) of the bag for the box in FIG. 9.

FIG. 9A shows a section of the cover (18) associated with the element (5) of the bag (4). This element (5) comprises a base (5B) attached or welded to the bag (4), this base being substantially planar or tapered with a central portion higher than the outer edge, an open central cylindrical extension (5C) forming a duct for the chamber defined by the bag (4), and a circular plate (5D) designed to be engaged in a groove (18G) presented by the cover (18) along its inner side (side facing the inside of the chamber (3) of the box (1)). The extension (5C) has a sufficient height so that when the circular plate (5D) rests on one side of the groove (18G), the passages (14) of the groove (16) are remote from the base (5B), this then allowing the cooling or heating liquid to flow on the base (5B) of the part (5). The lower cavity (18I) of the cover (18) has a central tube (18T) designed to extend into the cylindrical extension (5C) of the part (5).

Figure 10A:
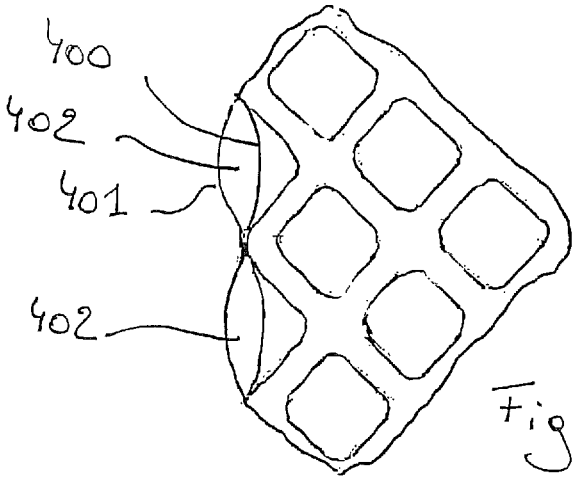
FIG. 10A is a view of a detail of the embodiment in FIG. 10.
Figure 10:
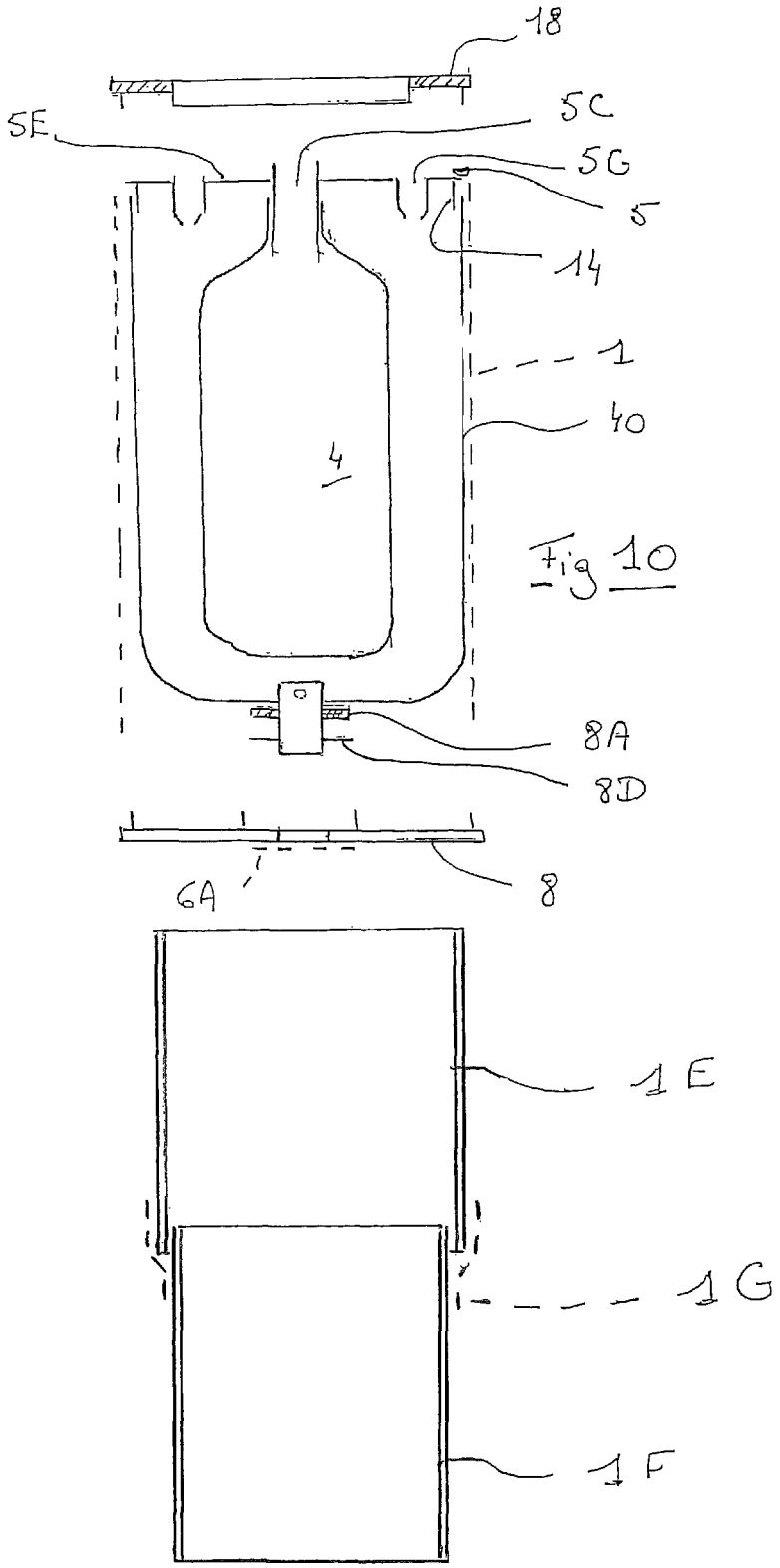
FIG. 10 is a sectional view of another embodiment of a box according to the invention.

FIG. 10 schematically shows the different parts forming a box according to the invention using a bag-in-bag system.

The bag (4) is associated with a part (5) having a central channel (5C) carrying a disc (5E) with a lateral skirt (5J), the disk (5E) having a groove (5G) with openings (14). An outer bag (40) surrounds the bag (4) and is attached to the skirt (5J) of the part (5). The bottom end of the bag is associated with a part (8A) forming a passage with the inside (3) of the bag (40). The cover (18) is a disk with a central opening, an outer skirt designed to bear on an inner face of the body (1) and an inner skirt for cooperating with the groove (5G) of the part (5).

The part (8A) has a crown (8D) designed to cooperate with the bottom (8) of the box (1). This bottom (8) has a skirt (8J) designed to fit the inside of the box (1).

The box (1) is formed in two parts (1E and 1F) slideable relative to each other between a close position in which the height of the box (1) is reduced and a remote position in which the height of the box (1) is extended. A means (1G) maintains the parts (1E and 1F) in the remote position, such a means being for example an adhesive tape.

To place the bag (4) in the chamber of the box (1), it is possible to proceed as follows:

Part (5) is associated with the cover (18);

Bag (40) and bag (4) are placed in the chamber of the box, and the cover (18) is attached to the side wall of the box (1);

The lower end of bag (40) and the part (8A) extend outside the box (1) whose parts are in the close position;

The bottom (8) is associated with part (8A);

The Parts (1E and 1F) are moved relative to each other to increase the height of the box (1), so as to bring the lower edge of the part (1F) into contact with the bottom (8) or its skirt (8R);

The bottom (8) is attached to the box (1), and

The Parts (1E and 1F) are maintained in the remote position by means of the device (1G), for example an adhesive tape.

In this embodiment, the water flows into the bag (40) to cool or heat the liquid contained in the bag (4). To ensure a flow around all sides of the bag (4), the bag (40) is preferably a bag with two layers (400, 401) welded to each other to form protrusions (defining air pockets (402)). (see FIG. 10A)

Figure 11:
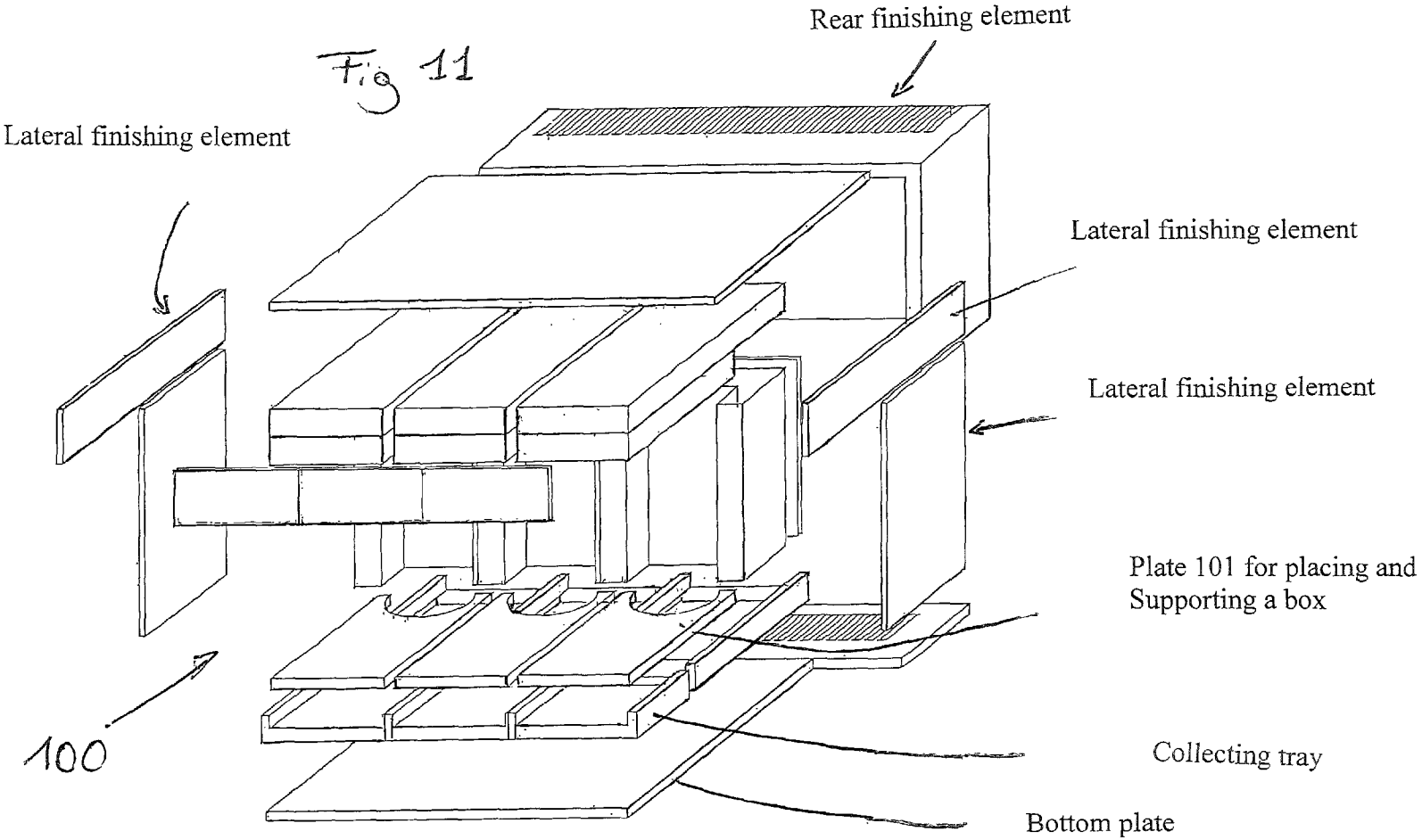
FIG. 11 is a schematic view of an apparatus according to the invention.
Figure 12:
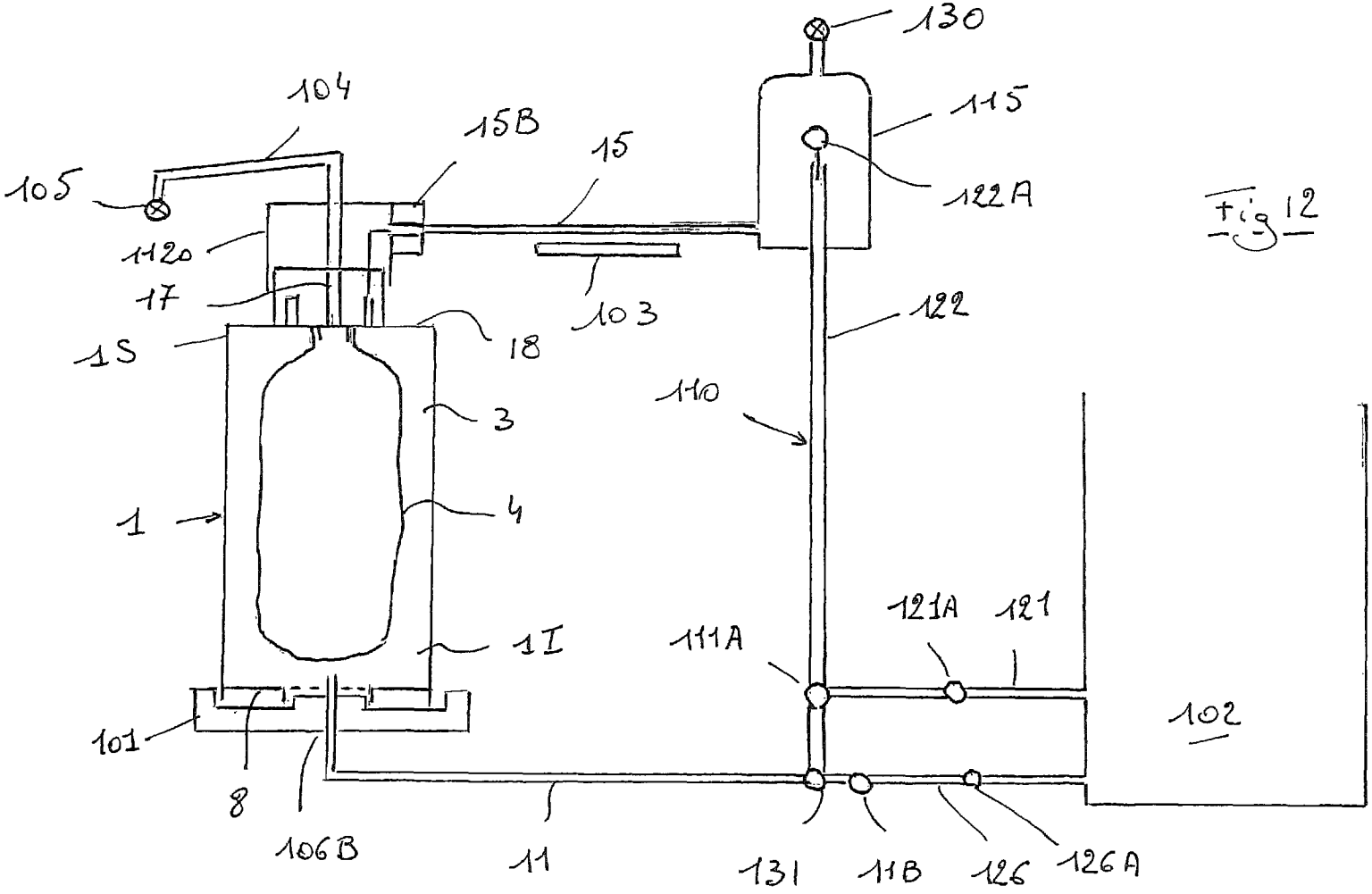
FIG. 12 is a schematic view of a circuit for a box placed on a support element of the apparatus according to the invention.

An apparatus according to the invention is shown in FIGS. 11 and 12 and comprises at least:

A structure (100) with at least one support element (101) for at least one box (1);

A tank (102) for an aqueous medium;

A means (103) for adjusting the temperature of at least part of said aqueous medium;

A tube (104) with a connection designed to cooperate with a passage in the upper part of the box, this passage being advantageously associated with a valve (105) and communicating with the inner chamber of the flexible bag (4);

One or more connections (106A, 106B) for connecting one or more passages of the box communicating with the inner chamber (3) of the box, outside the bag (4); and A circuit (110) with at least one pump (111A, 111B) to circulate aqueous medium by the means (103) to adjust the temperature of at least a portion thereof and to circulate the aqueous medium in the inner chamber (3) of the box outside the flexible bag (4) and pressurize (for example with slight overpressure) the aqueous medium present in the chamber (3), and A means of control (105) of the quantity of food to be dispensed, for example a valve.

The structure (100) comprises a part (1120) movable relative to the support element (101) between an open or raised position permitting the placing of a box (1) on the support element (101), and a closed or lowered position preventing the placing of a box (1) on the support element (101) or the removal of a box on the support element (101).

The support element (101) comprises one or more connection means (106B) designed to cooperate with at least one passage of the lower part (11) communicating with the inner chamber (3) of the box (1) outside the bag (4), said connection means (106B) being connected to one or more inlet and/or outlet pipes (11) for aqueous medium in said circuit (110).

The movable part (1120) moving relative to the support element (101) comprises a connection means (106A) designed to cooperate with a passage (17) of the box communicating with the inside of the bag (4) and to cooperate with a dispensing tube (104), and a connection means (106A) designed to cooperate with a passage (14) of the box communicating with the inner chamber (3) outside the bag (4), wherein, when the movable part (1120) is in the open position, said connection means (106A) are remote from said passages of the box, while when said movable part (1120) is in the closed position, said connection means are in a suitable position to cooperate with a passage of the box communicating with the inside of the bag and to cooperate with a dispensing tube, as well as to cooperate with a passage (14) of the box communicating with the chamber (3) outside said bag (4).

The apparatus comprises one or more support elements (101) having a connection means (106B) designed to cooperate with at least one passage of the lower part of a box resting on the support element in question (101).

The circuit (110) is associated with at least one vessel or expansion vessel (115) designed to be located at a level above the box or boxes bearing on the support element or elements (101).

The circuit is associated with one or more heat exchanger means (103), advantageously of the thermoelectric type, for example with a Peltier effect plate, to adjust/control the temperature of the aqueous medium before it circulates in a box or boxes. A Peltier type heat exchanger is useful for cooling of the aqueous medium. The heat exchanger (103) is in particular a thermoelectric type heat exchanger allowing both a heating and a cooling effect on the aqueous medium.

At least one pump (111A) of the circuit (110) is designed to provide a flow of aqueous medium from top to bottom in the box, outside the bag, which rests on a support element (101).

At least one pump (111B) is designed to extract (the) aqueous medium from a box resting on a support element (101) to bring it to a tank (102).

Pump 111A and pump 111B can be one and the same pump. In the embodiment, two pumps are used, one for the circulation of the aqueous medium in the circuit, the other to drain the circuit.

The support element (101) or the support elements is/are designed to support at least two or more than two distinct boxes, while the apparatus comprises at least two circuits (110) with at least one distinct pump (111A, 111B), each circuit (110) being designed to provide a flow of aqueous medium in the chamber of a box.

The circuit or each circuit (110) is associated with a vent valve (130), either to evacuate air present in the circuit or to bring air into the circuit. This vent valve is for example an automatic valve which goes to the open position when the vessel is depressed or when the vessel is in overpressure with respect to atmospheric pressure, for example in overpressure greater than a predetermined minimum overpressure.

As shown in the circuit diagram, at least one pump (111B) of the circuit or of each circuit (preferably the pumps of the circuit or of each circuit) is located at a level designed to be located below the level of the support element (101) or of the box resting on the support element (101).

The apparatus is associated with a control system preventing operation of the pump (111A) of the circuit when the movable part (1120) is in the open position and a safety system or systems when the aqueous medium level reaches a predetermined level in the tank (102) or in a vessel or expansion vessel (115).

The circuit (110) shown consists of the following pipes and components:

- A tank (102) for supplying the circuit, via the pipe (121) communicating with the pump (111A), a one-way valve (121A) preventing backflow of aqueous medium from the pump (111A) to the tank (102);
- A pipe (122) connecting the pump (111A) to the expansion vessel (115), said pipe being associated with a system (122A) preventing or limiting the descent of the aqueous medium in the pipe (122), this system (122A) being for example a float partially or completely closing off the open end of the pipe (122) at the expansion vessel (115),
- The expansion vessel (115) with a vent valve in the case of depression (pressure less than a specified pressure level) or overpressure (pressure higher than a specified pressure level)
- A pipe (15) associated with the thermoelectric exchanger (103) and extending between the expansion vessel (115) (opening (15A) located at a level below the level of the opening of pipe (122) in the vessel (115)), said pipe (15) opening into the movable part (1120) and being associated with a valve (15B) which goes from an open position (allowing the passage of liquid when the movable part (1120) is in the lowered position) to a closed position (preventing the passage of liquid when the movable part 1120 is in the raised position), said pipe (15) advantageously extending in an inclined plane towards the movable part (1120), when the latter is in the lowered position (the opening (15A) then being located at a level above the valve (15B) and the part (5) of the box (1));
- The passages (14) of the part (5);
- The chamber (3) of the box (1) (with a part or zone outside the bag (4))
- The passage (10) of the bottom (8) of the box (1);
- The pipe (11) extending between the support (101) and the pump (111B), this pipe (11) being sloped downward toward the pump (111B),
- A T-piece (131) extending the pipe (11);
- A pipe (125) connecting the pump (111A) to a branch of the T;
- A pipe (127) connecting the other branch of the T (131) to the pump (111B) capable of operating in both directions,
- A pipe (126) with a valve (126A) connecting the pump (111B) to the tank (102).

In operational use of the apparatus, after a new box (1) is placed on the support element (101), the movable part (1120) is put in its lowered position. Initially, the pump (111B) is operated with the valve (126A) in the open position to bring the aqueous medium into the pipe (11) and fill the box through its bottom (8). The power of the pump is advantageously insufficient to raise the float (122A).

The aqueous medium from the tank (102) thus fills the chamber (3) of the box from the bottom, thus driving the air in this chamber (3) via the pipe (15) into the expansion vessel (115). When the chamber (3) is filled at the skirt (21), the inner area or zone defined by the skirt (21) is filled before the passages (14) and the pipe (15) fill with liquid. The air in the passages (14) and the pipe (15) is thus driven into the expansion vessel (115). The inclination of the pipe (15) ensures proper evacuation of the air from the pipe (15) to the expansion vessel. The expansion vessel is then filled with liquid until the liquid level reaches the level of the opening (112A); the float (122A) is raised, thus allowing any air in the pipe (122) to escape.

If the air in the expansion vessel is at a pressure higher than a specified pressure, depending for example on the pressure of the pump (111B), the valve (130) opens to evacuate the air present in the expansion vessel.

When the float (122A) is in the raised or open position, the valve (126A) goes to the closed position.

The box (1) is thus in position for the dispensing of wine from the bag (4). Before dispensing, the pump (111A) is put in operation for the time required to provide fluid circulation in the circuit (100) with top-to-bottom flow of the fluid in the chamber (3). The fluid is heated or cooled, as required, by the thermoelectric heat exchanger (103). The circulation time before dispensing is predetermined for example depending on the outside temperature, the temperature of the fluid in the top of the chamber and the temperature of the fluid in the bottom of the chamber. For example, when for a certain period of time the fluid temperature difference between the top and bottom of the chamber is lower than a given value, a control device allows dispensing.

For dispensing, the pump is operated to generate a pressurization higher than a specified pressure of the fluid in the chamber (3). For this pressurization, a quantity of fluid is pumped from tank (102) to flow in the circuit (110). This pressurization will then pressurize the air in the expansion vessel, the valve (130) remaining closed. Upon activation of the dispensing tap (105), the bag (4) will be emptied due to the excess pressure of the fluid in the chamber (3). When the pressure is less than a predetermined value, the valve (105)

is controlled to stop dispensing. The pump (111A) is then restarted to once again create an overpressure in the expansion vessel greater than the predetermined value.

When the bag (4) is substantially empty, it is no longer possible to lower the pressure in the vessel below a set value, the pressure at which the pump (111A) is started up.

When the bag (4) is empty, the chamber (3) is substantially completely filled with fluid. The pump (111A) is then shut down, while the pump (111B) is activated with the valve (126) opened, thereby discharging the fluid from the circuit to the tank (102). During this draining operation, the fluid present in the vessel (115) passes through the chamber to be discharged into the tank (102). The chamber (3) is also emptied. During this draining operation, a depression is created in the circuit. When the depression reaches a predefined threshold, the valve (130) opens to allow the air to enter the circuit. The box can thus be emptied of the aqueous medium and be filled with air.

For the determination of the quantity of wine still present in the bag (4), the support (101) comprises a weight determination element, this element determining the weight of the box with the chamber (3) filled with air and the weight of the box with the chamber filled with water. Knowing the total volume of the chamber (3) and the density of the wine, it is then possible to determine the amount of wine in the bag (4). This type of measurement allows the amount of wine in the bag (4) to be determined again, even if the box of the apparatus has been removed while wine was still present in the bag (4). The apparatus thus allows good preservation of the wine present in the bag (4) (no oxidation) while ensuring dispensing of the wine at a temperature within a desired temperature range.

The valve (105) is advantageously associated with a flavour enhancing device, such as an aerator.

The tank (102) is advantageously removable or mobile to allow filling. This tank (102) could also be connected to a pressurized water supply and to an overflow.

It is clear that the bag (4) could contain another food, for example a sauce to be consumed hot or warm, broth, etc. In this case, the thermoelectric means is preferably an electric heating element.

The aqueous medium used in the circuit is advantageously water, optionally with the addition of citric or acetic acid. Other additives may be used.

Figure 13:
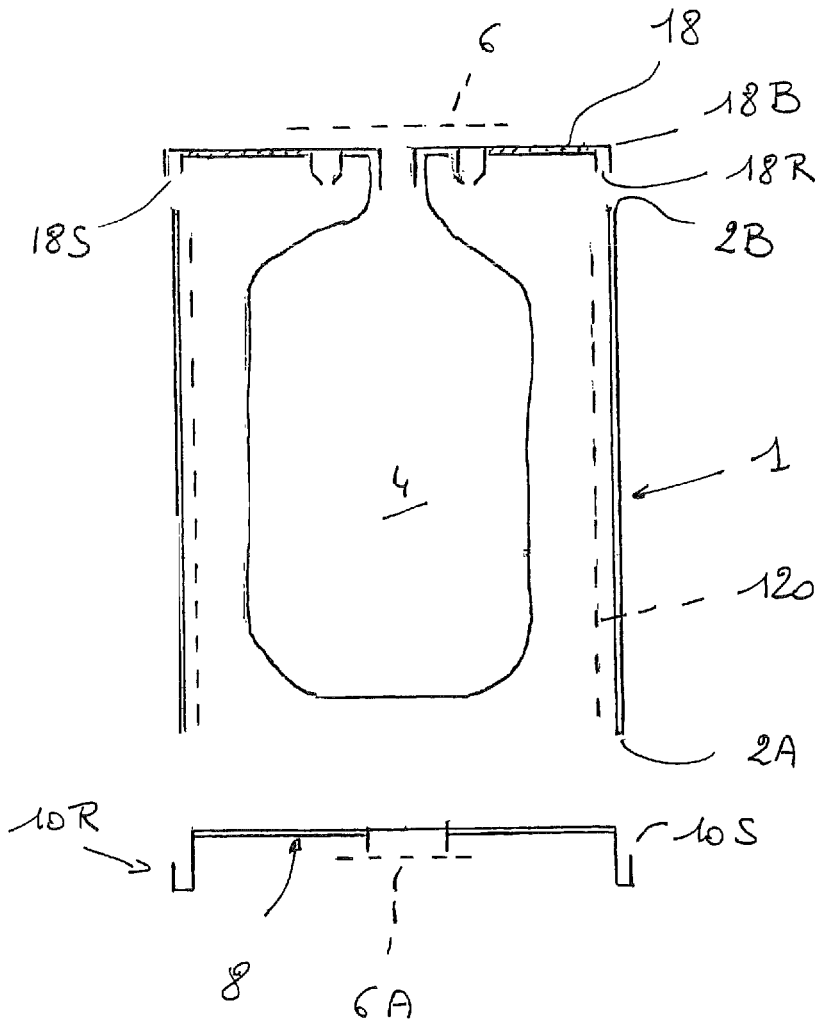
FIG. 13 is an (exploded) sectional view of an embodiment of the tube (2), the cover (18) and the bottom part (8)
Figure 14A:
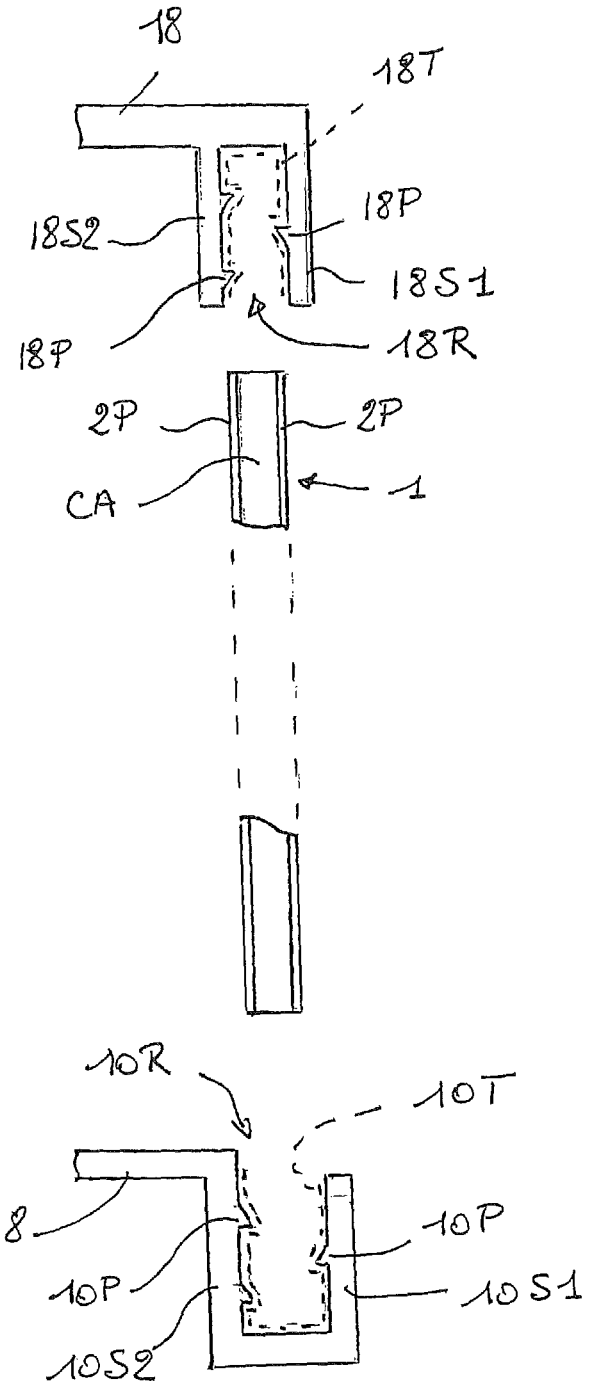
FIGS. 14A and 14B are larger-scale views of a detail of the cover and the bottom part before and after engagement of a tube end.
Figure 14B:
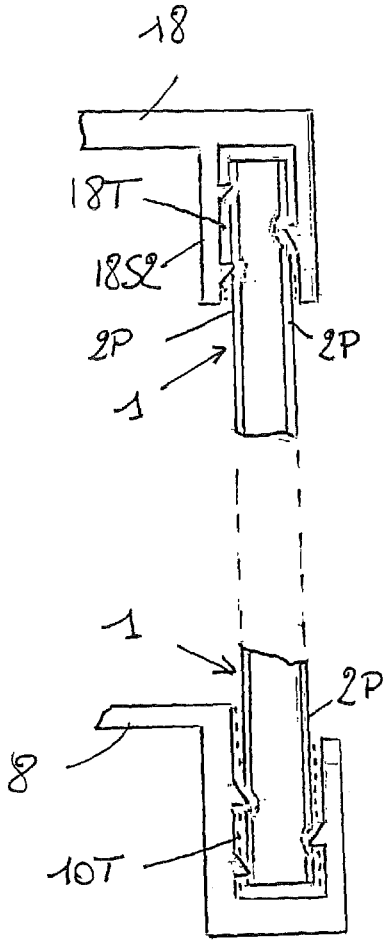
Figure 15:
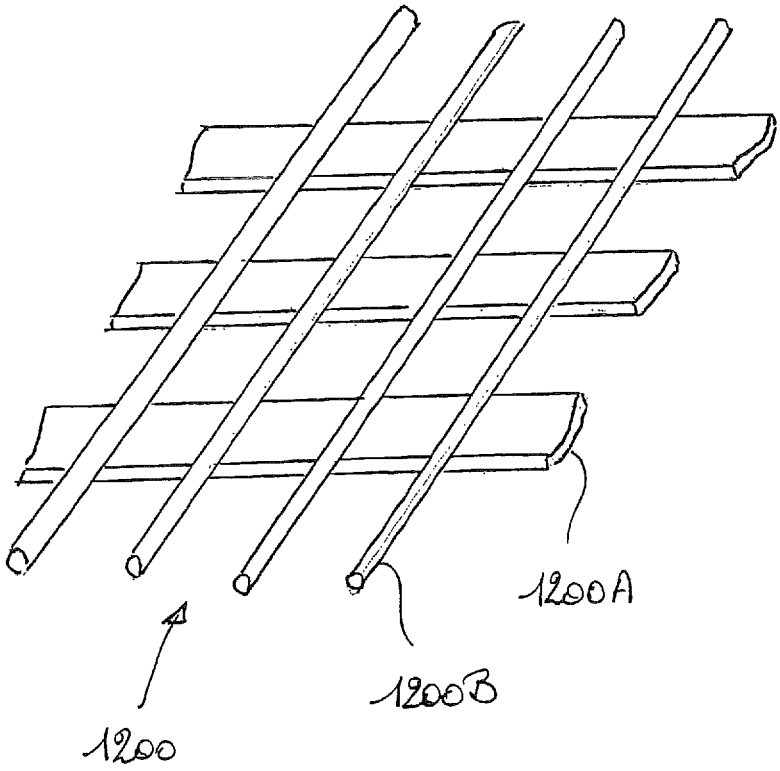
FIG. 15 is a perspective schematic plan view of a net which simultaneously provides some insulation and forms guide channels.

FIG. 13 schematically shows a box similar to that shown in FIG. 9. The box comprises a hollow cylindrical body (1) (for example in honeycomb cardboard) with a wall (2) whose inner and outer faces are provided with a (2P) plastic layer (for example in polypropylene). The inner side is preferably provided with an aluminium-type gas-tight layer.

The box also comprises a bottom (8) and a cover (18), which are each associated with a circular flange (10B, 18B) designed to cooperate respectively with the end (2A) and the end (2B) of the body (1). Said flange (10B, 18B) is associated with an element (10R, 18R) defining an open circular or annular groove (10S or 18S) defined between two substantially cylindrical walls (10S1, 10S2, 18S1, 18S2) with preferably one or more protrusions (10P, 18P) forming teeth or fingers opposing a movement of withdrawal of the casing (2) relative to the bottom part (8) and the cover (18) when the ends (2A, 2B) of the casing (2) are engaged in the groove (10S, 18S) of the bottom part (8) and the cover (18) respectively, said circular or annular groove advantageously being associated with a resilient or deformable layer (10T, 18T) capable of forming a seal at least for the liquid between the casing (2) and the cover (18) and the bottom part (8) respectively.

The openings of the bottom (8) and the cover (18) are closed in a gas-tight manner by a removable film (6, 6A).

Around the bag (4) is placed a flexible net (1200) designed to ensure the presence of guide channels along the inside of the tube (1).

When the ends (2A, 2B) are engaged in the grooves (10S, 18S), a gas-tight seal can be obtained. This prevents liquid contact with the central cardboard part of the material used to manufacture the tube. By ensuring gas-tightness both of the body (1) (by an inner aluminium film or an aluminized layer, for example), and between the bottom (8) and the body (1), and between the cover (18) and the body (1), and of the openings of the bottom (8) and the cover (18), it is possible to create a chamber (3) isolated from the external atmosphere so long as the films (6, 6A) have not been removed. This is beneficial because after placing the bag (4) filled with wine in the body (1) and before closing off an opening of the cover or bottom communicating with the part or zone of the chamber (3) located outside the bag (4) (in particular the opening of the bottom (8)), it is possible to change the atmosphere in the part or zone outside the bag (4). For example, the air in this part or zone is sucked out or expelled and replaced by a $CO_2$, nitrogen or oxygen-depleted air atmosphere. This subsequently helps to enable longer preservation of wine present in the bag (4), even if the bag or pouch (4) has low gas permeability. The atmosphere present in the part or zone of the chamber (3) outside the bag (4) may be placed under a slight overpressure relative to the atmospheric pressure.

In the embodiment in FIG. 13, a net (1200) was used. This net (1200) has a mesh with openings. This net (1200) (for example in polypropylene) consists for example of flattened or rectangular-section wires (attached to each other by wires (1200B) (for example of circular section). The wires 1200B and 1200A are welded together. The flat wires (1200A) are designed to bear on or to be turned towards the inner face of the body (1), while the wires (1200B) are designed to be turned towards the bag (4). The wires (1200B) extend at least partially vertically into the tube to form guide channels (12).

Figure 16:
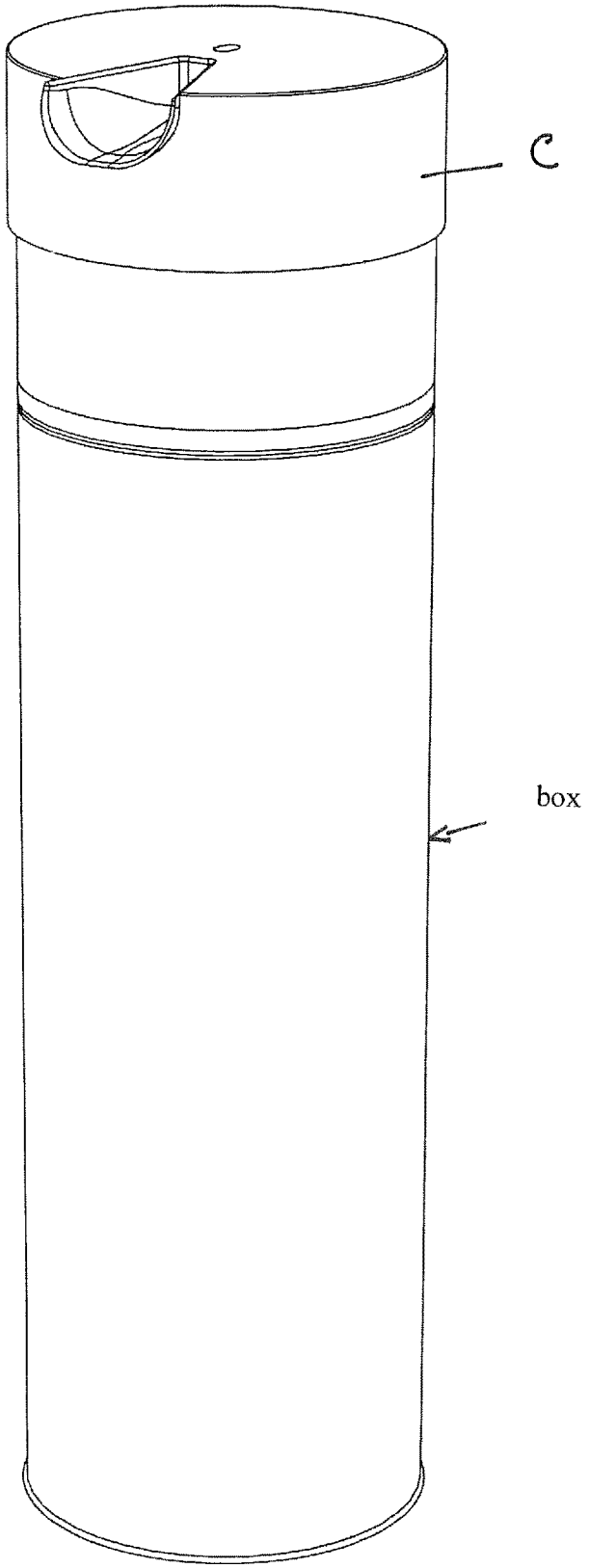
FIG. 16 is a view of a box according to the invention with a cover C which may be either a part of an apparatus according to the invention or a part sold with the box (preferably pre-mounted on the box)

FIG. 16 shows a box associated with a cover (C) comprising a valve control mechanism allowing or preventing the dispensing of wine contained in the bag (4).

Figure 17:
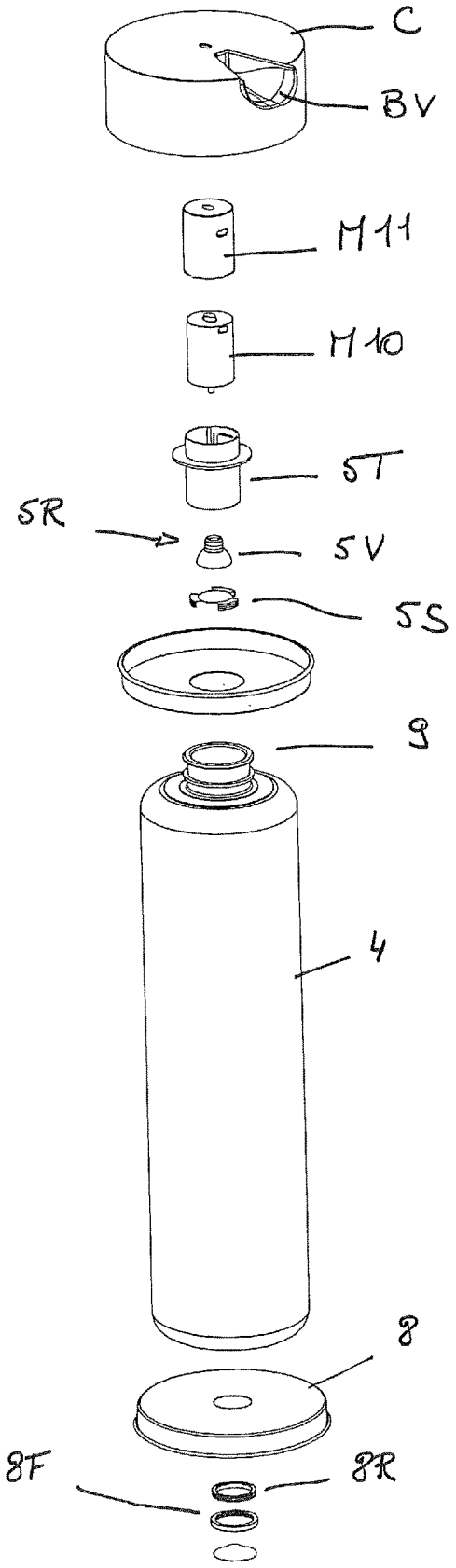
FIG. 17 is an exploded view of the box and the cover in FIG. 16.

This box with this cover (C) is shown in an exploded view in FIG. 17; only the net surrounding the bag (4) and the body (1) of the box are not shown.

The cover (18) has only one passage (9) (inserted into the central opening (18P)) communicating with the inside of the bag (4), said passage (9) being associated with a part (5) comprising a valve (5V) movable between a closed position opposing the passage of liquid out of the bag and an open position against the action of a biasing or return means (5R), while the bottom (8) has only a single central opening (8P) communicating with the part of the inner chamber (3) of the box located outside the bag (4), said opening (8P) being shut off by a seal or film (8F) which is for example tearable or able to be peeled off or torn or partially or totally pierced or pierceable, for example attached by one or more washers (8R). Said opening (8P) is designed to be associated with a liquid inlet pipe and an outlet pipe (or with a pipe having an inlet channel and an outlet channel). The washers or rings (8R) are advantageously designed to provide sealing between the cover and the inlet and outlet pipe when the latter is mounted on the bottom (8).

The biasing or return means (5R) of the valve (5V) may be of the spring type or a resiliently deformable material (for example elastomeric) which once deformed tends to return to its initial or undeformed shape.

Figure 18:
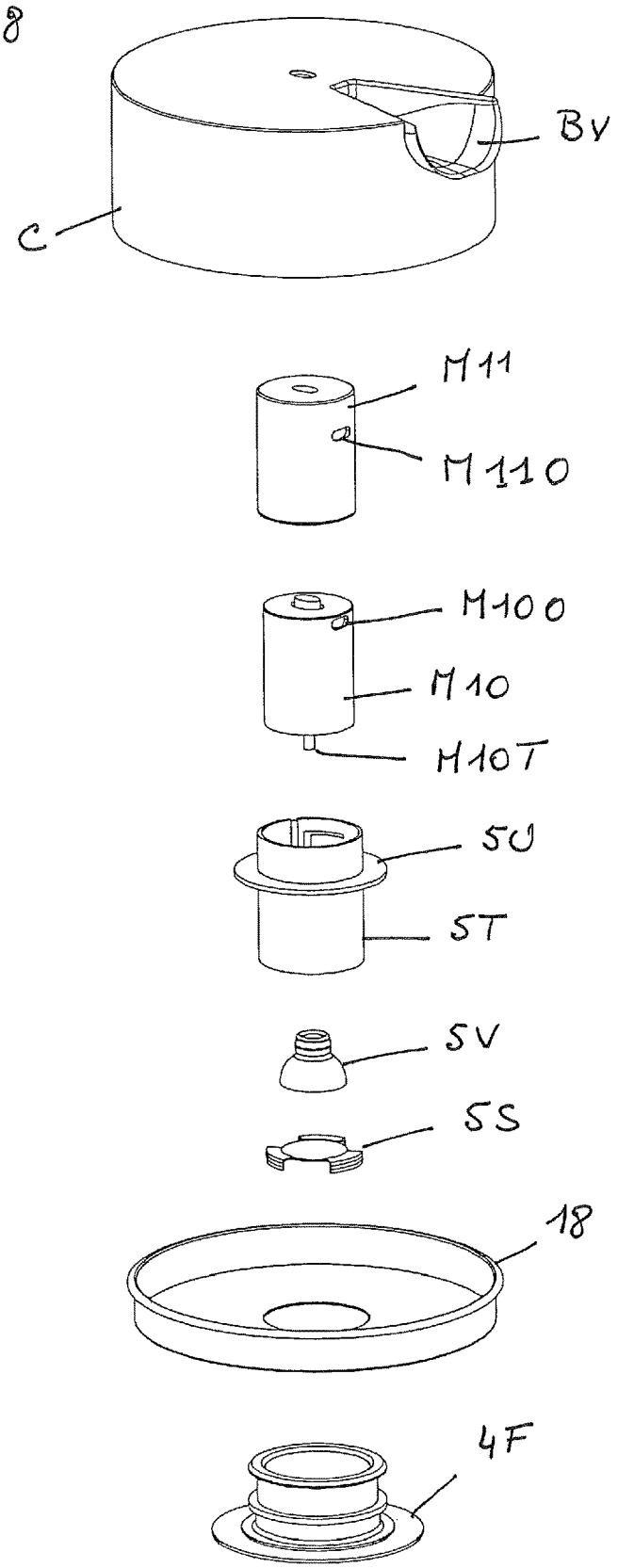
FIG. 18 is a larger-scale exploded view of the upper part of the box and the cover (C)
Figure 19B:
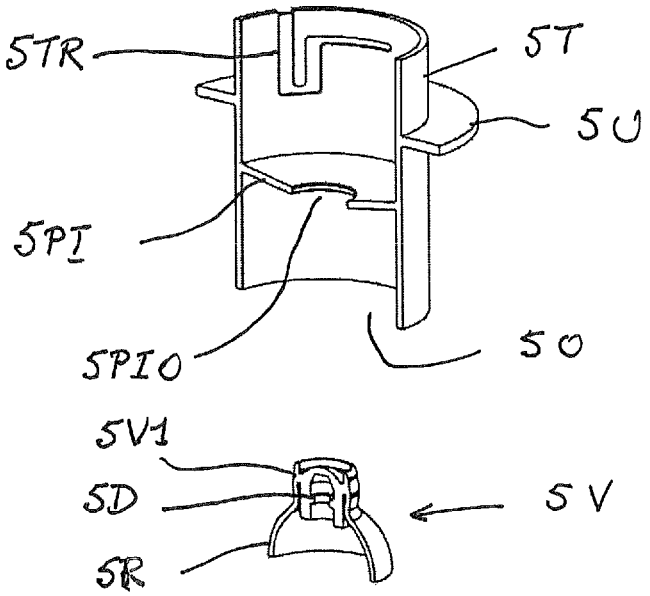

The part (5) (see FIG. 18 and FIGS. 19A and B) is a pipe (5T) with a flange (5U) resting on or attached to the cover (18) (The flange (5U) is advantageously glued or welded to the cover (18), especially on the outer side. This flange (5U) is advantageously made of a thermoplastic material enabling welding of the flange on the cover. If necessary the flange (5U) may also be associated with an additional seal).

Said pipe (5T) comprises an advantageously tapered inner plate (5PI), preferably with an inclination towards the inside of the chamber (3) and the bag (4) or of its fixing tip (4F) (this allows the liquid or wine which may be present in the pipe (5T) to flow into the bag (4)). Said inner plate (5PI) has a central opening (5PIO), said pipe (5T) being associated, in its portion (5TI) between the inner plate (5PI) and its open end (5O) directed towards the inside of the chamber (3) and the bag (4), with a seat (5S) for the biasing means (5R) of the valve (5V), said valve (5V) having a portion (5VI) designed to close off said opening(s) of the inner plate (5PI) in the closed position of said valve (5V), said biasing or return means (5R) pushing said valve (5V) towards the inner plate (5PI) in said closed position (by closed position is meant a position in which the valve (5V) opposes the passage of liquid through the pipe (5T), particularly between its lower open end facing the bag and its upper open end), whereas during the movement of the valve (5V) to the open position against the action of the biasing means (5R) (open position is a position in which passage of liquid through the pipe (5T) between its lower opening and its upper opening or vice versa is possible), an opening or openings in the plate is/are no longer closed off by the valve (5V). The seat (5S) and/or the portion (5TI) between the inner plate (5PI) and its open end (5O) directed towards the inside of the chamber (3) and the bag (4) has (have) a passage or passages communicating with the inside of the bag (4). Advantageously, the seat (5S) is inserted in the pipe (5T) removably or not, said seat then being advantageously attached to the lower end of the pipe (5T) by a clipping system. The seat then advantageously takes the form of a central plate with 3 to 6 feet, said feet (5SP) each being designed to cooperate with one or more slits or grooves in the bottom of the pipe (5T) to ensure fastening by clipping. The legs are spaced away from each other to form passages between the pipe (5T) and the seat (5S). The pipe (5T) is designed to be able to be inserted in the tip (4F) in a sealed way.

Figure 21C:
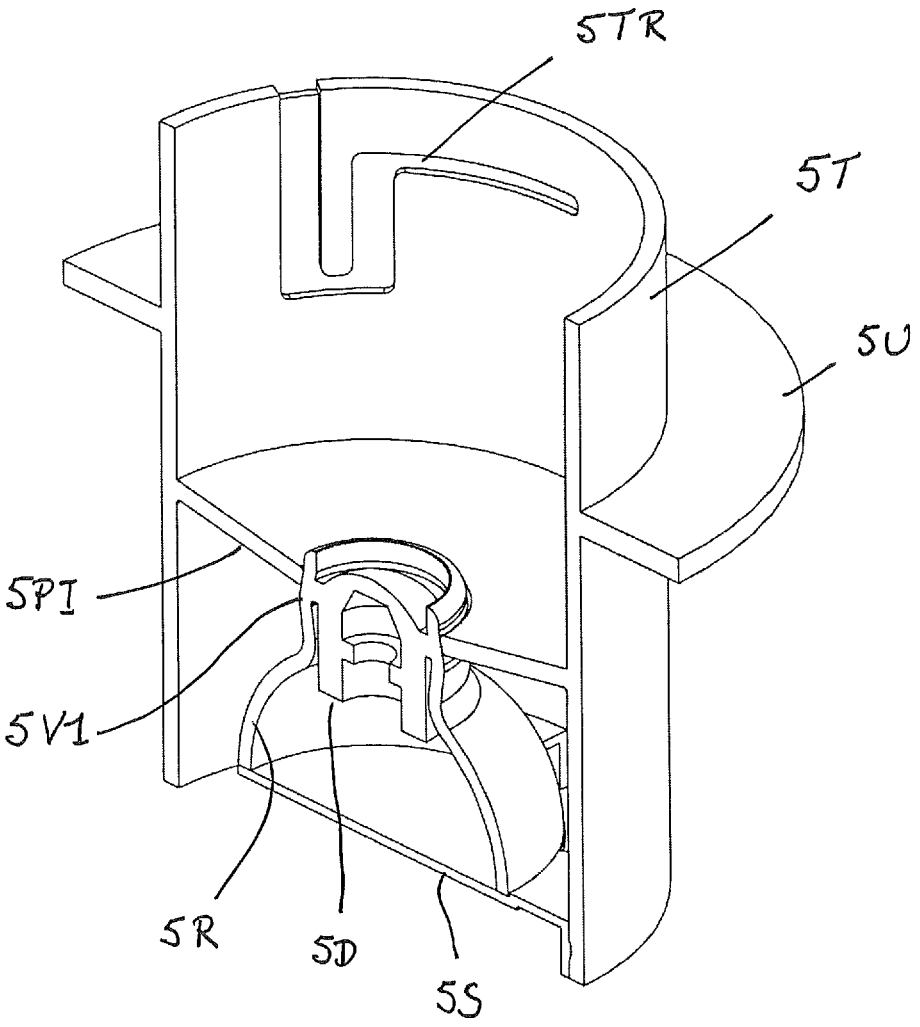

The valve (5V) has the shape of a pressure-deformable bell (5R) extended by a finger (5D), the bell (5R) having an edge (5RB) resting on the seat (5S) and being made of elastomeric material to form the biasing means, while the seat (5S) has a means to limit the movements of the edge (5RB) of the bell (5R) during its movement into the open position by deformation by pressure exerted on said finger (5D or 5V1). For example the central plate (5SC) of the seat has a hollow (5SC1) or recess or protrusions designed to form a bearing point or area for the base of the bell (5R), and thus limit the relative movements of the base of the bell (5R) with respect to the seat (5S). (see FIGS. 21A and B)

The box is associated with a cover (C) with a spout (BV), said cover (C) being associated with a mechanism (M) designed at least to control the opening of the valve (5V). The box may be marketed with the cover (C) associated with the box or capable of being mounted on the box (removably or not). The cover (C) can also be an element of the apparatus according to the invention. In this case, the cover (C) is mounted detachably on the box. If the cover (C) is mounted on the box, it is advantageously mounted movable on the box between an open position (in which the valve (5V) is in the open position) and a closed position (valve 5V in the closed position). When such a box with a cover is marketed, a system (e.g. a peelable or partially or totally tearable strip) is then provided to hold the cover (C) in the closed position prior to purchase and its placement in a device according to the invention. In such a case, the box with cover (C) will advantageously be marketed with instructions, and may then easily be recycled for reuse after disassembly and cleaning of the cover (C), removal of the cover (18) and the bag (4), installation of a new cover (18) with a new bag (4), and replacement of the cover (C) and a system (peelable or partially or totally tearable) for holding the cover (C) in the closed position.

The mechanism (M) designed at least to control the opening of the valve (5V) comprises at least one means (M10) movable between a raised position in which the valve (5V) is in the closed position (to prevent the passage of liquid through the pipe (5T) and a lowered position in which the valve (5V) is in the open position against the action of the biasing means (5R), said means (M10) being adapted to or associated with a means (M11) designed to cooperate with the pipe (5T) in a relative position of said means with respect to said pipe (5T) to hold said means (M10) in the lowered position and maintain the valve (5V) in the open position. (see FIGS. 18 and 19)

The cover (C) has a skirt (CJ) defining a chamber (CC) designed to receive the upper part of the box and its cover (18), the chamber (CC) defined by the skirt (CJ) having a central sleeve (CFC) communicating through a first opening (CFCO1) with the spout (BV) and through a second opening (CFCO2) with the external environment along the top wall of the cover (C), said central sleeve (CFC) being associated with a first whistle (M11) mounted at least partially rotatably with respect to the central sleeve (CFC), said first whistle (M11) having a hollow cylindrical body (M11A) with one end associated with a plate (M11P) with a central opening designed to be positioned opposite the second opening (CFCO2) and with a central guide sleeve (M11G) coaxial with the cylindrical body (M11A) and communicating with the second opening (CFCO2) when said first whistle (M11) is engaged in the central sleeve (CFC). In this embodiment, the means (or second whistle M10) for controlling the valve (5V) is a sleeve (M10A) with one end closed by a plate (M10B) associated with a part (M10C) defining a groove (M10G) open towards the central guide sleeve (M11G) and designed to receive said central guide sleeve (M11G), said part (M10C) carrying a rod or needle (M10T) designed to act on the finger (5D) of the valve (5V) when the latter is in the open position, said sleeve (M10A) being mounted mobile at least in translation relative to the hollow cylindrical body (M11A). Also in this embodiment, the hollow cylindrical body (M11A) has an opening (M11O) which by rotation relative to the central sleeve (CFC) can be brought opposite the first opening (CFCO1) of the central sleeve (CFC), while the sheath (M10A) has an opening (M10O) which by axial translation movement relative to the cylindrical body (M11A) can be brought opposite the opening (M11O) of the hollow cylindrical body (M11A) while preferably the means M10 and/or the means M11 are mounted removably relative to the cover (C) with spout (BV). Removable mounting facilitates operations to clean the cover (C). The whistles (M10 and M11) and the cover (C) are therefore advantageously attached to each other removably, while allowing some relative movement between them.

The guide sleeve (M11G) of the whistle (M11) and the groove (M11G) of the means (M10) are designed to permit only relative axial translation movement between them. The guide sleeve has for example a section along an oval edge. The part (M10C) is advantageously extended by a small protrusion (M10CP) on which a finger of an apparatus according to the invention can act to enable a relative movement of the part (M10) with respect to the box, to bring the valve (5V) into the open position against the biasing or return means (5R).

The hollow cylindrical body (M11A) and the sleeve (M10A) each have a vent hole (M11AE; M10AE) which can be brought opposite one another by relative axial translation movement between the hollow cylindrical body (M11A) and the sleeve (M10A).

Figure 20:
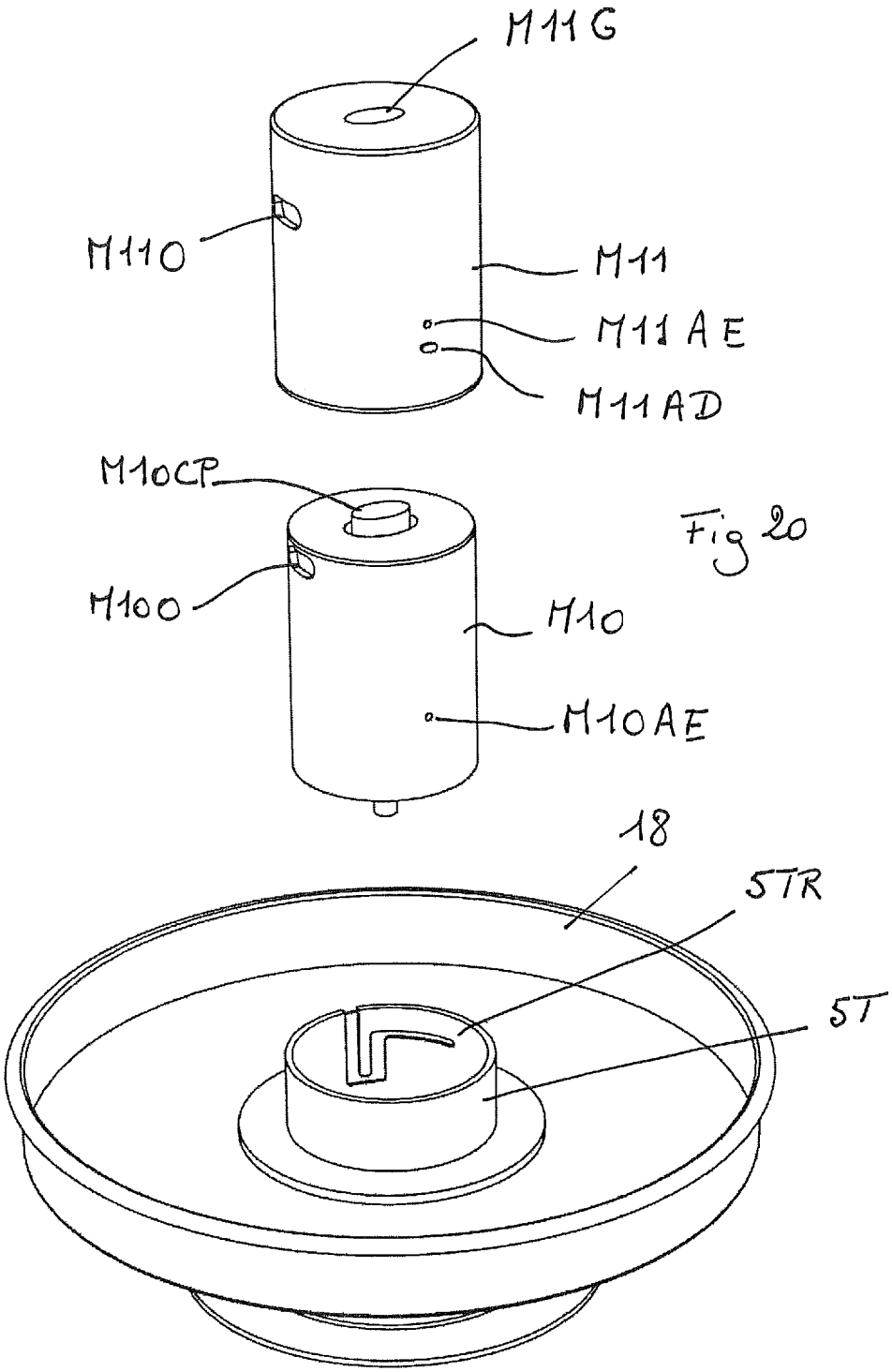
FIG. 20 is a view of the cover (18) with the pipe (5T) of the box, and of the valve control mechanism.

The hollow cylindrical body (M11A) carries at least one finger (M11AD) on its outer face, while the pipe (5T) has on its inner face at least one groove (5TR) open from the upper edge of the pipe (5T) and presenting a path permitting at least a first movement comprising at least a component of relative axial translation movement of the cylindrical body (M11A) with respect to the pipe (5T) (vertical groove portion) and at least a second movement comprising at least a component of relative rotation movement of the cylindrical body (M11A) with respect to the pipe (5T) (groove portion extending in a horizontal plane) (see FIG. 20).

Figure 23:
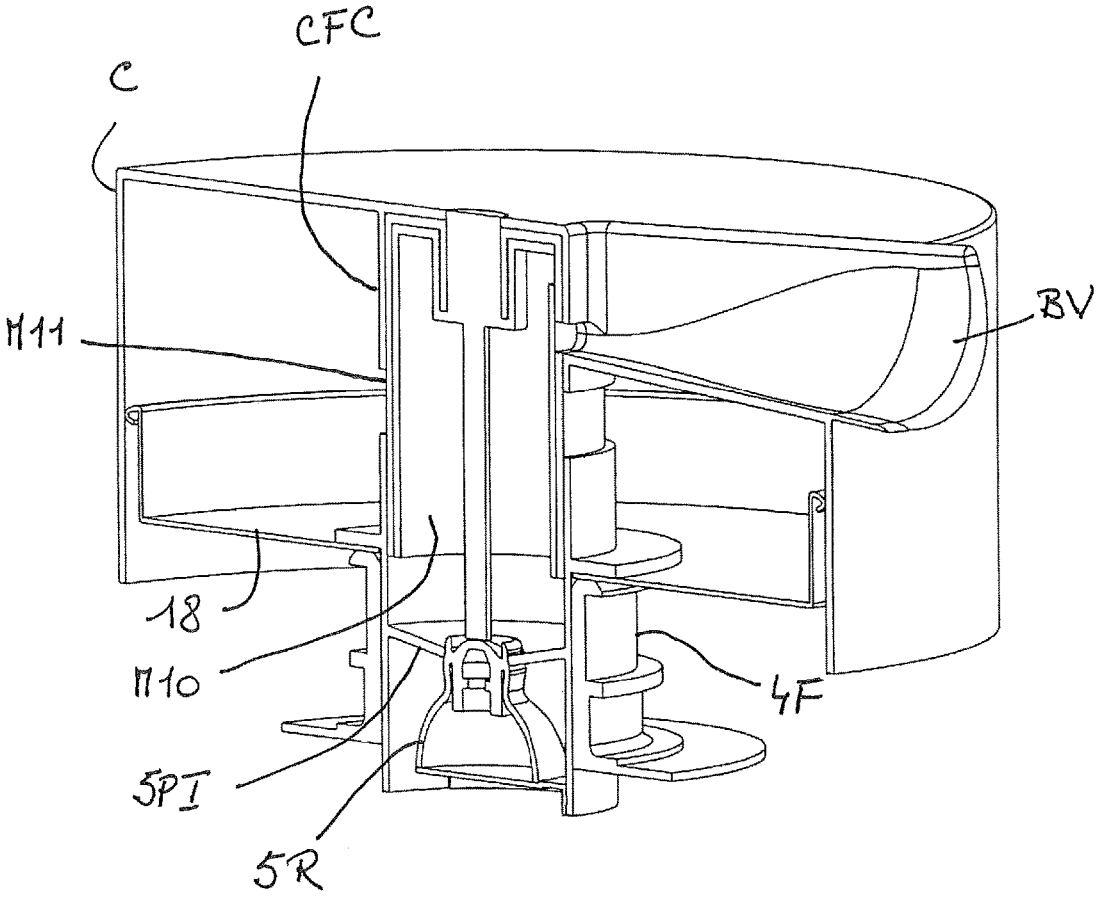
FIG. 23 is a larger-scale sectional view of the cover (C) in the closed position.

FIG. 23 shows the cover (C) mounted on the box (only the cover (18) and the tip (4F) of the bag being shown). The valve (5V) is in the closed position.

FIGS. 24 A to 24F show the movement of the parts relative to each other. In FIG. 24B, the cover (C) is lowered (for example by the apparatus) with respect to the box (movement of the top of the box into the hollow of the cover). This downward movement is controlled by the movement of the finger (M11AD) in the groove (5TR) (vertical path). The downward movement is also limited by the abutment of the central sleeve (CFC) on the upper edge of the pipe (5T). During this first movement the two whistles (M10 and M11) are brought into contact with the external air by the vents facing one another. In this lowered position the needle (5T) presses on the finger of the valve to compress it and therefore open it. (FIG. 24B)

After a first rotation and a slight upward movement (second vertical path of the groove) the vents are no longer in communication with the outside air. By rotation of the cover, it is now possible to bring the opening (M11O) opposite the opening (CFCO1) of the cover. (see FIG. 24D)

Figure 24A:
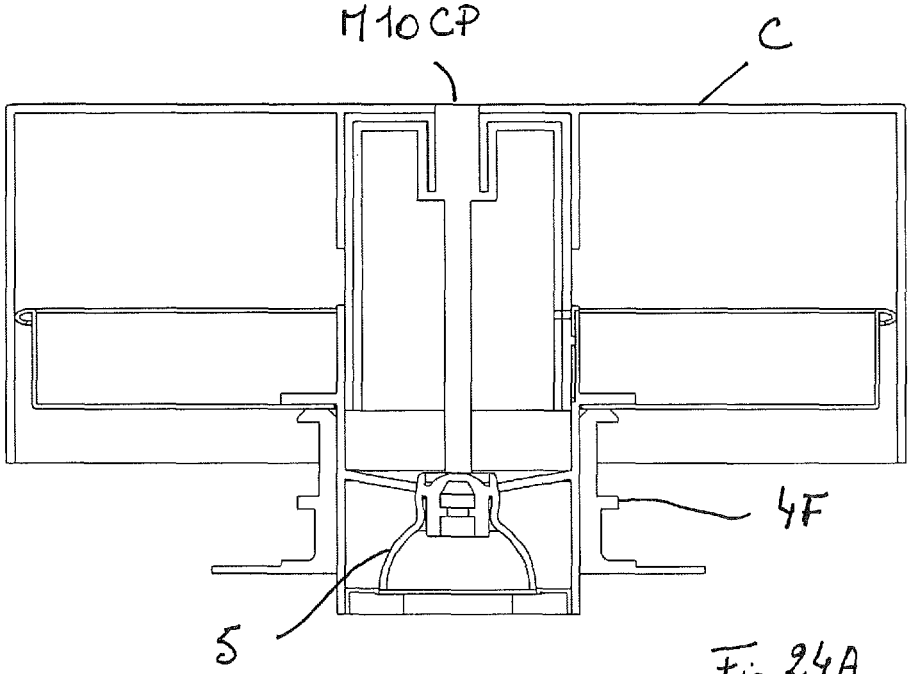
FIGS. 24A to 24F show steps for use of the cover during dispensing of wine from the bag (not shown)
Figure 24B:
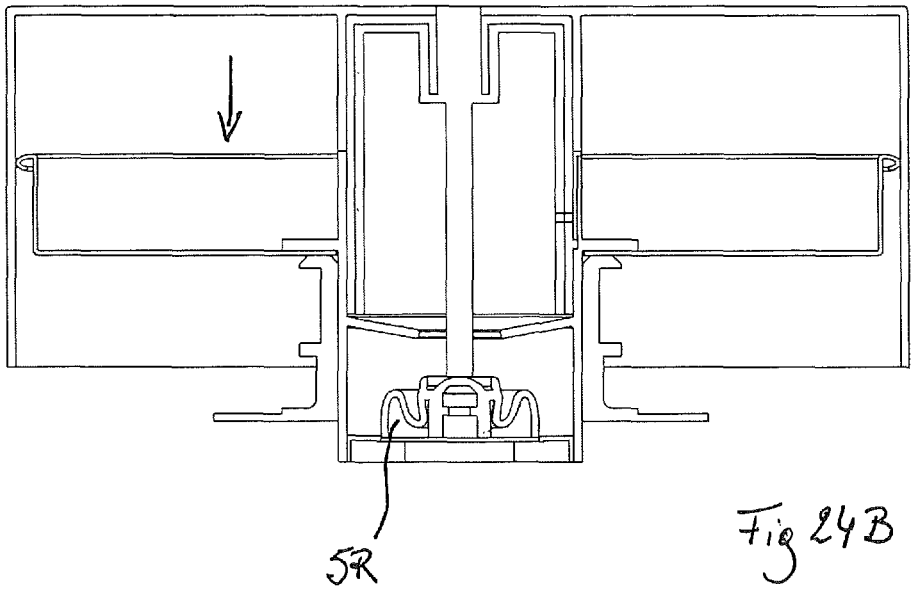
Figure 24C:
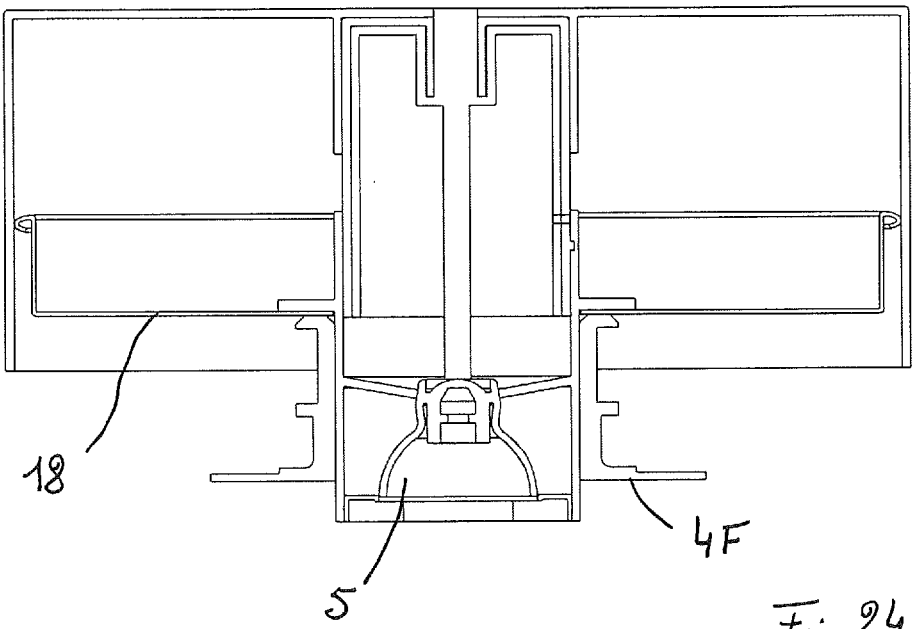
Figure 24D:
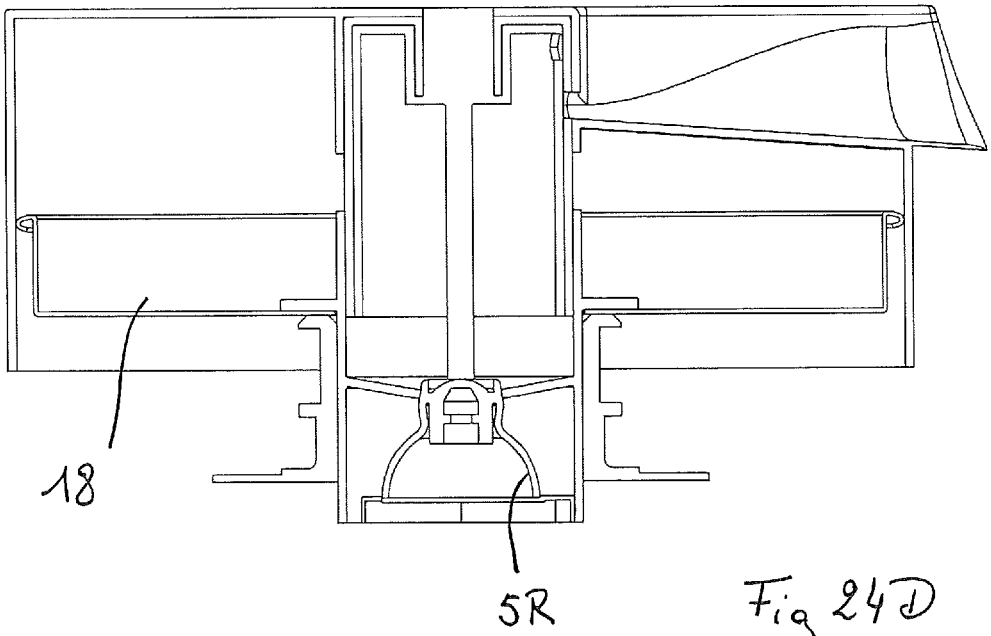
Figure 24E:
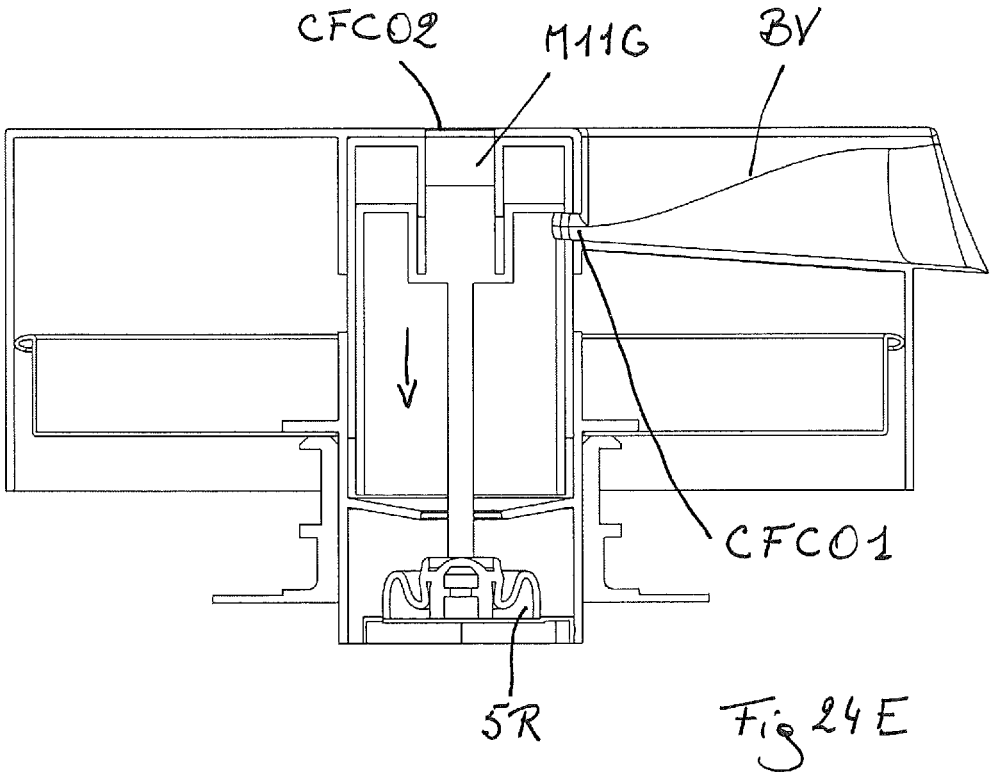

The apparatus according to the invention now has a needle designed to act on the protrusion (M10CP) to axially move the whistle (M10) downward to bring the opening (M10O) opposite the opening (M11O) and to bring the valve (5) into the open position. This then allows the wine in the bag to flow through the pipe (5T) and pass through the openings (M10O and M11O) to flow into the spout (BC), thanks to the pressurized liquid introduced into the chamber of the box through the opening (8P). (FIG. 24E)

Figure 24F:
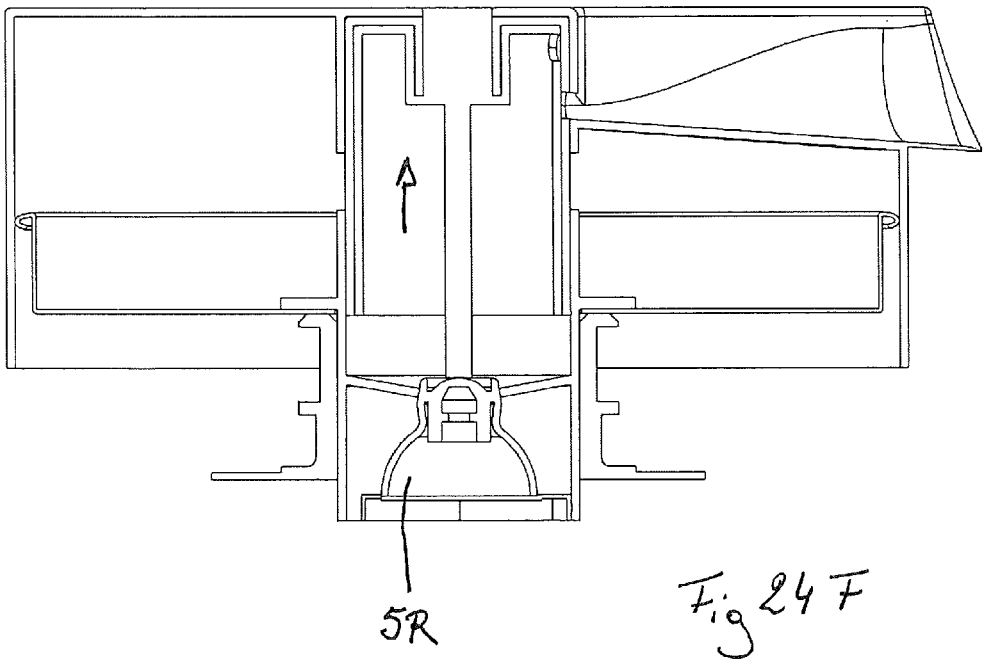

Once the glass if filled, the needle of the device no longer acts on the protrusion (M10CP) and the biasing part (5R) of the valve puts the valve back in the closed position, but also pushes the whistle (M10) upward so that the opening (M10O) is no longer opposite the opening (M11O). The wine present in the whistle (M10O) is thus protected from the ambient air. (FIG. 24F)

Figure 25A:
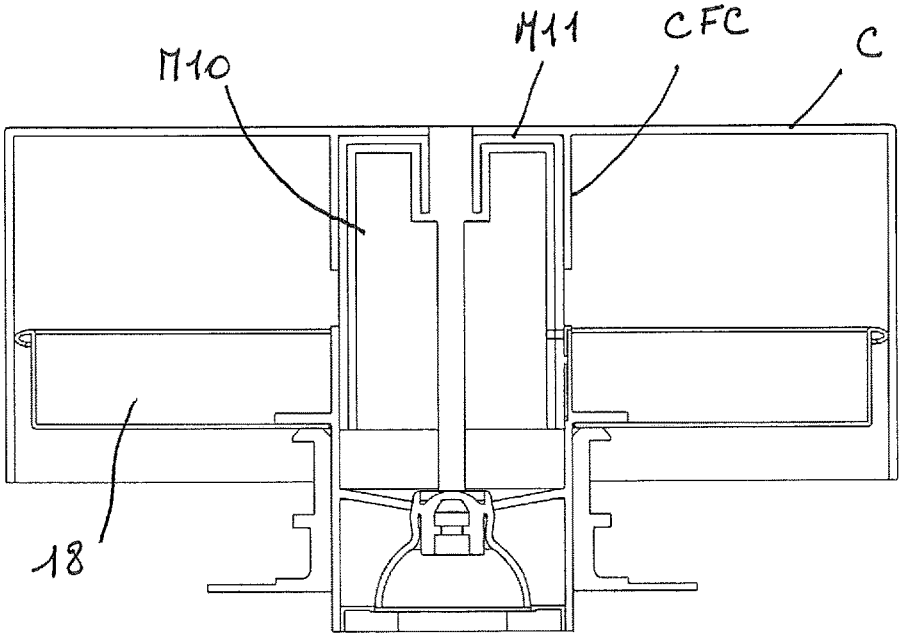
FIGS. 25A to 25C show steps during the disconnection of a box from the apparatus according to the invention.
Figure 25B:
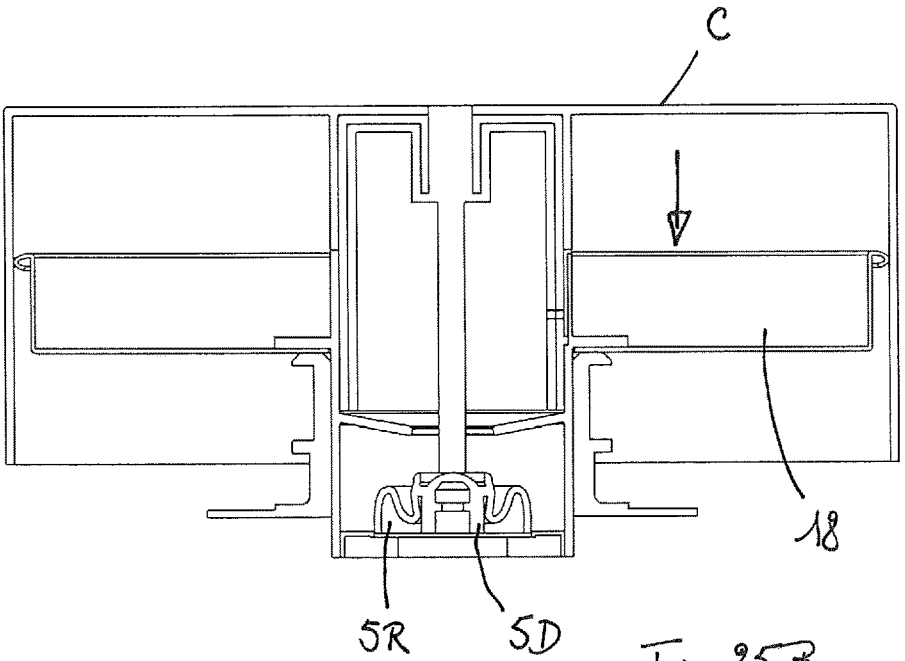
Figure 25C:
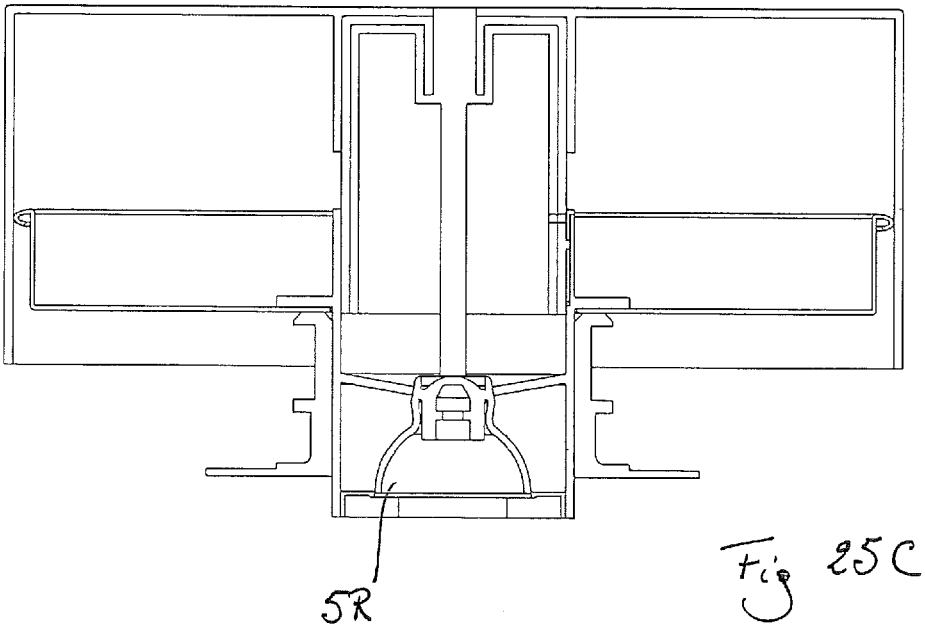
Figure 26:
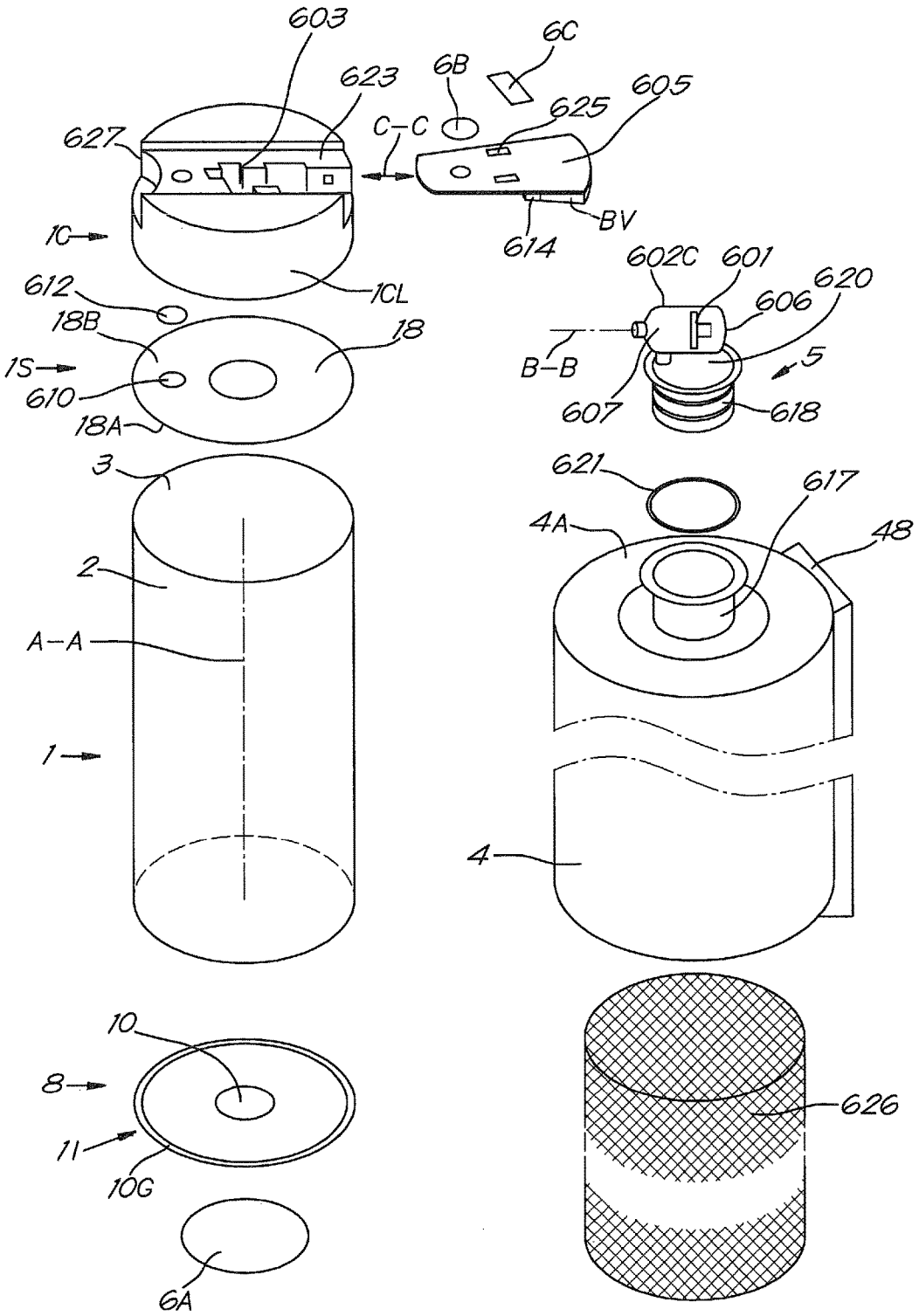
FIG. 26 is an exploded view of another box according to the invention.
Figure 28:
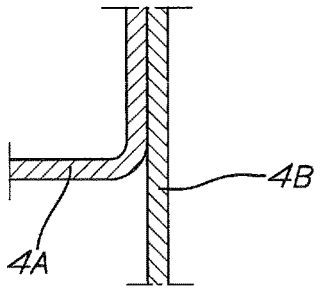
FIG. 28 is a partial view of the bonding of the two films forming the bag in FIG. 27.
Figure 27:
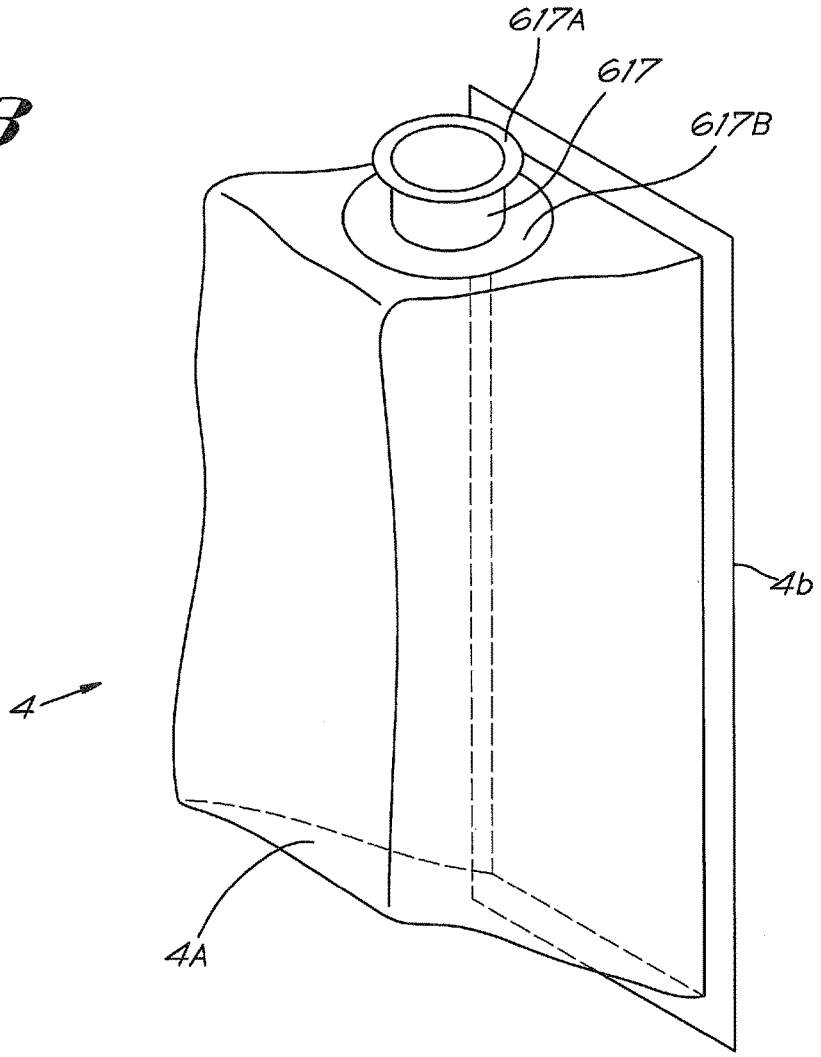
FIG. 27 is a perspective view of the bag of the box in FIG. 26.
Figure 29A:
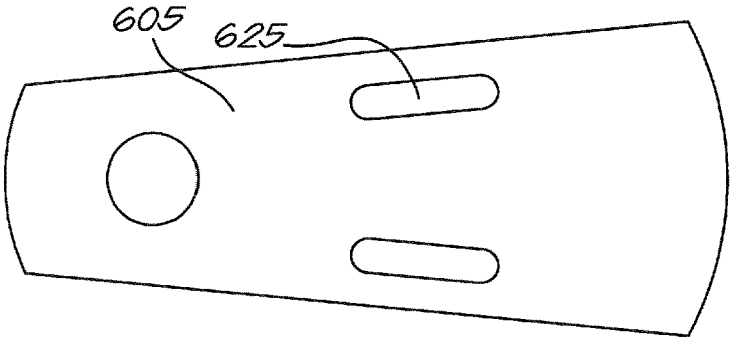
FIGS. 29A to C are top, bottom and side views of the retention part.
Figure 29B:
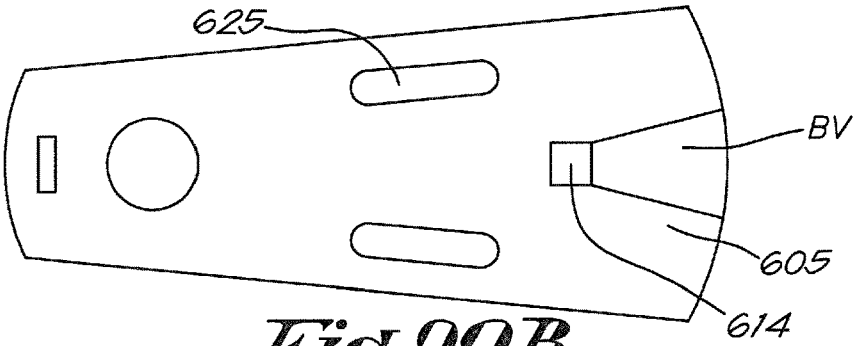
Figure 30:
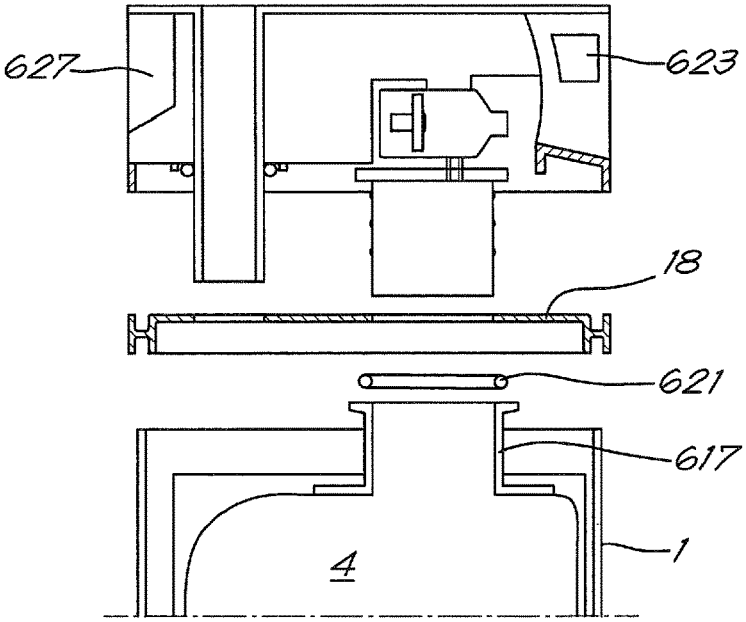
FIG. 30 is an exploded sectional view of the cover, the bag and the container.
Figure 29C:
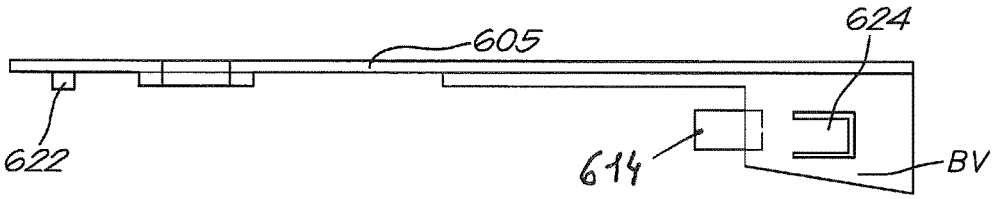
Figure 36:
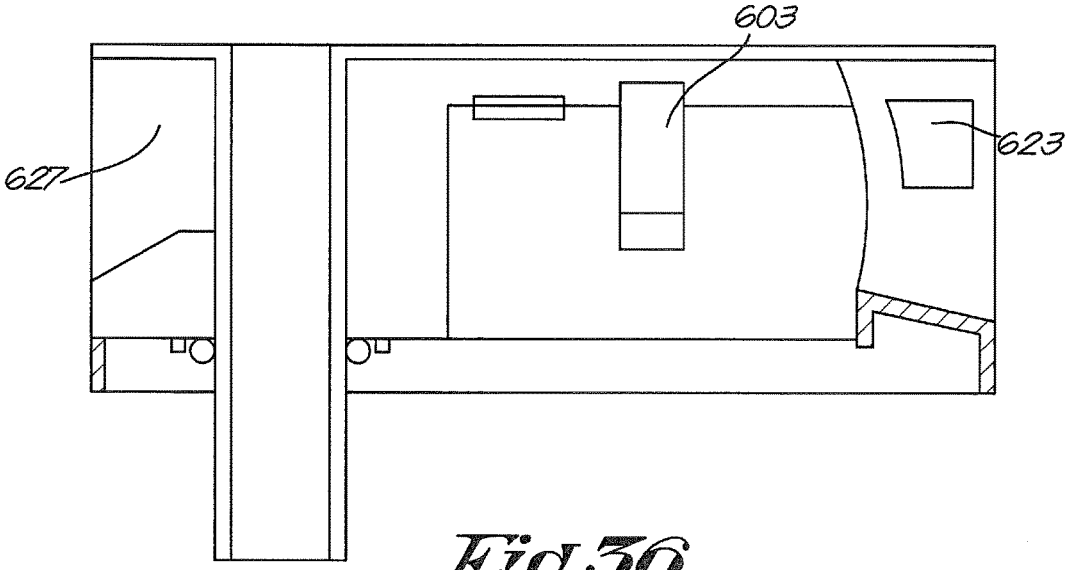
FIG. 36 is a sectional view of the cover in FIG. 34 along the line XXXVI-XXXVI.
Figure 37:
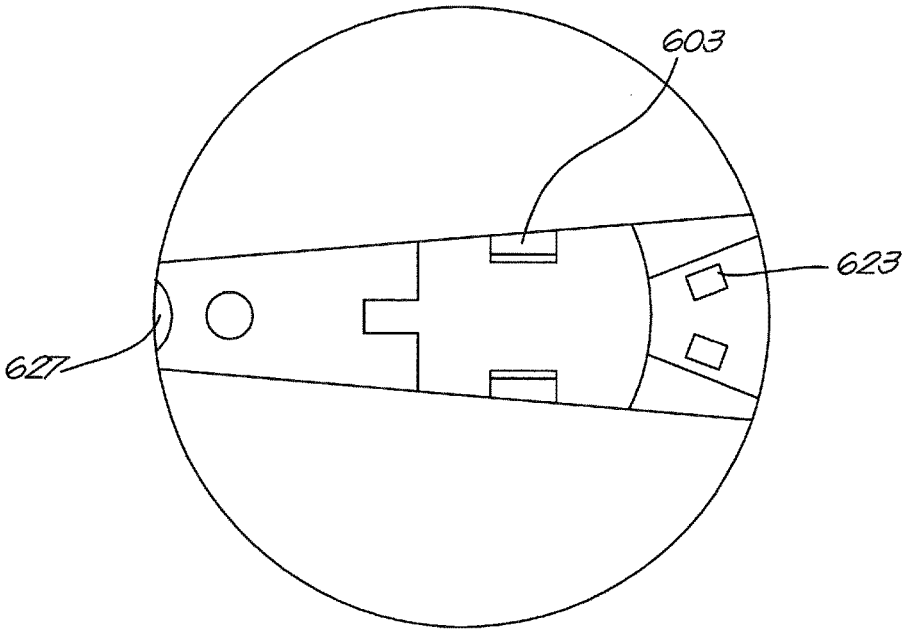
FIG. 37 is a view of the bottom of the cover in FIG. 34.
Figure 32:
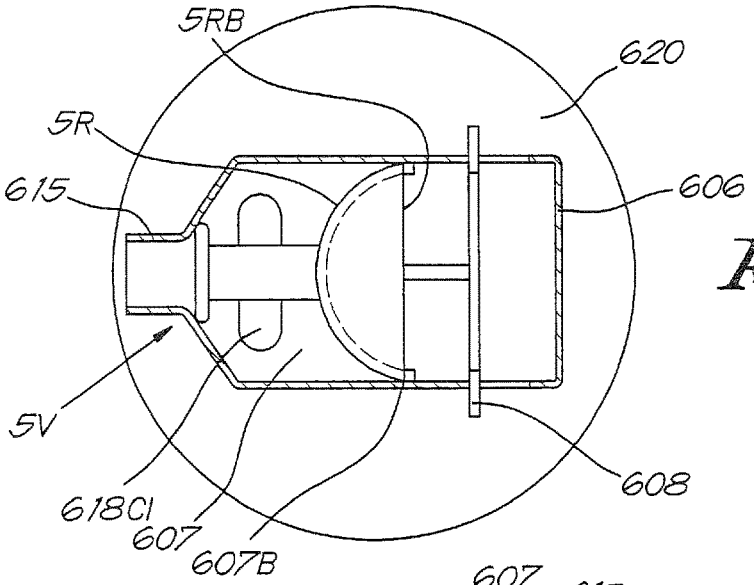
FIG. 32 is a sectional view of the valve in the closed position.
Figure 31:
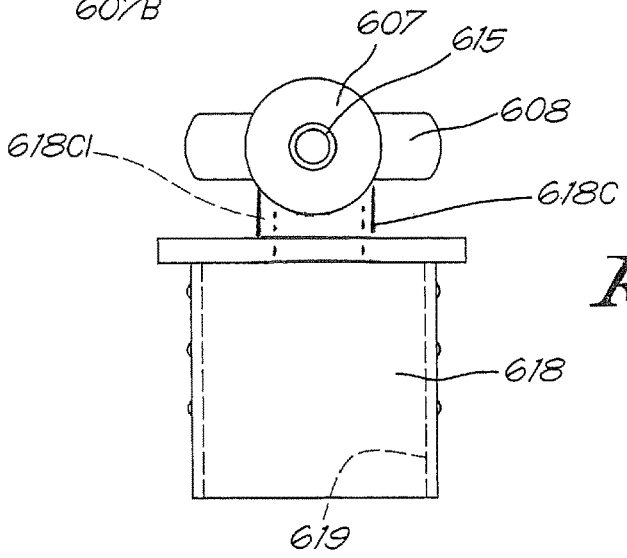
FIG. 31 is a front view of the valve.
Figure 33:
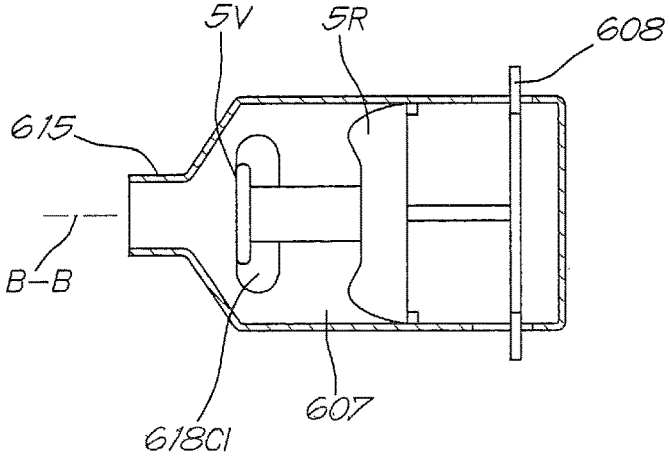
FIG. 33 is a sectional view of the valve body in the open position.
Figure 34:
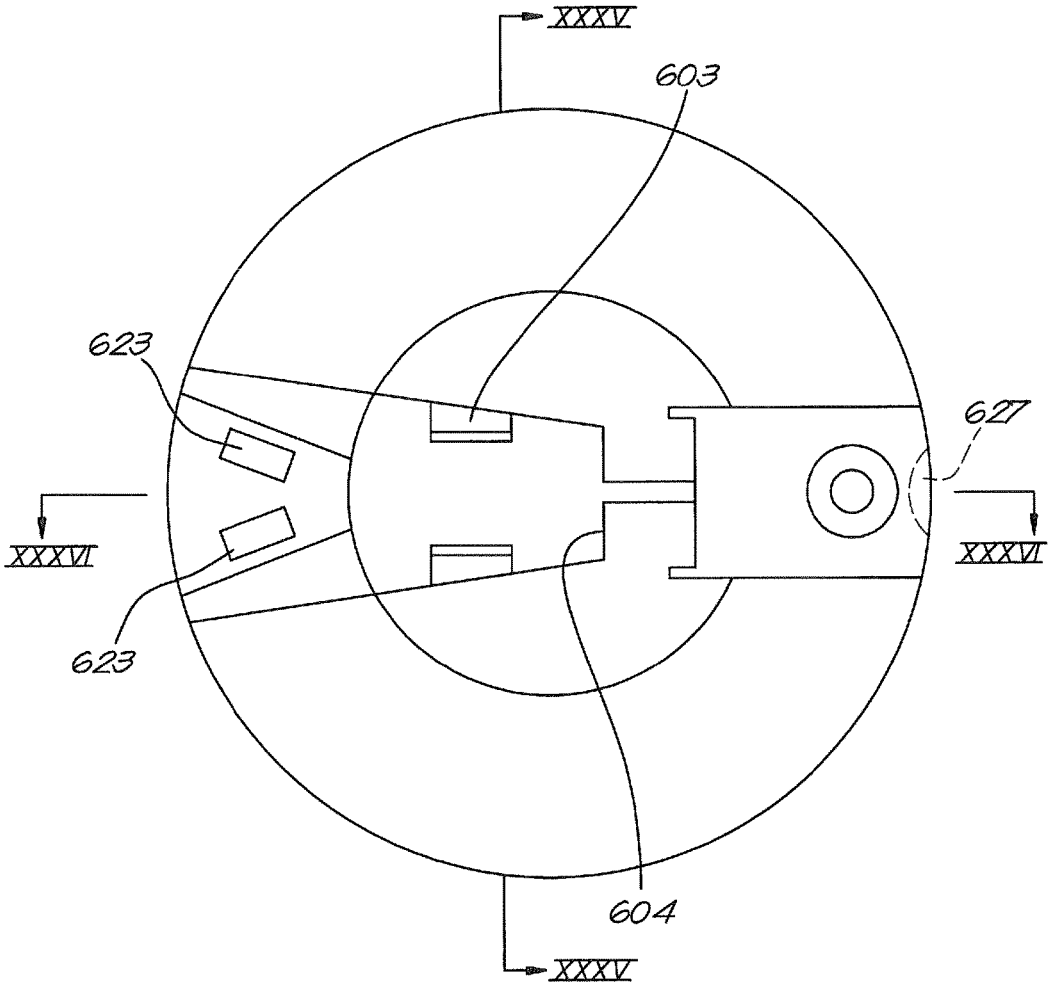
FIG. 34 is a top view of the cover without the retention part.
Figure 35:
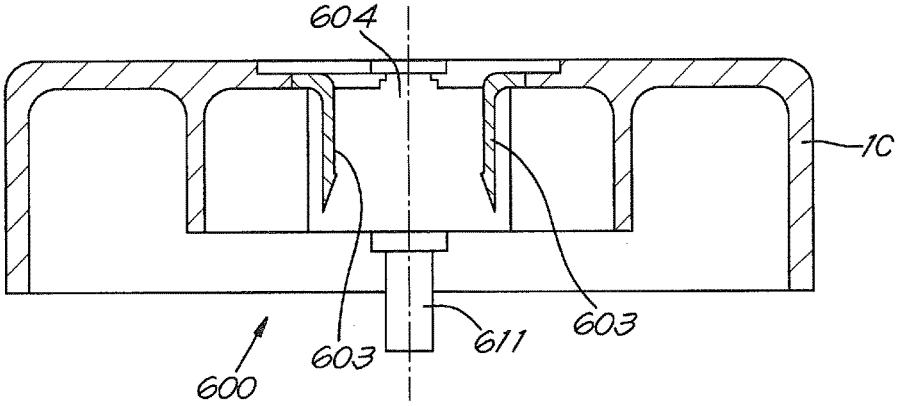
FIG. 35 is a sectional view of the cover in FIG. 34 along the line XXXV-XXXV.
Figure 38:
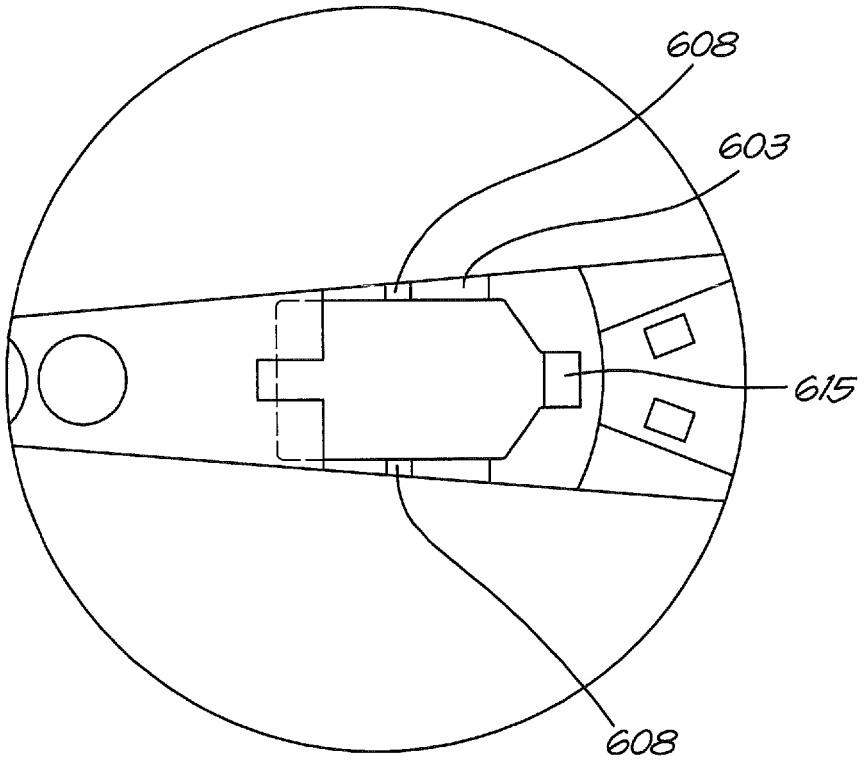
FIG. 38 is a view of the bottom of the cover in FIG. 34 with the valve body attached between the two flexible tabs.
Figure 40:
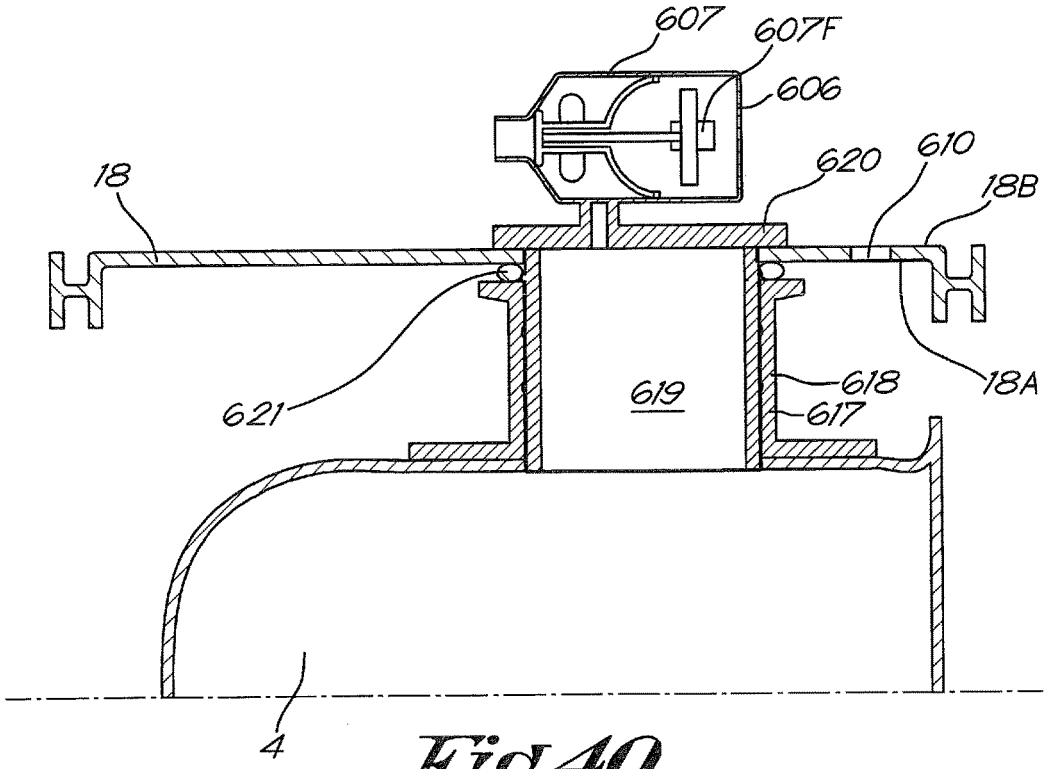
FIG. 40 shows in partial section the bag associated with the valve.
Figure 39:
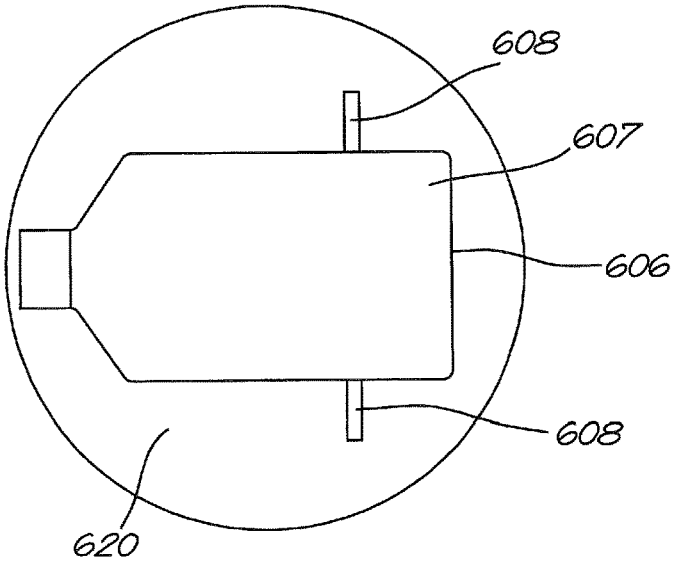
FIG. 39 is a top view of the valve shown in FIGS. 31 to 33.

FIGS. 25A to C show steps for disconnection of a box, for example because the bag (4) is empty. The cover is first of all in the position shown in FIG. 24F.

The cover is rotated and then moved downward in order first to position the vents of the whistles (M10 and M11) opposite each and then to open the valve (V). In this operation the chamber of the box has previously been emptied of the liquid through its lower opening (8P). In the position shown in FIG. 25B, the wine in the whistle (M10) then flows into the bag (4) via the pipe (5T).

It is then possible to rotate the cover and bring it into the high position, or to remove it, for example for cleaning.

FIGS. 26 to 40 are views of the box or of parts of the box. The rigid box presenting a container (1) whose wall or walls (2) define an inner chamber (3) in which there extends a soft bag (4) for a liquid or viscous food to be consumed in an appropriate serving temperature range, said bag (4) being associated with a part (5) associated with a valve with a portion with a control device to move the valve between at least an open position and a closed position, said container (1) having a lower part (1I) with a bottom (8) presenting at least one opening (10) which can if necessary be closed by a means (6A) and which communicates with the inner chamber (3), an upper part (1S) with a plate (18) with at least one passage (9) for the to part (5) or a portion thereof.

The wall (2) has a side (2C) facing the inner chamber (3) resistant to an aqueous medium at a temperature at least close to the appropriate serving temperature range.

The upper part (1S) of the (cylindrical) container is associated with a cover (1C) having an opening or passage for an element capable of acting on the control device of the valve, this cover (1C) being associated with a spout (BV).

The cover (1C) defines a chamber or hollow (600) to accommodate at least partially the portion with the control device (601) of the valve (or its body) (602), said cover (1C) comprising one or more means (603, 604) to attach said portion of the valve (602) to the cover (1C) and maintain said portion of the valve (602) in position during the movement of said control device (601) inside said chamber (600) of the cover (1C).

The cover (1C) is associated with at least one means of positioning (603, 604) of the portion with the control device in the chamber or hollow of the cover, and with at least one retention part (605) for said portion with the control device (601) of the valve (602), said retention part (605) being movable relative to said cover (1C) between a retention position in which said retention part (605) opposes withdrawal of the part with the control device (601) of the valve (602) from the chamber or hollow (600) of the cover (1C), and a non-retention position in which said retention part (605) does not oppose withdrawal of the portion with the control device (601) of the valve (602) from the chamber or hollow (600) of the cover (1C).

The cover (1C) has, in its chamber or hollow (600), at least two tabs (603) which are spaced apart from each other and flexible, said tabs (603) serving as a means to cooperate with the portion (in this case the substantially cylindrical body) comprising the control device (601) of the valve (602) to ensure positioning of said portion in the chamber or hollow (600) of the cover (1C).

The cover (1C) also has a stop (604) in its chamber or hollow (600), said stop serving as a support for a wall (606) of the portion with the control device (601) of the valve (602) to limit or prevent movement of said portion of the valve (602) during relative movement of the control device (601) with respect to said portion of the valve (602). This stabilizes the valve body during the movements of the control device.

The valve body (602C) associated with the control device (601) of the valve (602) has a hollow body (607) with two windows, while the control device (601) comprises two lugs (608) extending outside said body (607). They are movable relative to said body (607) against the action of a biasing means (5R) between a first position corresponding to the closed position of the valve (5V) and a second position corresponding to the open position of the valve (5V), said biasing means (5R) exerting a force opposing the movement of said lug or lugs (608) towards its/their second position(s). This biasing means (5R) is for example a substantially hemispherical hollow rubber body carrying at its top the valve (5V) designed to close the opening of the tube (615) extending the valve body (602C). This biasing means (5R) is located inside the hollow of the body (607), the latter having a support stop (607B) for the circular base (5RB) of the biasing means (5R). A rod extends between a recess of the valve (5V) and a support for the lugs (608), passing through the hollow of the biasing means (5R). When the lugs are moved towards the stop (604), the biasing means (5R) is elastically deformed, its central part being retracted in the hollow of the body (607) in the direction of the stop or wall (604) of the cover (1C) (or towards the wall (606) of the valve body (602C)). When the lugs (608) are no longer used to apply a thrust, the biasing means (5R) returns to its initial position, in which the valve body closes the opening of the tube extending the valve body (602C). The valve body (602C) is connected to the element (618) by a pipe (618C) whose internal passage (618CI) forms a communication between the chamber (607) and the internal passage (619) of the element (618). When the biasing means (5R) is moved (against the biasing force), the valve (5V) closing the pipe (615) is moved inside the chamber (607), with the result that a passage is formed between the inside of the bag (4) and the tube (615), via the passage (619), the pipe (618CI) and the inner chamber (607).

The tabs (603) extending in the chamber or hollow (600) of the cover (1C) serve as a means of positioning of the lugs (608) of the portion with the control device (601) of the valve (602) in the hollow or chamber (600) of the cover (1C). The lugs are thus located between the tabs (603) and the stop (604) of the cover (1C).

The lugs (608) are movable against a biasing means (5R) between an adjacent position of the tabs (608) (closed position of the valve), and a remote position of the tabs (608) (open position of the valve).

The container (1) has a central axis (A-A), while the control device (601) moves in a direction (B-B) perpendicular or substantially perpendicular to said central axis (A-A) of the container (1). This makes it possible to exert a force tending to separate the cover (1C) from the container (1) when the valve (602) is opened.

The plate (18) of the upper part (1S) (the plate closes the upper opening of the container (1) has a means (610) cooperating with the cover (1C) to limit and preferably prevent rotation of the cover (1C) relative to the container (1) or to the plate (18). The plate (18) has for example a circular lower groove designed to accommodate the upper edge of the container (1) with an interposed layer of glue. The plate (18) also has a circular upper groove designed to accommodate a circular edge of the cover (1C).

This plate (18) has a passage or a recess (610), while the cover has a protrusion (611) extending in said passage or recess (610) to limit or prevent rotation of the cover relative to the container or to the plate (18).

The plate (18) has a passage (610) towards the inner chamber (3) of the container (1), while the protrusion (611) is a pipe carried by the cover (1C), thus enabling passage of air or liquid into the inner chamber (3) via the pipe (611) carried by the cover (1C), a seal (612) advantageously surrounding the pipe (611) to be compressed between a flat support (613) of the pipe (611) and the plate (18) of the upper part (1S) of the container (1).

The container (1) has a central axis (A-A), in which the retention part (605) is movable in a direction (C-C) perpendicular to said central axis (A-A), said retention part (605) comprising a spout (BV), an open end (614) of which accommodates one end of an outlet channel (615) of the valve (602).

The plate (18) has a first side (18A) facing the inner chamber (3) and a second side (18B) opposite the first side and facing the chamber or hollow (600) of the cover (1C). The soft bag (4) is associated with a hollow tip (617), while the valve (602) is associated with an element (618) presenting an inner open channel (619), a transverse section enabling the insertion of the element (618) in the hollow tip (617), and a clamp (620) bearing, possibly with an interposed seal, on the second side (18B) of said plate (18). Advantageously, a seal (621) surrounding said element (618) of the valve (602) bears on the first side (18A) of the plate (18), and is preferably compressed between a far edge (617A), advantageously with a collar, of the hollow tip (617) and said first side (18A) of the plate (18).

The lower plate 8 has a groove (10G) designed to accommodate the lower edge of the container (1), with an interposed layer of glue. The lower plate has a central opening (10) which can be closed by a peelable or tearable film when it is positioned on a support of an apparatus according to the invention.

The retention part (605) is held in position on the cover (1C) by a clip system or a system for insertion of a protrusion (622), possibly carried by a strip (624), in a recess or window (623).

The retention part (605) has two windows (625) giving access to the control device (601) of the valve (602) located in the hollow or chamber (600) of the cover (1C), the window(s) (625) being positioned to enable the insertion in the hollow or chamber (600) of the cover of an end or ends (630) of a tool (631) to apply a force on the control device (601), said windows (625) being advantageously also positioned to enable the insertion of a tool to detach the retention part (605) from the cover (1C).

The bag (4) comprises a first soft element (4B) and a second soft element (4A) bonded together to form a soft pouch, the first element (4B) being less supple than the second element (4A), this second element (4A) having an area facing the inside of the pouch at least 50% and preferably 75% to 300% greater than the area of the first element (4B) facing the inside of the pouch, and in that advantageously the tip (617) of the soft bag is attached to said second soft element (4A) near one of its edges bonded to the first soft element (4A).

The soft bag (4) is surrounded by a soft net (626) serving as a means to ensure that channels exist between the inner face of the container and the soft bag to enable passage of liquid around the bag during the operations to extract liquid food from the bag.

The hollow tip (617) advantageously has a lower collar (617B) bonded to the film (4A).

The cover (1C) has a positioning hollow or recess (627), said hollow or recess extending along the side face (1CL) of the cover (1C).

The box is associated with one or more means of protection (6, 6A, 6B, 6C) to secure the closing of a passage or passages or windows before the box is used. For example, such means are tearable or detachable flexible films, or tearable or deformable elements for the windows of the retention part of the cover (1C).

Figure 41:
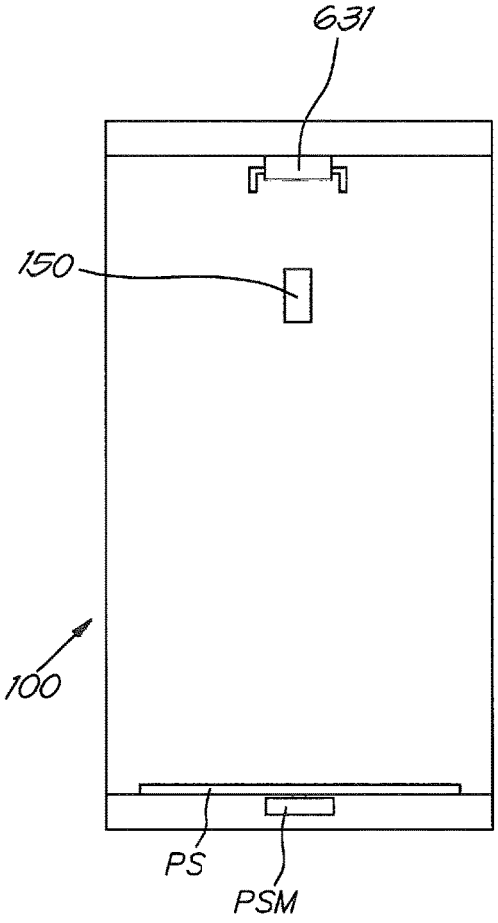
FIGS. 41 and 42 are views of a unit of an apparatus according to the invention for a box as shown in FIG. 26.
Figure 42:
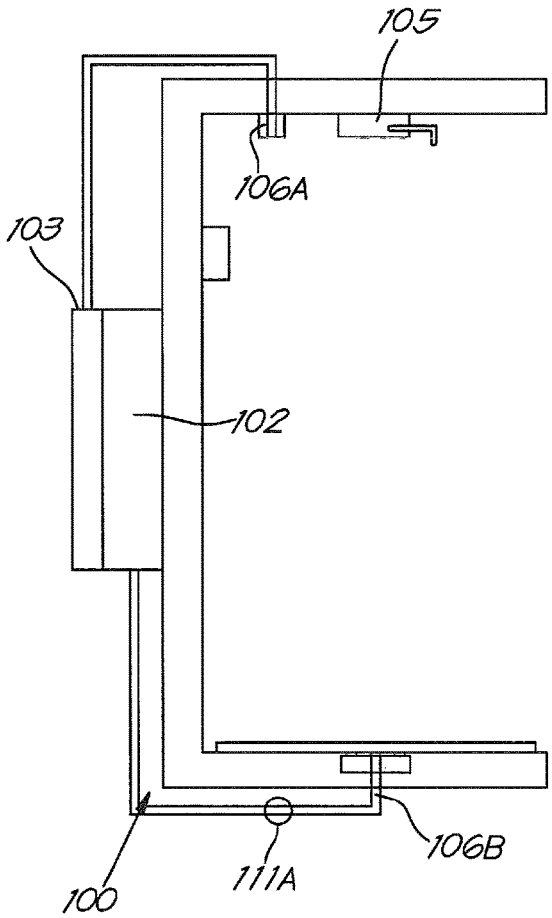
Figure 43:
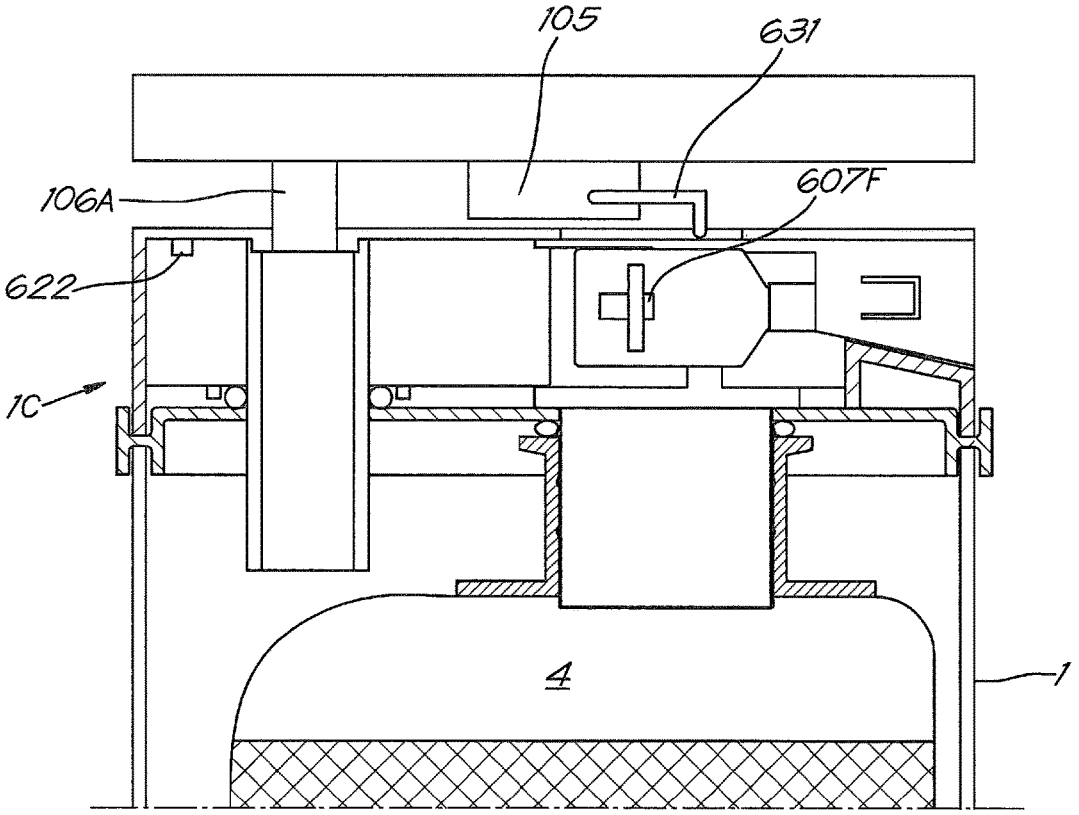
FIG. 43 is a partial view of the apparatus associated with a box, with the box in the unlocked position.
Figure 44:
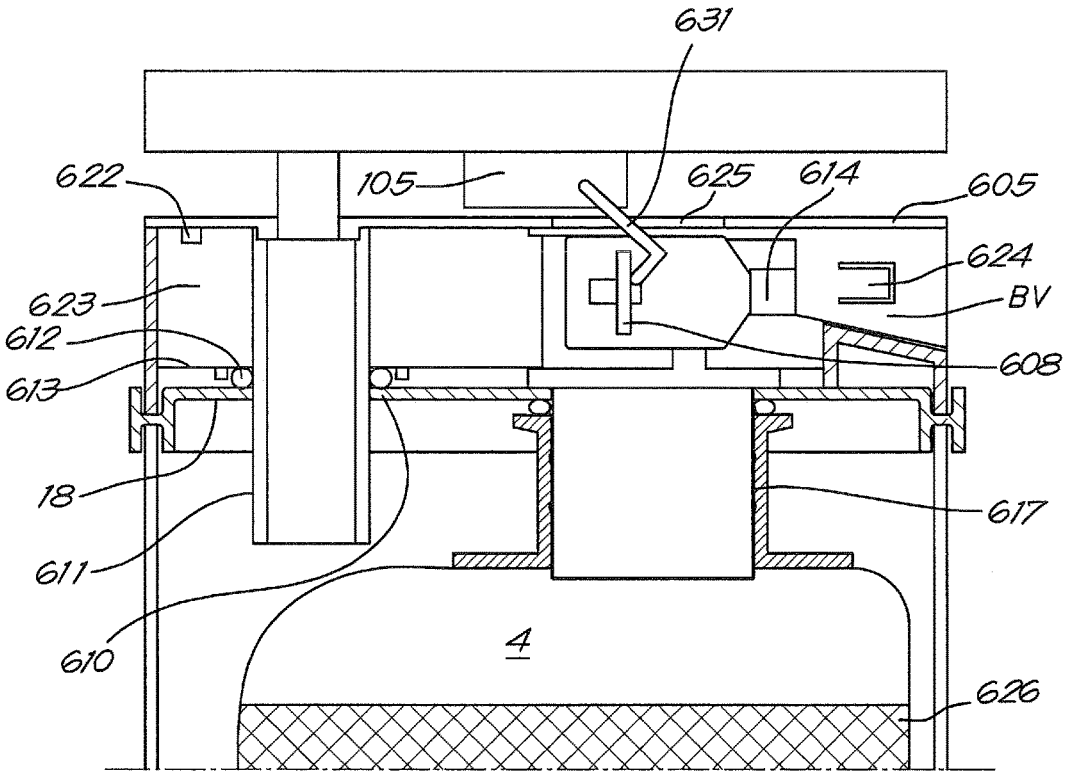
FIG. 44 is a view of the apparatus with the box in the locked position, and with the claw not yet acting on the control device to bring the valve into the open position.
Figure 46A:
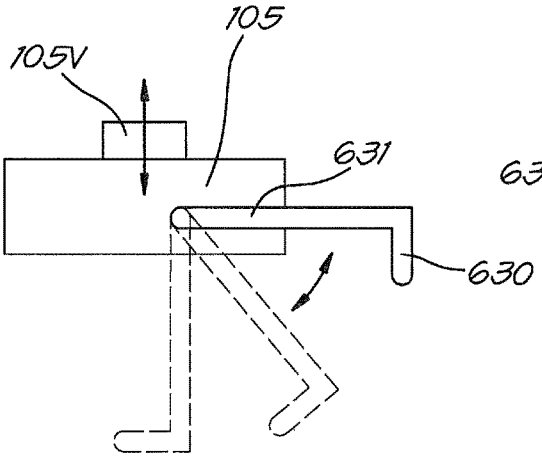
Figure 46B:
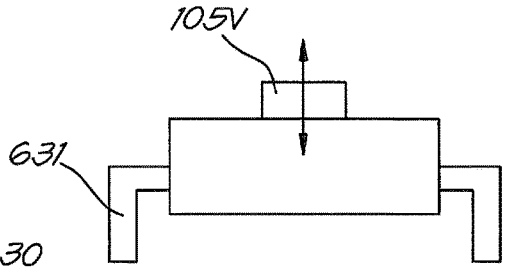
Figure 45:
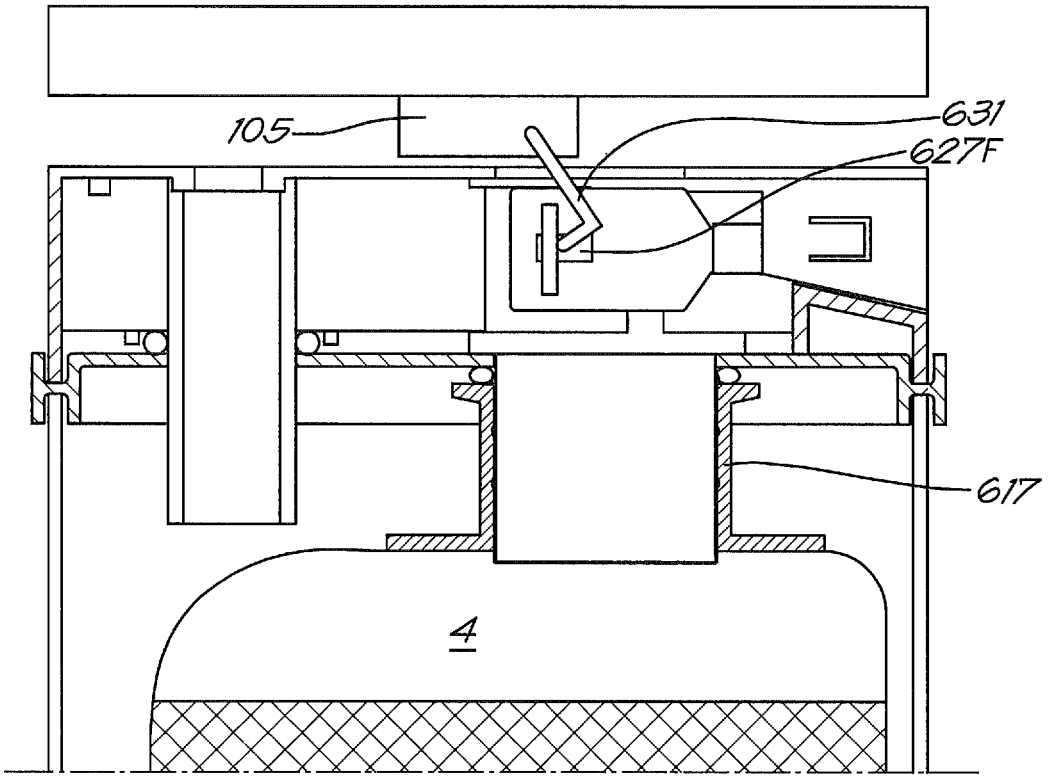
FIG. 45 is a view of the apparatus with the box in the locked position, and with the claw acting on the control device to bring the valve into the open position, and FIGS. 46A and B are views of the means of control with the claw.

FIGS. 41 and 42 are views of a unit of an apparatus for dispensing a quantity of a liquid or viscous food contained in a bag placed in a box according to the invention, in an appropriate temperature range, said apparatus comprising at least:

a structure (100) with at least one support element (101) for at least one box according to the invention;

a tank (102) for an aqueous medium;

a means (103) to adjust the temperature of at least a portion of said aqueous medium;

one or more connections (106A, 106B) to connect one or more passages of the box communicating with its inner chamber (3) to the outside of the bag (4); and a circuit (110) with at least one pump (111A) to circulate aqueous medium by the means (103) to adjust the temperature of at least a portion thereof and to circulate aqueous medium in the inner chamber (3) of the box outside the soft bag (4) and pressurize the aqueous medium present in the chamber (3), and a means of controlling (105) the amount of food dispensed comprising a mobile tool (631) capable of acting on the control device (601) of the valve (602).

The mobile tool has at least one claw-shaped element (631) capable of moving through a window (625) of the retention part (605) at least between a position acting on the control device (601) of the valve to bring it into the open position and a rest position in which the control device (601) of the valve is in a position corresponding to a closed position of the valve.

The mobile tool (631) has at least one claw-shaped element capable of moving (advantageously by at least one pivoting movement), between a position in which the claw is located outside the hollow or chamber of the cover of the box and a position in which the claw has an end located in the hollow or chamber of the cover and acts on the control device of the valve to bring it into the open position, with an intermediate position in which the claw is in a position in which the claw has an end located in the hollow or chamber of the cover, without acting on the control device of the valve to bring it into the open position.

The apparatus comprises a means to ensure correct positioning of the box with respect to the bottom of the apparatus. For this purpose, the unit comprises a support plate (PS) for the base of the container (1), said plate (PS) rotating (for example via a controlled motor (PSM)) around a substantially vertical or vertical axis (to be parallel to the central axis A-A of the container (1)), and a protrusion (150) on the rear face of the unit (100), this protrusion being designed to fit into the recess (627) of the cover (1C). By a slight rotational movement of the plate (PS) carrying a box according to the invention, it is possible to ensure correct positioning of the box by inserting the protrusion (150) in the hollow (627) of the cover (1C).

Once correctly positioned, the claw-holder (105) is moved, for example by an actuator (105V) in a vertical direction (either the claw-holder (105) is moved downwards, towards the cover (1C), or the plate (PS) is moved upwards), so as to bring the claws (631) close to the windows (625) of the retention part (605), and position them to allow them by a rotational movement to enter the hollow of the cover through the windows (625), to oppose removal of the box and to act on the lugs (608) of the valve.

What we claim is:

1. A rigid box having at least one wall (2) defining an inner chamber (3) in which a flexible bag (4) extends, which flexible bag (4) is designed to contain a liquid or viscous food to be consumed in an appropriate serving temperature range by using an aqueous medium flowing within the inner chamber (3), said flexible bag (4) being selected from the group consisting of a flexible bag (4) associated with a part (5) comprising a valve, a flexible bag (4) associated with a part (5) comprising a membrane, and a flexible bag (4) associable with a protection means (6) designed to cooperate with a part (7) comprising a valve; wherein said rigid box (1) having a lower part (1I) with a bottom (8), an upper part (1S) and at least one passage (9) for the part (5);

in which the flexible bag (4) defines within the inner chamber (3) the part located outside said flexible bag (4);

in which the box is at least associated with a means for protecting the at least one wall (2) against the liquid aqueous medium flowing within the inner chamber (3) outside the flexible bag (3);

in which the rigid box (1) is provided or associated, in the vicinity of the lower part (1I), with an element (8A) having at least one passage (10) designed to form a connection between the part of the inner chamber (3) located outside said bag (4) and a pipe (11), in which the rigid box (1) is provided or associated at its upper part (1S) with a plate (18) having the at least one first passage (9) designed to cooperate with the part (5,7) associated or associable with said flexible bag (4) and a second passage (610) towards the part of the inner chamber (3) outside the flexible bag (4), and in which at least a portion of the at least one side wall (2) of the rigid box (1) located between the lower part (1I) and the upper part (1S) cooperates with a means for forming one or more guide channels (12) between flexible the bag (4) and the said portion of the at least one side wall (2), said one or more guide channels (12) remaining open for passage of the aqueous medium between the passage of the lower part and the second passage of the plate (18) even in the presence of the flexible bag (4) in the inner chamber (3).

2. The rigid box of claim 1, in which at least a portion of the at least one side wall (2) of the rigid box (1) located between the lower part (1I) and the upper part (1S) cooperates with the means for forming a plurality of guide channels (12) between flexible the bag (4) and the said portion of the at least one side wall (2), said plurality of guide channels (12) being distributed along said at least one side wall (2).

3. A rigid box presenting a container (1) having at least one wall (2) defining an inner chamber (3) in which a flexible bag (4) for a liquid or viscous food to be consumed in an appropriate serving temperature range extends so as to define a part of the inner chamber (3) outside the flexible bag (4) by using an aqueous medium flowing within the part of the inner chamber (3) outside the flexible bag (4), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with: (a) at least one first passage (9) for at least a portion of the part (5) associated with the valve, and (b) a second passage (610) towards the part of the inner chamber (3) outside the flexible bag (4), and in which the upper part (1S) of the container is associated with a cover (1C) having one or more passages for an element capable of acting on the movable control device of the valve, this cover (1C) being associated with a spout (BV), in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the cover is provided with a pipe (611) adapted to cooperate with the second passage (610) of the plate (18) for at least limiting rotation of the cover (1C) relative to the plate (18), and enabling passage of air or liquid in the part of the inner chamber (3) outside the flexible bag (4).

4. A rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the cover (1C) is associated with at least one means of positioning (603, 604) of the portion with the control device in the chamber of the cover, and with at least one retention part (605) for said portion with the control device (601) of the valve (602), said retention part (605) being movable relative to said cover (1C) between a retention position in which said retention part (605) opposes withdrawal of the part with the control device (601) of the valve (602) from the chamber (600) of the cover (1C), and a non-retention position in which said retention part (605) does not oppose withdrawal of the portion with the control device (601) of the valve (602) from the chamber (600) of the cover (1C).

5. A rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the cover (1C) has, in its chamber (600), at least two tabs (603) spaced apart from each other, at least one of which is flexible, said tabs (603) serving as a means to cooperate with the portion with the control device (601) of the valve (602) to ensure positioning of said portion in the chamber (600) of the cover (1C).

6. The rigid box of claim 5, in which the cover (1C) presents a stop (604) in its chamber (600), said stop serving as a support for a wall (606) of the portion with the control device (601) of the valve (602) to limit or prevent movement of said portion of the valve (602) during relative movement of the control device (601) with respect to said portion of the valve (602).

7. A rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the portion with the control device (601) of the valve (602) has a body (607), while the control device (601) comprises at least one and advantageously two tabs (608) extending outside said body (607) and movable relative to said body (607) against the action of a biasing means (5R) between a first position corresponding to the closed position of the valve (5V) and a second position corresponding to the open position of the valve (5V), said biasing means (5R) exerting a force opposing the movement of said tab or tabs (608) towards its/their second position(s).

8. The rigid box of claim 7, in which the tabs (603) extending in the chamber (600) of the cover (1C) serve as a means of positioning of the lug or lugs (608) of the portion with the control device (601) of the valve (602) in the chamber (600) of the cover (1C).

9. The rigid box of claim 3, in which the container (1) has a central axis (A-A), and in which the control device (601) moves in a direction (B-B) perpendicular to said central axis (A-A) of the container (1).

10. The rigid box of claim 3, in which the plate (18) of the upper part (1S) has a means (610) cooperating with the cover (1C) to at least limit rotation of the cover (1C) relative to the container (1).

11. The rigid box of claim 10, in which the plate (18) has a passage (610) towards the inner chamber (3) of the container (1), while the protrusion (611) is a pipe carried by the cover (1C), thus enabling passage of air or liquid into the inner chamber (3) via the pipe (611) carried by the cover (1C).

12. The rigid box of claim 4, in which the container (1) has a central axis (A-A), and in which the retention part (605) is movable in a direction (C-C) perpendicular to said central axis (A-A), said retention part (605) comprising a spout (BV), an open end (614) of which accommodates one end of an outlet channel (615) of the valve (602).

13. A rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the plate (18) has a first side (18A) facing the inner chamber (3) and a second side (18B) opposite the first side and facing the chamber (600) of the cover (1C), in which the soft bag (4) is associated with a hollow tip (617), while the valve (602) is associated with an element (618) presenting an inner open channel (619), a transverse section enabling the insertion of the element (618) in the hollow tip (617), and a clamp (620) bearing on the second side (18B) of said plate (18).

14. The rigid box of claim 4, in which the retention part (605) is held in position on the cover (1C) by a system for insertion of a protrusion (622) in a recess or window (623).

15. The rigid box of claim 4, in which the retention part (605) has at least one window (625) giving access to the control device (601) of the valve (602) located in the chamber (600) of the cover (1C), the window (625) being positioned to enable the insertion in the chamber (600) of the cover of at least one end (630) of a tool (631) to apply a force on the control device (601).

16. A rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the flexible bag (4) comprises a first soft element (4B) and a second soft element (4A) bonded together to form a soft pouch, the first element (4B) being less supple than the second element (4A), this second element (4A) having an area facing the inside of the pouch at least 50% greater than the area of the first element (4B) facing the inside of the pouch.

17. The rigid box of claim 16, in which the flexible bag (4) is surrounded by a soft net (626).

18. The rigid box of claim 3, in which the cover (1C) has a positioning means (627), said positioning means extending along a side face (1CL) of the cover (1C).

19. An apparatus for dispensing a quantity of a liquid or viscous food contained in a bag placed in a box, in a suitable temperature range, in which the said box is a rigid box is selected from the group consisting of (A) a rigid box having at least one wall (2) defining an inner chamber (3) in which a flexible bag (4) extends, which flexible bag (4) is designed to contain a liquid or viscous food to be consumed in an appropriate serving temperature range by using an aqueous medium flowing within the inner chamber (3), said flexible bag (4) being selected from the group consisting of a flexible bag (4) associated with a part (5) comprising a valve, a flexible bag (4) associated with a part (5) comprising a membrane, and a flexible bag (4) associable with a protection means (6) designed to cooperate with a part (7) comprising a valve, said rigid box (1) having a lower part (1I) with a bottom (8), an upper part (1S) and at least one passage (9) for the part (5);

in which the flexible bag (4) defines within the inner chamber (3) a part located outside said flexible bag (4);

in which the box is at least associated with a means for protecting the at least one wall (2) against the liquid aqueous medium flowing within the inner chamber (3) outside the flexible bag (3);

in which the rigid box (1) is provided or associated, in the vicinity of its lower part (1I), with an element (8A)

having at least one passage (10) designed to form a connection between the part of the inner chamber (3) located outside said bag (4) and a pipe (11), in which the rigid box (1) is provided or associated with an element having at least one passage (9) designed to cooperate with the part (5,7) associated or associable with said flexible bag (4), and in which at least a portion of the at least one side wall (2) of the rigid box (1) located between the lower part (1I) and the upper part (1S) cooperates with a means for forming one or more guide channels (12) between flexible the bag (4) and the said portion of the at least one side wall (2), said one or more guide channels (12) remaining open for passage of the aqueous medium between the lower part and the upper part of the rigid box (1) even in the presence of the flexible bag (4) in the inner chamber (3), and (B) a rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), and in that the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C);

whereby said apparatus comprises at least:

A structure (100) with at least one support element (101) for said rigid box (1);

A tank (102) for the aqueous medium intended to flow within the inner chamber (3) of the said rigid box (1);

A means (103) for adjusting the temperature of at least part of said aqueous medium intended to flow within the inner chamber (3) of the said rigid box (1);

A tube (104) with a connection designed to cooperate with a passage in the upper part of the rigid box;

At least one connection (106A, 106B) for connecting one or more passages of the rigid box communicating with the inner chamber (3) of the box, outside the bag (4); and A circuit (110) with at least one pump (111A, 111B) to circulate said aqueous medium in the inner chamber (3) of the rigid box outside the flexible bag (4) and to pressurise the aqueous medium present in the inner chamber (3), and A means of control (105) of the quantity of food to be dispensed.

20. The apparatus of claim 19, in which the structure (100) comprises a part (1120) movable relative to the support element (101) between an open or raised position permitting the placing of a box (1) on the support element (101), and a closed or lowered position preventing the placing of a box (1) on the support element (101) or the removal of a box on the support element (101).

21. The apparatus according to claim 19, in which the support element (101) comprises one or more connection means (106B) designed to cooperate with at least one passage of the lower part (1I) communicating with the inner chamber (3) of the box (1) outside the flexible bag (4), said connection means (106B) being connected to one or more pipes (1I) for aqueous medium to flow in said circuit (110).

22. The apparatus according to claim 20, in that the movable part (1120) moving relative to the support element (101) comprises a connection means (106A) designed to cooperate with a passage (17) of the box communicating with the inside of the bag (4) and to cooperate with a dispensing tube (104), and a connection means (106A) designed to cooperate with a passage (14) of the box communicating with the inner chamber (3) outside the bag (4), wherein, when the movable part (1120) is in the open position, said connection means (106A) are remote from said passages of the box, while when said movable part (1120) is in the closed position, said connection means are in a suitable position to cooperate with a passage of the box communicating with the inside of the bag and to cooperate with a dispensing tube, as well as to cooperate with a passage (14) of the box communicating with the chamber (3) outside said bag (4).

23. The apparatus of claim 19, which comprises at least one support element (101) having a connection means (106B) designed to cooperate with at least one passage of the lower part of a box resting on the support element in question (101).

24. The apparatus of claim 19, in which the circuit (110) is associated with at least one expansion vessel (115) designed to be located at a level above the box bearing on the support element (101).

25. The apparatus of claim 19, in which the at least one pump (111A) of the circuit (110) is designed to provide a flow of aqueous medium from top to bottom in the box, outside the bag, which rests on a support element (101).

26. The apparatus of claim 19, in which the circuit (110) is associated with a vent valve (130).

27. The apparatus according of claim 19, which is associated with a control system preventing operation of the pump (111A) of the circuit when the movable part (1120) is in the open position.

28. The apparatus of claim 19, which comprises one or more safety systems when the aqueous medium level reaches a predetermined level in a container selected from the group consisting of the tank (102) and an expansion vessel (115).

29. The apparatus of claim 19, suitable for cooperating with a rigid box comprising a cover (1C) associated with at least one means of positioning (603, 604) of the portion with the control device in the chamber or hollow of the cover, and with at least one retention part (605) for said portion with the control device (601) of the valve (602), said retention part (605) being movable relative to said cover (1C) between a retention position in which said retention part (605) opposes withdrawal of the part with the control device (601) of the valve (602) from the chamber or hollow (600) of the cover (1C), and a non-retention position in which said retention part (605) does not oppose withdrawal of the portion with the control device (601) of the valve (602) from the chamber or hollow (600) of the cover (1C), whereby the apparatus comprises a mobile tool has at least one claw-shaped element (631) capable of moving through a window (625) of the retention part (605) at least between a position acting on the control device (601) of the valve to bring it into the open position and a rest position in which the control device (601) of the valve is in a position corresponding to a closed position of the valve.

30. The apparatus of claim 29, in which the mobile tool (631) has at least one claw-shaped element capable of moving between a position in which the claw is located outside the chamber of the cover of the box and a position in which the claw has an end located in the chamber of the cover and acts on the control device of the valve to bring it into the open position, with an intermediate position in which the claw is in a position in which the claw has an end located in the chamber of the cover, without acting on the control device of the valve to bring it into the open position.

31. A method of dispensing a liquid or viscous food contained in a bag placed in a box selected from the group consisting of (A) a rigid box having at least one wall (2) defining an inner chamber (3) in which a flexible bag (4) extends, which flexible bag (4) is designed to contain a liquid or viscous food to be consumed in an appropriate serving temperature range by using an aqueous medium flowing within the inner chamber (3), said flexible bag (4) being selected from the group consisting of a flexible bag (4) associated with a part (5) comprising a valve, a flexible bag (4) associated with a part (5) comprising a membrane, and a flexible bag (4) associable with a protection means (6) designed to cooperate with a part (7) comprising a valve, said rigid box (1) having a lower part (1I) with a bottom (8), an upper part (1S) and at least one passage (9) for the part (5);

in which the flexible bag (4) defines within the inner chamber (3) a part located outside said flexible bag (4);

in which the box is at least associated with a means for protecting the at least one wall (2) against the liquid aqueous medium flowing within the inner chamber (3) outside the flexible bag (3);

in which the rigid box (1) is provided or associated, in the vicinity of its lower part (1I), with an element (8A) having at least one passage (10) designed to form a connection between the part of the inner chamber (3) located outside said bag (4) and a pipe (11), in which the rigid box (1) is provided or associated with an element having at least one passage (9) designed to cooperate with the part (5,7) associated or associable with said flexible bag (4), and in which at least a portion of the at least one side wall (2) of the rigid box (1) located between the lower part (1I) and the upper part (1S) cooperates with a means for forming one or more guide channels (12) between flexible the bag (4) and the said portion of the at least one side wall (2), said one or more guide channels (12) remaining open for passage of the aqueous medium between the lower part and the upper part of the rigid box (1) even in the presence of the flexible bag (4) in the inner chamber (3), and (B) a rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), and in that the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C);

by using an apparatus comprising at least:

A structure (100) with at least one support element (101) for said rigid box (1);

A tank (102) for the aqueous medium intended to flow within the inner chamber (3) of the said rigid box (1);

A means (103) for adjusting the temperature of at least part of said aqueous medium intended to flow within the inner chamber (3) of the said rigid box (1);

A tube (104) with a connection designed to cooperate with a passage in the upper part of the rigid box;

At least one connection (106A, 106B) for connecting one or more passages of the rigid box communicating with the inner chamber (3) of the box, outside the bag (4);

A circuit (110) with at least one pump (111A, 111B) to circulate said aqueous medium in the inner chamber (3) of the rigid box outside the flexible bag (4) and to pressurise the aqueous medium present in the inner chamber (3), and A means of control (105) of the quantity of food to be dispensed, said method comprising at least the steps of :

placing on a support element of the apparatus at least a rigid box with a flexible bag containing a liquid or viscous food;

controlling the temperature of an aqueous medium to flow within the inner chamber (3) of the rigid box;

controlling the operation of the pump to bring aqueous medium having a suitable temperature under pressure into the inner chamber (3) of the rigid box; and controlling the opening of the valve for controlling the amount of liquid or viscous food from the flexible bag flowing into a container.

32. Cover (1C) for a rigid box presenting a container (1) having at least one wall (2) defining an inner chamber (3) in which a flexible bag (4) for a liquid or viscous food to be consumed in an appropriate serving temperature range extends so as to define a part of the inner chamber (3) outside the flexible bag (4) by using an aqueous medium flowing within the part of the inner chamber (3) outside the flexible bag (4), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with: (a) at least one first passage (9) for at least a portion of the part (5)

associated with the valve, and (b) a second passage (610) towards the part of the inner chamber (3) outside the flexible bag (4), in which the said cover is adapted to be associated to the upper part (1S) of the container, in which the said cover has one or more passages for an element capable of acting on the movable control device of the valve, and in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the cover is provided with a pipe (611) adapted to cooperate with the second passage (610) of the plate (18) for at least limiting rotation of the cover (1C) relative to the plate (18), and enabling passage of air or liquid in the part of the inner chamber (3) outside the flexible bag (4).

33. The cover of claim 20, in which the cover (1C) is associated with at least one means of positioning (603, 604) of the portion with the control device in the chamber of the cover, and with at least one retention part (605) for said portion with the control device (601) of the valve (602), said retention part (605) being movable relative to said cover (1C) between a retention position in which said retention part (605) opposes withdrawal of the part with the control device (601) of the valve (602) from the chamber or hollow (600) of the cover (1C), and a non-retention position in which said retention part (605) does not oppose withdrawal of the portion with the control device (601) of the valve (602) from the chamber or hollow (600) of the cover (1C).

34. Cover (1C) for a rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the said cover is adapted to be associated to the upper part (1S) of the container, in which the said cover has one or more passages for an element capable of acting on the movable control device of the valve, in which the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C), and in which the cover (1C) has, in its chamber or hollow (600), at least two tabs (603) spaced apart from each other, at least one of which is flexible, said tabs (603) serving as a means to cooperate with the portion with the control device (601) of the valve (602) to ensure positioning of said portion in the chamber (600) of the cover (1C).

35. The cover of claim 34, in which the cover (1C) presents a stop (604) in its chamber (600), said stop serving as a support for a wall (606) of the portion with the control device (601) of the valve (602) to limit or prevent movement of said portion of the valve (602) during relative movement of the control device (601) with respect to said portion of the valve (602).

36. A method of dispensing a liquid or viscous food contained in a bag placed in a rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), and in that the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C);

in which said rigid box is selected from with the group consisting of:

a rigid box further characterized in that the cover is provided with a pipe (611) adapted to cooperate with the second passage (610) of the plate (18) for at least limiting rotation of the cover (1C) relative to the plate (18), and enabling passage of air or liquid in the part of the inner chamber (3) outside the flexible bag (4);

a rigid box further characterized in that the cover (1C) is associated with at least one means of positioning (603, 604) of the portion with the control device in the chamber of the cover, and with at least one retention part (605) for said portion with the control device (601) of the valve (602), said retention part (605) being movable relative to said cover (1C) between a retention position in which said retention part (605) opposes withdrawal of the part with the control device (601) of the valve (602) from the chamber (600) of the cover (1C), and a non-retention position in which said retention part (605) does not oppose withdrawal of the portion with the control device (601) of the valve (602) from the chamber (600) of the cover (1C);

a rigid box further characterized in that the cover (1C) has, in its chamber (600), at least two tabs (603) spaced apart from each other, at least one of which is flexible, said tabs (603) serving as a means to cooperate with the portion with the control device (601) of the valve (602) to ensure positioning of said portion in the chamber (600) of the cover (1C);

a rigid box further characterized in that the portion with the control device (601) of the valve (602) has a body (607), while the control device (601) comprises at least one and advantageously two tabs (608) extending outside said body (607) and movable relative to said body (607) against the action of a biasing means (5R) between a first position corresponding to the closed position of the valve (5V) and a second position corresponding to the open position of the valve (5V), said biasing means (5R) exerting a force opposing the movement of said tab or tabs (608) towards its/their second position(s);

a rigid box further characterized in that the plate (18) has a first side (18A) facing the inner chamber (3) and a second side (18B) opposite the first side and facing the chamber (600) of the cover (1C), in which the soft bag (4) is associated with a hollow tip (617), while the valve (602) is associated with an element (618) presenting an inner open channel (619), a transverse section enabling the insertion of the element (618) in the hollow tip (617), and a clamp (620) bearing on the second side (18B) of said plate (18), and a rigid box further characterized in that the flexible bag (4) comprises a first soft element (4B) and a second soft element (4A) bonded together to form a soft pouch, the first element (4B) being less supple than the second element (4A), this second element (4A) having an area facing the inside of the pouch at least 50% greater than the area of the first element (4B) facing the inside of the pouch, by using an apparatus comprising at least:

A structure (100) with at least one support element (101) for said rigid box (1);

A tank (102) for the aqueous medium intended to flow within the inner chamber (3) of the said rigid box (1);

A means (103) for adjusting the temperature of at least part of said aqueous medium intended to flow within the inner chamber (3) of the said rigid box (1);

A tube (104) with a connection designed to cooperate with a passage in the upper part of the rigid box;

At least one connection (106A, 106B) for connecting one or more passages of the rigid box communicating with the inner chamber (3) of the box, outside the bag (4);

A circuit (110) with at least one pump (111A, 111B) to circulate said aqueous medium in the inner chamber (3) of the rigid box outside the flexible bag (4) and to pressurise the aqueous medium present in the inner chamber (3), and A means of control (105) of the quantity of food to be dispensed, said method comprising at least the steps of:

placing on a support element of the apparatus at least a rigid box with a flexible bag containing a liquid or viscous food;

controlling the temperature of an aqueous medium to flow within the inner chamber to (3) of the rigid box;

controlling the operation of the pump to bring aqueous medium having a suitable temperature under pressure into the inner chamber (3) of the rigid box; and controlling the opening of the valve for controlling the amount of liquid or viscous food from the flexible bag flowing into a container.

37. An apparatus for dispensing a quantity of a liquid or viscous food contained in a bag placed in a box, in a suitable temperature range, in which the said box is a rigid box presenting a container (1) having at least one wall (2) defining an inner chamber (3) in which a flexible bag (4) for a liquid or viscous food to be consumed in an appropriate serving temperature range extends by using an aqueous medium flowing within the inner chamber (3), said bag (4) being associated with a part (5) associated with a valve (602) with a portion with a movable control device (601) to move the valve between at least an open position and a closed position, said container (1) having a lower part (1I) with a bottom (8) presenting at least one opening (10) communicating with the inner chamber (3), an upper part (1S) with a plate (18) with at least one passage (9) for at least a portion of the part (5) associated with the valve, in which the upper part (1S) of the container is associated with a cover (1C) having one or more passages for an element capable of acting on the movable control device of the valve, this cover (1C) being associated with a spout (BV), and in that the cover (1C) defines a chamber (600) to accommodate at least partially the portion with the control device (601) of the valve (602), said cover (1C) comprising one or more means (603, 604) to attach said portion of the valve (602) to the cover (1C) and maintain said portion of the valve (602) in position during the movement of said control device (601) inside said chamber (600) of the cover (1C);

in which said rigid box is selected from with the group consisting of:

a rigid box further characterized in that the cover is provided with a pipe (611) adapted to cooperate with the second passage (610) of the plate (18) for at least limiting rotation of the cover (1C) relative to the plate (18), and enabling passage of air or liquid in the part of the inner chamber (3) outside the flexible bag (4);

a rigid box further characterized in that the cover (1C) is associated with at least one means of positioning (603, 604) of the portion with the control device in the chamber of the cover, and with at least one retention part (605) for said portion with the control device (601) of the valve (602), said retention part (605) being movable relative to said cover (1C) between a retention position in which said retention part (605) opposes withdrawal of the part with the control device (601) of the valve (602) from the chamber (600) of the cover (1C), and a non-retention position in which said retention part (605) does not oppose withdrawal of the portion with the control device (601) of the valve (602) from the chamber (600) of the cover (1C);

a rigid box further characterized in that the cover (1C) has, in its chamber (600), at least two tabs (603) spaced apart from each other, at least one of which is flexible, said tabs (603) serving as a means to cooperate with the portion with the control device (601) of the valve (602) to ensure positioning of said portion in the chamber (600) of the cover (1C);

a rigid box further characterized in that the portion with the control device (601) of the valve (602) has a body (607), while the control device (601) comprises at least one and advantageously two tabs (608) extending outside said body (607) and movable relative to said body (607) against the action of a biasing means (5R) between a first position corresponding to the closed position of the valve (5V) and a second position corresponding to the open position of the valve (5V), said biasing means (5R) exerting a force opposing the movement of said tab or tabs (608) towards its/their second position(s);

a rigid box further characterized in that the plate (18) has a first side (18A) facing the inner chamber (3) and a second side (18B) opposite the first side and facing the chamber (600) of the cover (1C), in which the soft bag (4) is associated with a hollow tip (617), while the valve (602) is associated with an element (618) presenting an inner open channel (619), a transverse section enabling the insertion of the element (618) in the hollow tip (617), and a clamp (620) bearing on the second side (18B) of said plate (18), and a rigid box further characterized in that the flexible bag (4) comprises a first soft element (4B) and a second soft element (4A) bonded together to form a soft pouch, the first element (4B) being less supple than the second element (4A), this second element (4A) having an area facing the inside of the pouch at least 50% greater than the area of the first element (4B) facing the inside of the pouch, whereby said apparatus comprises at least:

A structure (100) with at least one support element (101) for said rigid box (1);

A tank (102) for the aqueous medium intended to flow within the inner chamber (3) of the said rigid box (1);

A means (103) for adjusting the temperature of at least part of said aqueous medium intended to flow within the inner chamber (3) of the said rigid box (1);

A tube (104) with a connection designed to cooperate with a passage in the upper part of the rigid box;

At least one connection (106A, 106B) for connecting one or more passages of the rigid box communicating with the inner chamber (3) of the box, outside the bag (4); and A circuit (110) with at least one pump (111A, 111B) to circulate said aqueous medium in the inner chamber (3) of the rigid box outside the flexible bag (4) and to pressurise the aqueous medium present in the inner chamber (3), and A means of control (105) of the quantity of food to be dispensed.

* * * * *